US011072985B2

(12) United States Patent
Akkerman et al.

(10) Patent No.: US 11,072,985 B2
(45) Date of Patent: Jul. 27, 2021

(54) UNLOCKING AND UNBLOCKING TOOL FOR DISCONNECT ASSEMBLY FOR CYLINDRICAL MEMBERS

(71) Applicants: Neil H. Akkerman, Houston, TX (US); John A. Barton, Arlington, TX (US)

(72) Inventors: Neil H. Akkerman, Houston, TX (US); John A. Barton, Arlington, TX (US)

(73) Assignees: Neil H. Akkerman, Houston, TX (US); John A. Barton, Houston, TX (US)

( * ) Notice: Subject to any disclaimer, the term of this patent is extended or adjusted under 35 U.S.C. 154(b) by 1015 days.

(21) Appl. No.: 15/369,507

(22) Filed: Dec. 5, 2016

(65) Prior Publication Data

US 2017/0081932 A1 Mar. 23, 2017

Related U.S. Application Data

(63) Continuation of application No. 13/407,592, filed on Feb. 28, 2012, now Pat. No. 9,512,683.

(60) Provisional application No. 61/447,471, filed on Feb. 28, 2011.

(51) Int. Cl.
*E21B 23/03* (2006.01)
*E21B 17/06* (2006.01)

(52) U.S. Cl.
CPC ..... *E21B 23/03* (2013.01); *E21B 17/06* (2013.01)

(58) Field of Classification Search
CPC ..... E21B 23/03; E21B 17/06
See application file for complete search history.

(56) References Cited

U.S. PATENT DOCUMENTS 2,302,856 A 11/1942 Hamon
3,112,796 A * 12/1963 Myers ..... E21B 33/1295 166/120
3,622,185 A 11/1971 Rosan
(Continued)

FOREIGN PATENT DOCUMENTS

CA 2744942 A1 6/2010

OTHER PUBLICATIONS

Extended European Search Report dated Jul. 5, 2017, for European Application No. 12751793.6 (6 pages).
(Continued)

*Primary Examiner* — David J Bagnell
*Assistant Examiner* — Jonathan Malikasim
(74) *Attorney, Agent, or Firm* — Conley Rose, P.C.

(57) ABSTRACT

Disclosed is an assembly for disconnecting portions of a downhole tubular string, such as a drill stem or drill string, and removing an upper portion of the tubular string from the lower stuck portion in a well. The disconnect assembly includes a connection between joints of two portions of the tubular string. The assembly includes two tubular members and an inner sleeve having two splines each with different angular pitches or teeth counts. The assembly may include a rotary shouldered threaded connection, wherein the two tubular portions are disconnectable at the rotary shouldered threaded connection in the assembly. The assembly may include a sleeve lock, a selective no-go for landing in a profile, and a selectively deployable unlocking and unblocking tool for activating the assembly. The assembly may include connectable cylindrical members other than downhole tubulars.

29 Claims, 91 Drawing Sheets

(56) References Cited

U.S. PATENT DOCUMENTS

| | | | | |
|---|---|---|---|---|
| 3,638,723 | A * | 2/1972 | Carroll | E21B 23/02 166/215 |
| 4,823,872 | A * | 4/1989 | Hopmann | E21B 23/02 166/217 |
| 5,819,854 | A * | 10/1998 | Doane | E21B 23/00 166/373 |
| 6,408,946 | B1 | 6/2002 | Marshall | |
| 8,141,634 | B2 * | 3/2012 | Fisher | E21B 17/06 166/250.13 |
| 8,322,432 | B2 * | 12/2012 | Bailey | E21B 33/085 166/344 |
| 8,469,106 | B2 * | 6/2013 | Caminari | E21B 23/00 166/373 |
| 2009/0301711 | A1 | 2/2009 | Jagert | |

OTHER PUBLICATIONS

Canadian Office Action dated Nov. 23, 2018, for Application No. 2,894,001.

* cited by examiner

UNLOCKING AND UNBLOCKING TOOL FOR DISCONNECT ASSEMBLY FOR CYLINDRICAL MEMBERS

CROSS-REFERENCE TO RELATED APPLICATIONS

This application is a continuation of U.S. application Ser. No. 13/407,592 filed Feb. 28, 2012, and entitled "Disconnect Assembly for Cylindrical Members," which claims priority to U.S. Provisional Application No. 61/447,471 filed Feb. 28, 2011, and entitled "Disconnect Assembly for Tubular Members," both of which are hereby incorporated herein by reference in their entirety for all purposes.

STATEMENT REGARDING FEDERALLY SPONSORED RESEARCH OR DEVELOPMENT

Not applicable.

BACKGROUND

This disclosure relates to releasable connections between cylindrical members or bodies. In some aspects, this disclosure relates to connections between downhole tubulars, such as drill pipe tool joints, as are employed in the rotary system of drilling. More particularly, the downhole tubular connections or drill pipe tool joints include connections configured to be selectively disconnectable within the well bore, such that upper and lower portions of the downhole tubular string can be separated.

In drilling by the rotary method, a drill bit is attached to the lower end of a drill stem composed of lengths of tubular drill pipe and other components joined together by tool joints with rotary shouldered threaded connections. In this disclosure, "drill stem" is intended to include other forms of downhole tubular strings such as drill strings and work strings. A rotary shouldered threaded connection may also be referred to as a RSTC. Furthermore, the tubular members that make up a drill stem may also be substituted with other rods, shafts, or other cylindrical members that may be used at the surface and which may require a releasable connection.

The drill stem may include threads that are engaged by right hand and/or left hand rotation. The threaded connections must sustain the weight of the drill stem, withstand the strain of repeated make-up and break-out, resist fatigue, resist additional make-up during drilling, provide a leak proof seal, and not loosen during normal operations.

The rotary drilling process subjects the drill stem to tremendous dynamic tensile stresses, dynamic bending stresses and dynamic rotational stresses that can result in premature drill stem failure due to fatigue. The accepted design of drill stem connections is to incorporate coarse tapered threads and metal to metal sealing shoulders. Proper design is a balance of strength between the internal and external threaded connection. Some of the variables include outside diameter, inside diameters, thread pitch, thread form, sealing shoulder area, metal selection, grease friction factor and assembly torque. Those skilled in the art are aware of the interrelationships of these variables and the severity of the stresses placed on a drill stem.

The tool joints or pipe connections in the drill stem must have appropriate shoulder area, thread pitch, shear area and friction to transmit the required drilling torque. In use, all threads in the drill string must be assembled with a torque exceeding the required drilling torque as a minimum, or more to handle tensile and bending loads without shoulder separation because shoulder separation causes leaks and fretting wear.

Drill stem and tool joints with rotary shouldered threaded connections are addressed by industry accepted standards such as, but not limited to: International Industry Standard (ISO), ISO 10424-1:2004 (modified)—Part 1 and Part 2; Petroleum and natural gas industries-Rotary drilling equipment—Part 1: Rotary drill stem elements; American Petroleum Institute (API), API 7-1 Specification for Rotary Drill Stem Elements; API 7G Recommended Practice for Drill Stem Design and Operating Limits; and others. These standards address design, manufacture, use and maintenance of drill stem thread joints.

Offshore drilling, for example, is performed in progressively deeper water, with deeper penetration of the earth and possibly having higher deviations from a vertical bore hole. Further, many wells now have sections of horizontal bore hole. The temperatures are high, the friction between drill stem and borehole is high, the hanging weight is extreme and the well bores may not be straight. Consequently, a portion of the drill stem often becomes stuck at a great distance from the surface, preventing its movement and recovery. Further causes of stuck drill pipe include accumulation of cuttings falling out of circulated fluids, unconsolidated earth caving in the borehole, low pressure strata capturing the drill stem due to differential pressure, and the like.

In rotary drilling, to remove stuck drill stem from the well, typically the first remedial action is to identify the point at which the drill stem is stuck. A decision is then often made to either explosively loosen a thread joint or sever the drill stem with highly reactive explosive or chemical tools.

Highly specialized crews, equipment and tools must be mobilized and transported to the well location. The transportation of explosive or highly reactive chemical tools is subject to tight governmental regulation. The use of such explosive or highly reactive chemical tools presents a risk to the well operation in that the possibility exists that accidental discharge on the surface can cause property damage and injury or death to personnel. Mobilization and transportation can consume a significant amount of expensive, non-productive time.

Current tubing disconnects designed for within-the-wellbore activation are lacking. In the discussion below, tubing disconnects are disposed in work strings or pipe strings used for coiled tubing drilling, well completion, workover, and other services less demanding than rotary drilling. Consequently, current tubing disconnects do not meet the requirements of the ISO and/or API specifications for rotary drilling equipment. They incorporate non-shouldered connections and/or connections that do not establish a stress pattern within the connection to prevent shoulders from separation under extreme tension and/or bending loads.

Further, current tubing disconnects employ non-metal seals. Failure of one of these seals may result in a washout or total joint failure. The sliding fit of the seals facilitates fretting and wear as the tubing is flexed in response to axial, bending and rotational forces. Some tubing disconnects make use of springs or washers that restrict the inside diameter of the tubing string, or leave a connection in the well that cannot be easily reconnected without special tools. Some tubing disconnects leave a ball or other activation device in the well that can inhibit additional work that may be required after recovery of the upper unstuck tubing section.

Various current tubing disconnects are intended for very specific applications. Often, the environment in which these tubing disconnects are operated is relatively stable and predictable. For example, such tubing disconnects are intended for releasing perforating guns after firing, sub-sea risers, or coiled tubing drilling bits. However, such tubing disconnects do not have the ruggedness and are not designed to operate in the extremes of rotary drilling. Such tubing disconnects often include mechanical features that a driller would recognize as a weak link in a rotary drill stem.

Some current tubing disconnects include pressure activation, requiring the ability to circulate fluids within the well tubing. Pressure activated tubing disconnects are typically activated by dropping or pumping a ball or like device to engage a seat, so that pressure may be applied down the tubing to initiate disconnection. Without circulation, differential pressure cannot be reliably established to disconnect the tubing. The seat is a restriction to and subject to damage by the passage of instruments such as measurement while drilling tools and the like. Accidental impact of tools passing the seat may initiate inadvertent and unwanted disconnection. If the well tubing is plugged, a circulation port must be opened before disconnection is possible. A circulation port degrades the reliability and pressure integrity of the tubing.

In the process of drilling a well, a drill bit and drill stem may drill a significant distance into the earth without requiring removal and refitting of a new drill bit. It is problematic to determine where to install a disconnect within the drill stem. Deciding the optimum location of a disconnect requires an accurate estimation of the probable depth of the portion of the drill stem that has become stuck. This problem is compounded because a disconnect is lowered progressively deeper as the well is drilled. The tubing or drill stem may become stuck due to solids, such as sand, falling out of well fluid suspension at any depth within a well.

The several embodiments described herein overcome these and other limitations in the art. By way of example, and in no way limiting the scope of this disclosure, a downhole tubular string disconnect mechanism in accordance with the principles disclosed herein may be configured for selective activation within the well bore, meet industry standards and/or expectations of ruggedness for rotary drilling and other downhole applications, be insensitive to the passage of instruments and tools, not require well fluid circulation, not require pressure application to the drill stem, not leave an obstructed well bore after disconnection, and allow disconnection of a drill stem at selectable, multiple locations by installing multiple disconnects along the length of the drill stem and providing the ability to disconnect the lowest one in the unstuck portion of the drill stem. Other limitations are also overcome, including for cylindrical member couplings such as for drive shafts.

NOMENCLATURE

The words up, upper, upward or upwardly refer to a direction, portion, motion or action that is closer to the surface of the earth and/or closer to the surface of the water and/or that which is further from the bottom of the well.

The words down, lower, downward or downwardly refer to a direction, portion, motion or action that is further from the surface of the earth and/or further from the surface of the water and/or that which is closer to the bottom of the well.

"Rotary shouldered threaded connection" (RSTC) is a tubular connection with rotationally engaged threads and one or more contacting shoulders to limit engagement and relative movement between two tubulars or pipes.

"Tool joint" is a heavy coupling element utilizing a rotary shouldered connection. A tool joint in a drill stem typically has coarse tapered threads and sealing shoulders designed to sustain the weight of the drill stem, withstand the strain of repeated make-up and break-out, resist fatigue, resist additional make up during drilling and provide a leak proof seal. API specifications include a series of numbered tool joint designs; however, proprietary tool joint designs exist that are different from the numbered tool joints of API that include rotary shouldered connections.

"Drill stem" is an assembly of components joined by tool joints for use in a well for rotary drilling. Components such as a drill bit, a bit sub, drill collars, crossover subs, drill pipe, kelley valves, a swivel sub, a swivel and the like are included. "Drill string" is a length of connected drill pipes used for drilling. As previously described, "tubing" refers to those conveyances used for coiled tubing drilling, well completion, workover, and other services less demanding than rotary drilling. The terms "tubular member" or "tubular string" refer to all of the various pipes and strings mentioned above regardless of their specific application in the well.

"Minimum make-up torque" is the minimum amount of torque necessary to develop an arbitrary derived tensile stress in the external thread or compressive stress in the internal thread of a tool joint. This arbitrary derived stress level is perceived as being sufficient in most conditions to prevent downhole make-up and to prevent shoulder separation from bending loads.

"Friction factor" is a value that represents the coefficient of friction of mating surfaces within a threaded connection and the relative magnitude of assembly torque required to achieve a recommended stress level in an assembled connection, as specified by the API.

"Torque turn" is a technique of recording assembly torque and rotation as a thread connection is assembled or disassembled. The collected data is usually analyzed on a computer with specialized software.

"Washout" is a portion of borehole enlarged by erosion of high velocity fluid flow or leakage.

SUMMARY

An assembly for disconnecting and removing an upper portion of a drill stem or tubular string from a well is represented by the various embodiments herein. The drill stem or tubular string may become stuck in the well, and the disconnect assembly may be used to separate an upper portion of the drill stem from a lower, stuck portion of the drill stem. In one embodiment, the disconnect assembly (also referred to as a drill stem disconnect or DSD) comprises an upper body and a lower body connected by a rotary shouldered threaded connection (RSTC), wherein the assembly is adapted to be installed as part of a rotary drill stem. It is understood that the drill stem may be other various kinds of tubular strings, and the RSTC may be other kinds of joints such as non-shouldered joints and joints not meeting specific API standards, without affecting the principles disclosed herein.

The RSTC may be configured to assemble at a lower torque than other connections within the drill stem and meet the requirements of accepted drilling industry standards. The RSTC may be configured to assemble with rotation in either direction. The DSD may be configured to withstand the fatigue caused by dynamic tensile, compressive and rotational loads experienced within a rotary drill stem. The upper and lower bodies, when in a locked position, may be blocked from relative rotation by a third body engaging the upper and lower bodies after proper torque has been applied, thereby assuring retention of proper assembly torque and allowing the transmission of torque equal to the other connections of the drill stem. The third body may be locked in place and may be selectively released and moved from blocking engagement of the upper and lower bodies.

An activation tool, or unlocking and unblocking tool (UUT), may selectively unlock and move the third body out of blocking engagement with at least one of the upper or lower bodies, to allow rotation for disengaging the upper and lower bodies. The tool may be powered by hydrostatic pressure within the well bore. Circulation of well fluids may not be required and pressure need not be applied to the well. An embodiment of the tool may include a selective anchor allowing any one of multiple identical drill stem disconnects installed in the drill stem to be unlocked and unblocked. The UUT may be configured such that it is retained and removed with the upper body and the upper disconnected portion of the drill stem. After removal of the upper disconnected portion of the drill stem, the upward facing connection of the lower body, remaining in the well, is unobstructed, facilitating re-attachment of a later deployed string or tool.

A drill stem tool joint depends on proper assembly torque to achieve optimum performance. If all tool joints in a drill stem similarly configured, then they are typically assembled with the same torque. If the tool joints within a drill stem vary in size, proprietary design, material properties and the like, then they must be assembled with a minimum make up torque value that exceeds the torque value required to be transmitted during drilling operations. If a joint cannot withstand this level of assembly or make up torque, then the joints are sometimes bonded using epoxy compounds. Assembly torque may need to be greater and vary along the length of drill stem to prevent tensile and bending loads from separating the rotary shoulders within a tool joint.

The torque required to disassemble a particular tool joint is a function of assembly torque. More assembly torque results in more disassembly torque necessitated to disassemble the tool joint. Furthermore, tool joints may tighten when in use because of jarring and/or impact of the working drill bit, temperature effects on thread lubricants, and time of use.

When a drill stem becomes stuck within the well bore, it is problematic to determine where along the length of drill stem that reverse torque will disengage a tool joint.

It is possible, within the parameters and equations specified within API 7G, to have tool joints of equal strength that require different minimum assembly torque. For instance, differing friction factors and other variables within the equations specified within API 7G can individually or in combination provide similar variations of required minimum assembly torque. If the equal strength, but lower assembly torque tool joint is rotationally blocked from further assembly or disassembly, it can be used in a drill stem at higher torque levels.

An example of this concept is to assemble identical tool joints with lubricants of different friction factors, the high torque tool joints assembled with high friction factor grease and the low assembly torque joints assembled with low friction factor grease and subsequently disposed to be rotationally blocked from further assembly or disassembly. However, a tool joint assembled with low torque and not rotationally blocked will disassemble with low torque. Thus a stuck drill string will disassemble, through reverse rotation of the upper un-stuck drill string, at an unblocked low assembly torque tool joint location. A rotationally blocked, low assembly torque tool joint that facilitates selective, within-the-well-bore un-blocking, can facilitate the removal of the upper unstuck drill stem and yet satisfy industry standards, such as API 7G, when rotationally blocked.

It is common to utilize so called "Torque Turn" techniques to assure proper assembly of tool joints. This technique accurately measures the torque as a tool joint is rotated during assembly. Those with ordinary skill in the art are aware that, during assembly, there is very little rotation after the rotary shoulders achieve minimum torque as contact is made, and there is little additional rotation to achieve maximum torque.

Those with ordinary skill in the art understand that each time a tool joint is assembled, disassembled and reassembled that variations in angular position between the halves of the tool joint are common due to wear, variations of lubricant thickness and the like.

In some embodiments, a disconnect assembly includes an upper body and a lower body connected by a rotary shouldered threaded connection, adapted to be installed as part of a rotary drill stem. The rotary shouldered threaded connection is adapted to assemble at a lower torque than other connections within the drill stem and meet the requirements of accepted drilling industry standards. The rotary shouldered threaded connection may be configured to assemble with rotation in either direction. The assembly is designed to withstand the fatigue caused by dynamic tensile, compressive and rotational loads experienced within a rotary drill stem. The upper and lower bodies are blocked from further rotation by a third body, or rotational blocking sleeve, engaging the upper and lower bodies after proper torque has been applied, thereby assuring retention of proper assembly torque and allowing the transmission of torque equal to the other connections of the drill stem. The third body is locked in place and may be selectively released and moved from blocking engagement. A locking assembly has a bore larger than surrounding bores and is thus protected from accidental engagement when well bore instruments or tools are passed therethrough.

The rotational blocking sleeve or member provides accurate rotational positioning between the upper and lower bodies for proper torque retention. The blocking sleeve accommodates variations of angular alignment when the upper and lower bodies are properly assembled. In some embodiments, the blocking member is a serrated or splined blocking sleeve that facilitates selective blocking and unblocking of the upper and lower bodies, wherein the upper and lower bodies are joined by a low assembly torque rotary shouldered threaded connection.

In the embodiments disclosed herein, a method is presented that addresses one or more of the limitations noted above. The blocking sleeve is moveable to and from blocking engagement with the upper and lower bodies using a sliding fit including a small amount of angular clearance. The splines or first serration of the upper body include a different number of teeth, or a different angular pitch, than the splines or second serration of the lower body. The blocking sleeve includes accommodating or mating splines or serrations. The blocking sleeve serrations have a progressive, incremental angle between the individual features or teeth forming the serrations because of the differing number of teeth or angular pitch. In one embodiment, the incremental pitch between upper and lower serrations on the blocking sleeve is smaller than the total of the angular clearance between the upper body serration and the upper serration of the blocking sleeve plus the angular clearance between the lower body serration and the lower serration of the blocking sleeve. Thus, no matter how the upper and lower bodies angularly align, the blocking sleeve may be rotated and moved into blocking engagement therebetween.

By way of example, if the blocking sleeve has a 50-tooth serration on one axial end and a 51-tooth serration on the other axial end, the incremental angle will be $$360°/50 \cdot 51 \sim 0.14° \text{(approximately)}.$$

Thus, if the total angular clearance is 0.2 degrees, the blocking sleeve may be installed for any angular orientation of the upper and lower splines and the maximum angular deviation from nominal is 0.2 degrees. It is noted that other angular clearances, both less than and greater than 0.2 degrees can be used.

The compressive stress retained in the rotationally blocked rotary shouldered connection of the assembly embodiments described herein is retained between a minimum and maximum allowed value. So when configured, the upper and lower bodies or subs of the disconnect assembly disclosed herein may be torqued to a specific or predetermined value and, without rotational adjustment, the blocking sleeve may be engaged.

In some embodiments, the blocking sleeve is retained in the engaged position by a locking mechanism that transfers impact and vibration forces directly from the blocking sleeve to the upper and lower bodies of the assembly. The locking mechanism is held and selectively released in response to forces applied by the unlocking and unblocking tool disclosed herein.

In some embodiments, an unlocking and unblocking tool selectively unlocks and moves the sleeve out of blocking engagement between the upper or lower bodies, to allow rotation to disengage the upper and lower bodies of the drill stem disconnect assembly. The UUT is powered by hydrostatic pressure within the well bore. Circulation of well fluids is not required and pressure need not be applied to the well. The UUT includes a selective anchor allowing any one of multiple identical drill stem disconnects installed in the drill stem to be unlocked and unblocked. The activating UUT is configured such that it is retained and removed with the upper body and the upper disconnected portion of the drill stem. After removal of the upper disconnected portion of the drill stem, the upward connection of the lower body, remaining in the well, is unobstructed, facilitating re-attachment.

In some embodiments, a disconnect assembly includes a first body including a first serration, a second body including a second serration, and a third body including a third serration to be engaged with the first serration using a first number of teeth, and the third body include a fourth serration to be engaged with the second serration using a second number of teeth to lock the first body relative to the second body. In an embodiment, the third body is free to rotate to align the first and third serrations and the second and further serrations prior to movement of the third body to a locking position.

In some embodiments, a disconnect assembly includes a first tubular member including a first inner serration, a second tubular member including a second inner serration, wherein the first tubular member is coupled to the second tubular member, and an inner sleeve including an upper serration engaged with the first inner serration with a first angular pitch, and a lower serration engaged with the second inner serration with a second angular pitch. In an embodiment, the upper serration and the first inner serration each have the same number of teeth, and the lower serration and the second inner serration each have the same number of teeth that is different than the number of upper serration teeth. In an embodiment, the engaged upper serration and first inner serration has a first clearance, the engaged lower serration and second inner serration has a second clearance, and the upper and lower serrations have an incremental pitch less than the sum of the first and second clearances.

In some embodiments, a disconnect assembly includes a first tubular member including a first inner serration, a second tubular member including a second inner serration, an inner sleeve including an upper serration engaged with the first inner serration and a lower serration engaged with the second inner serration, and a rotary shouldered and threaded connection coupling the first and second tubular members. In an embodiment, the upper and lower serrations are axially engageable with the first and second serrations for any rotational position of the inner sleeve using a first angular pitch for the upper engaged serration and a second angular pitch for the lower engaged serration.

In some embodiments, a disconnect assembly includes a first tubular member including a first inner spline, a second tubular member including a second inner spline, and an inner sleeve including an upper spline engaged with the first inner spline and a lower spline engaged with the second inner spline, wherein the inner sleeve is held into engagement with the first and second tubular members by a lock.

In some embodiments, a disconnect assembly for a downhole tubular string includes a first body connected to a second body with a threaded connection, a first serration in the first body, a second serration in the second body, a third body including upper and lower serrations for mating engagement with the first and second serrations, the third body, in a first position, prevents rotation between the first and second bodies, and in a second position allows relative rotation between the first and second bodies, and the upper and lower serrations are aligned with the first and second serrations for movement of the third body between the first and second positions after an assembly torque is applied to develop a predetermined amount of axial load between the first and second bodies. In an embodiment, the third body is free to rotate between the first and second positions to align the upper and lower serrations with the first and second serrations for movement of the third body into a locking position.

These and other features will be readily apparent to those skilled in the art upon reading the following detailed description of the embodiments and by referring to the accompanying drawings.

BRIEF DESCRIPTION OF THE DRAWINGS

For a more detailed description of embodiments of the invention, reference will now be made to the accompanying drawings, wherein.

DETAILED DESCRIPTION

Figure 1:
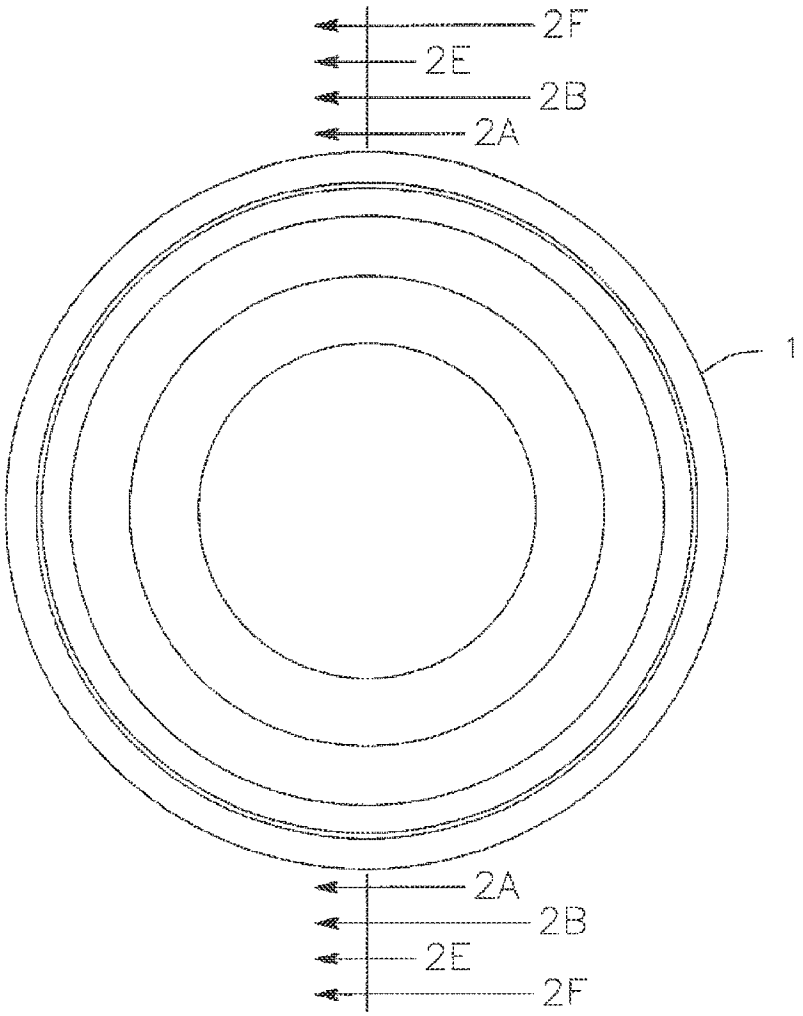
FIG. 1 is an end view defining section views FIGS. 2A, 2B, 2E, and 2F.

Referring collectively to FIGS. 1, 2A-2F, 3-8, 22 and 22A-22D, an embodiment of a drill stem disconnect assembly 50 and a blocking sleeve 3 are illustrated. The drill stem disconnect assembly 50 (FIG. 2B) includes a generally tubular shape with an outer surface 51. An upper body or sub 1 is connected to a lower body or sub 2 (FIG. 2C) by a tool joint 15. Tool joint 15 is a heavy coupling element utilizing a rotary shouldered and threaded connection.

Figure 2A:
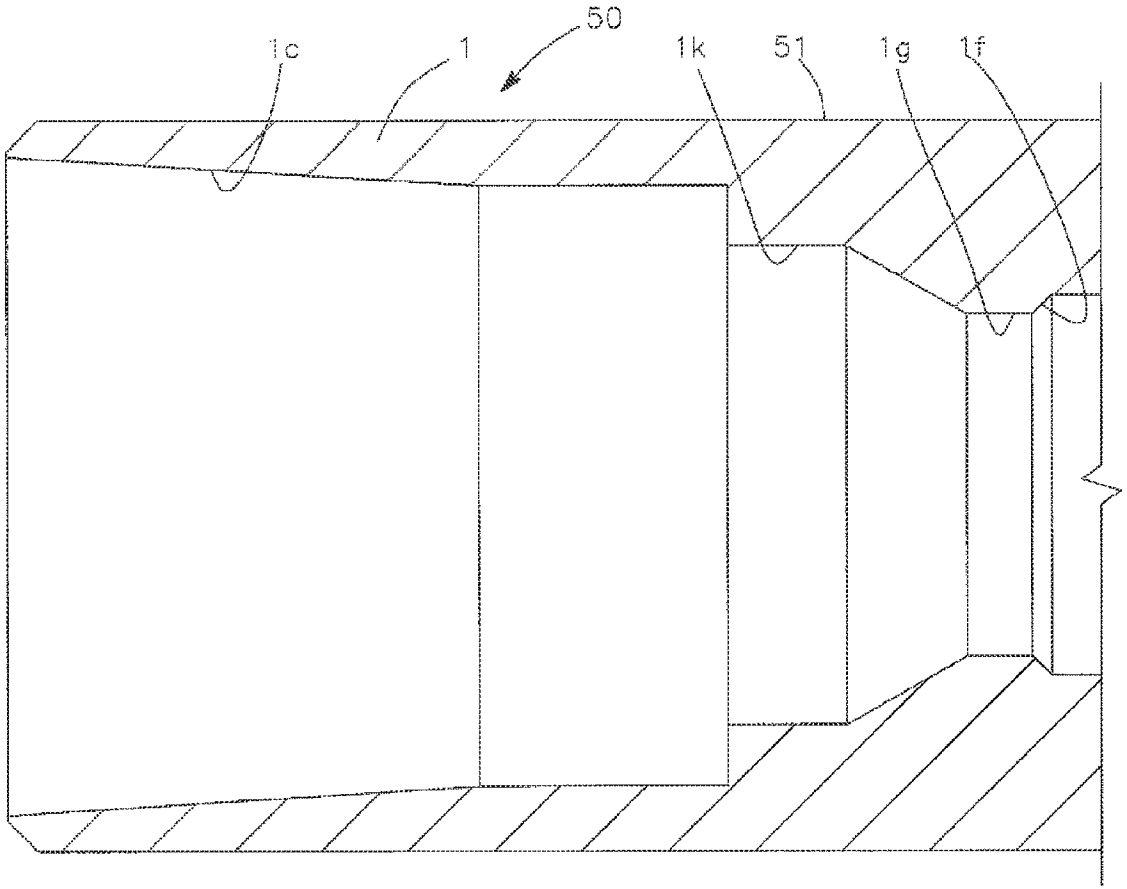
FIG. 2A is a section view of the upper most end of the DSD.
Figure 2B:
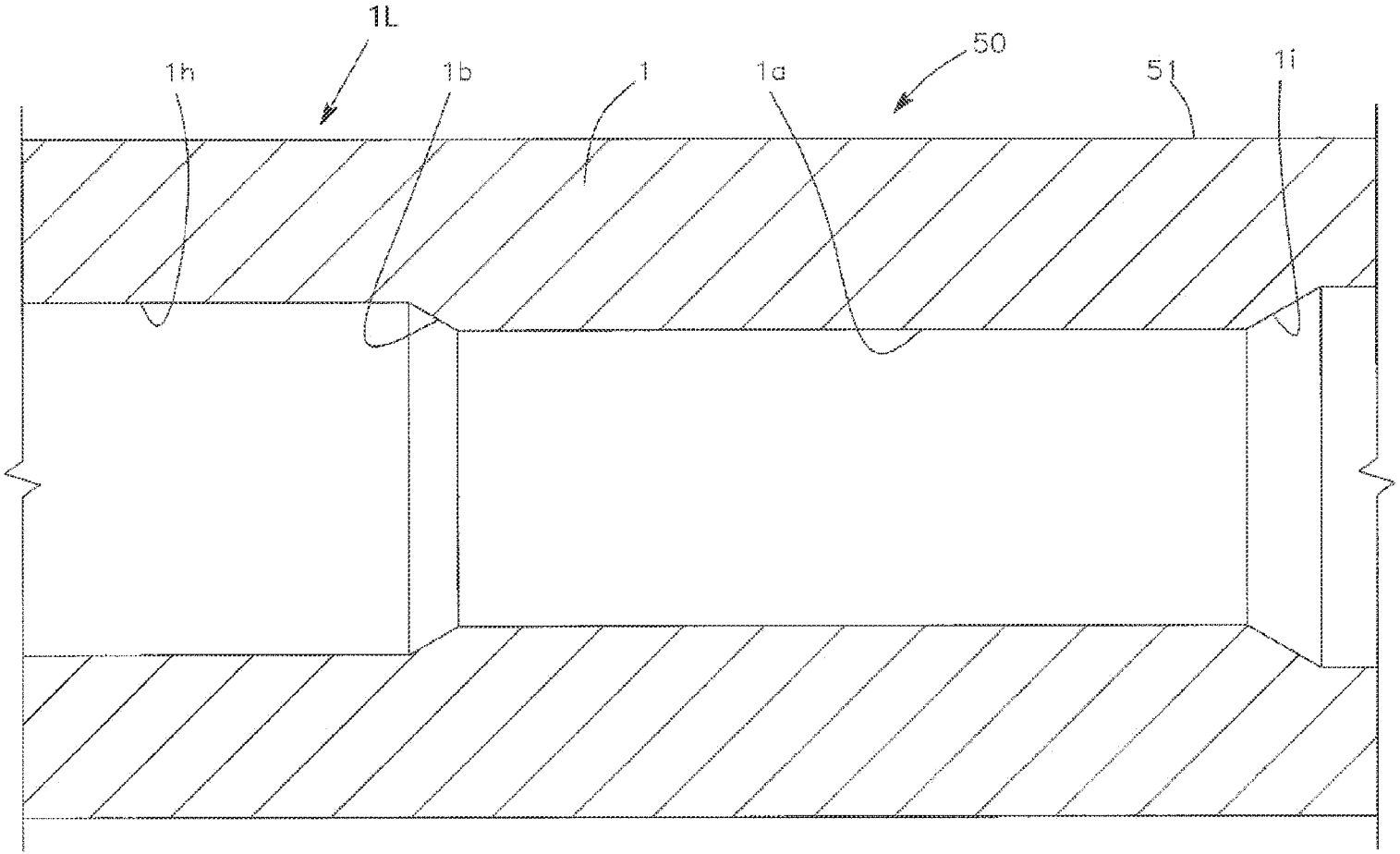
FIG. 2B is an intermediate section view of the DSD.

Referring to FIG. 2A, upper body 1 includes an internal upper thread 1*c*, often called a female thread or a box thread, which is half of a tool joint for connection within a drill stem. The axial lower end of lower body 2 (FIG. 2F) includes an external lower thread 2*c*, often called a male thread or pin thread, which is the other half of a tool joint for connection within a drill stem.

Referring to FIGS. 2A-2F, upper body 1 has an upper shoulder 1*f* (FIG. 2A) displaced from an upward or lower shoulder 1*b* (FIG. 2B) by an internal recess 1*h* which is axially above an inner profile or internal diameter 1*a*; forming landing profile 1L. To allow passage for an unlocking and unblocking tool (UUT), internal diameter 1*a* is smaller than tool joint internal diameter 1*k* (FIG. 2A), internal diameter of the passage of the drill stem above upper body 1, internal diameter 3*a* (FIG. 2C) of blocking sleeve 3, internal diameter 2*g* of lower body 2 and the internal diameter of the passage of the drill stem below lower body 2. are larger than internal diameter 1*a*, to allow passage of an unlocking and unblocking tool (UUT) and will be addressed during the discussion of the operation of the assembly below. Axially opposing shoulders 1*i* and 3*k* form a recess 1*j*. Shoulder 1*i* may be referred to herein as downward shoulder 1*i* and shoulder 3*k* may be referred to herein as inner portion 3*k*. Internal recess 1*j* and internal diameter 1*g* are important to the function of the UUT, as will be described.

Tool joint 15 may be designed or specially lubricated such that it is properly assembled at a lower torque than other tool joints in a drill stem. Upper thread 1*c* (FIG. 2A) and lower thread 2*c* (FIG. 2F) are part of tool joints and form tool joints of a drill stem (not shown). These tool joints and others of the drill stem may be designed or lubricated to properly assemble at a higher assembly torque than that required to assemble tool joint 15.

Serration or splines 1*d* (FIGS. 2C and 3) within upper body 1 and serrations or splines 2*d* (FIGS. 2C and 5) within lower body 2 may be formed in different manners such as, but not limited to, milling, shaping, electro discharge machining and the like. Internal diameter 1*a* is smaller than serration 1*d*, and internal diameter 2*g* is smaller than serration 2*d*; it may be practical to form serration 1*d* and serration 2*d* in upper body 1, while forming lower body 2 individually when not assembled at tool joint 15. As previously described, alignment of serration 1*d* and serration 2*d* when tool joint 15 is properly assembled may vary because of manufacturing tolerances, wear, thickness of lubrication and the like.

Figure 2C:
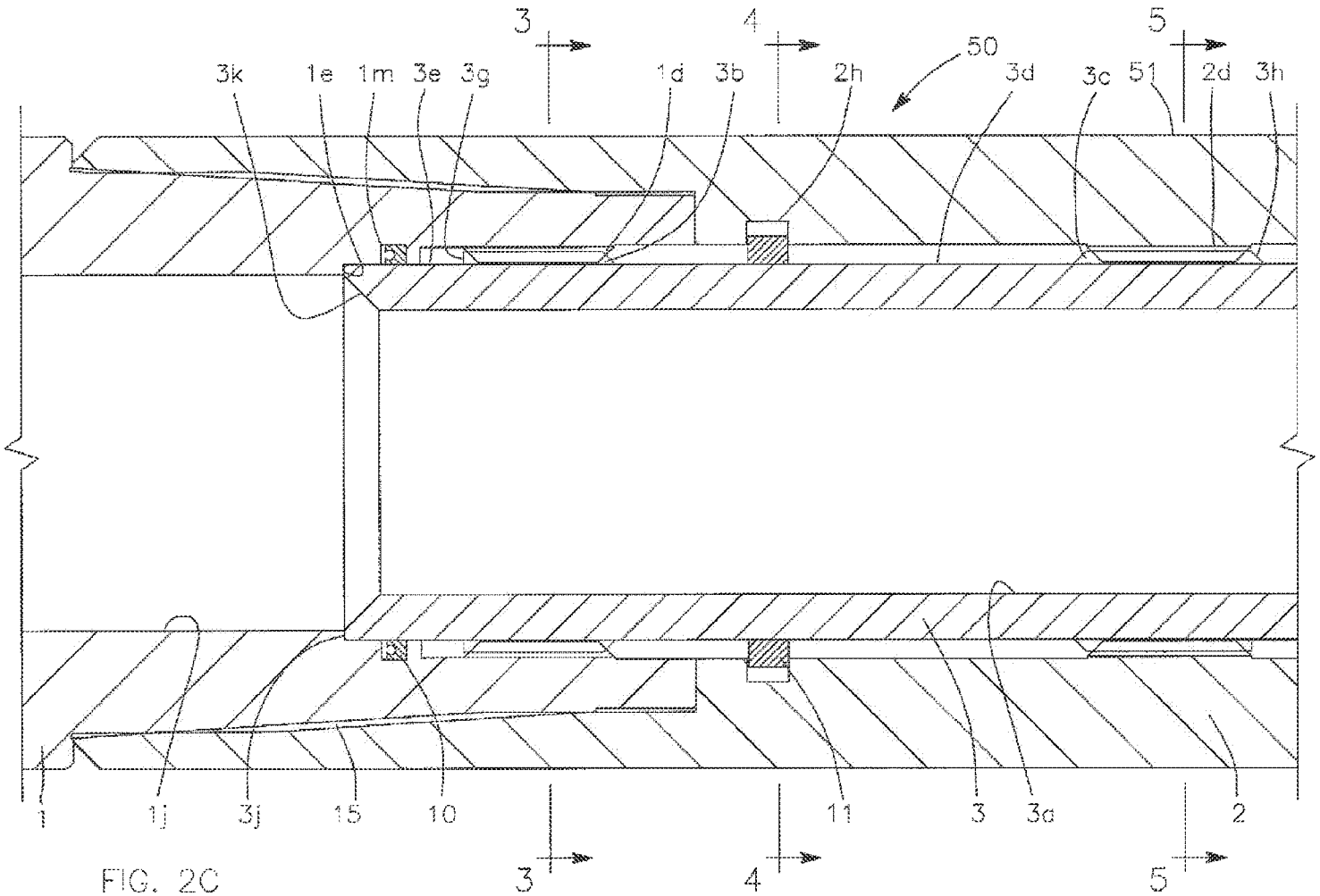
FIG. 2C is an intermediate section view of the DSD.
Figure 3:
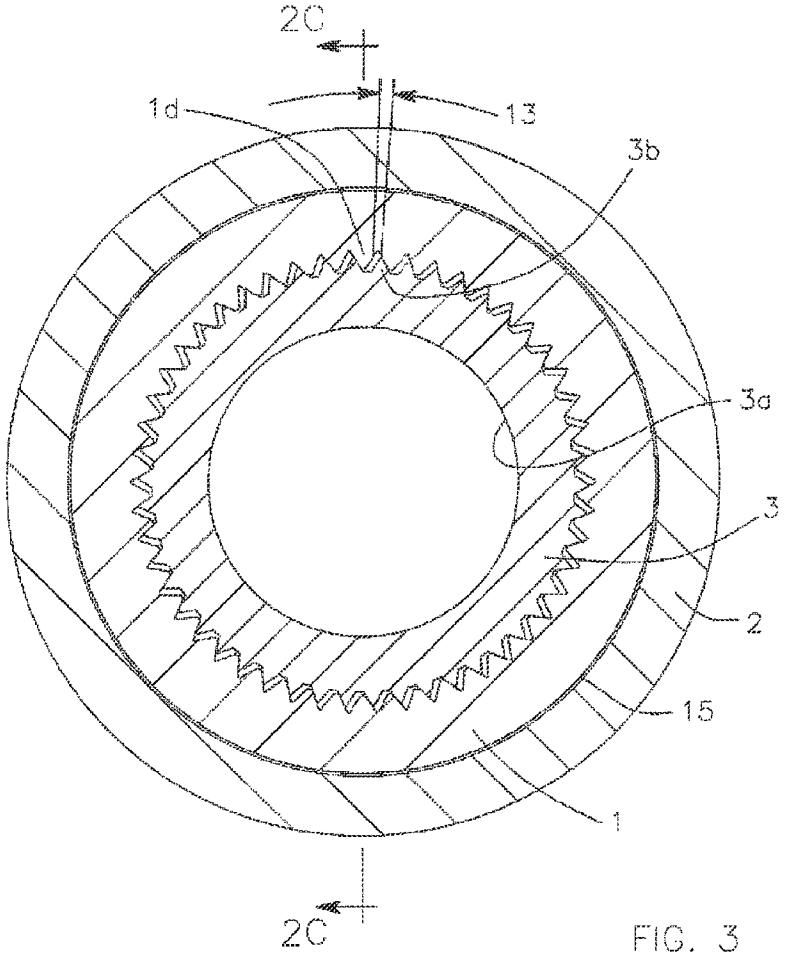
FIG. 3 is a section view, shown in full, defined in FIG. 2C.
Figure 4:
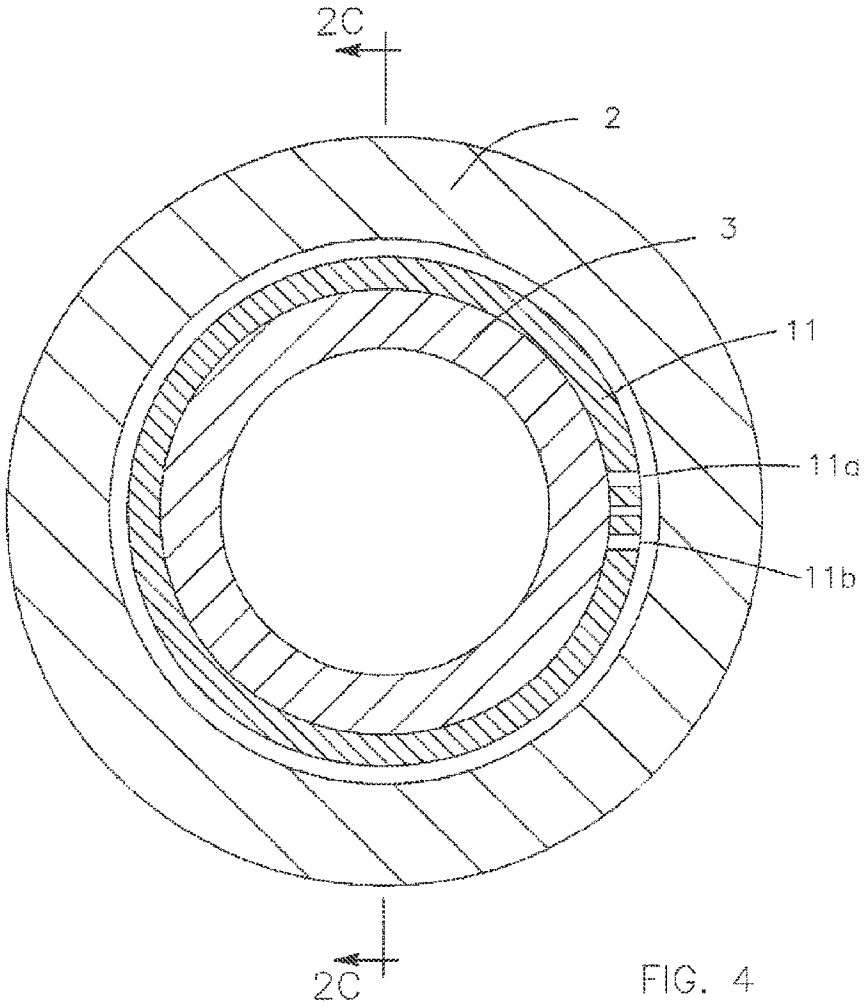
FIG. 4 is a section view, shown in full, defined in FIG. 2C.
Figure 5:
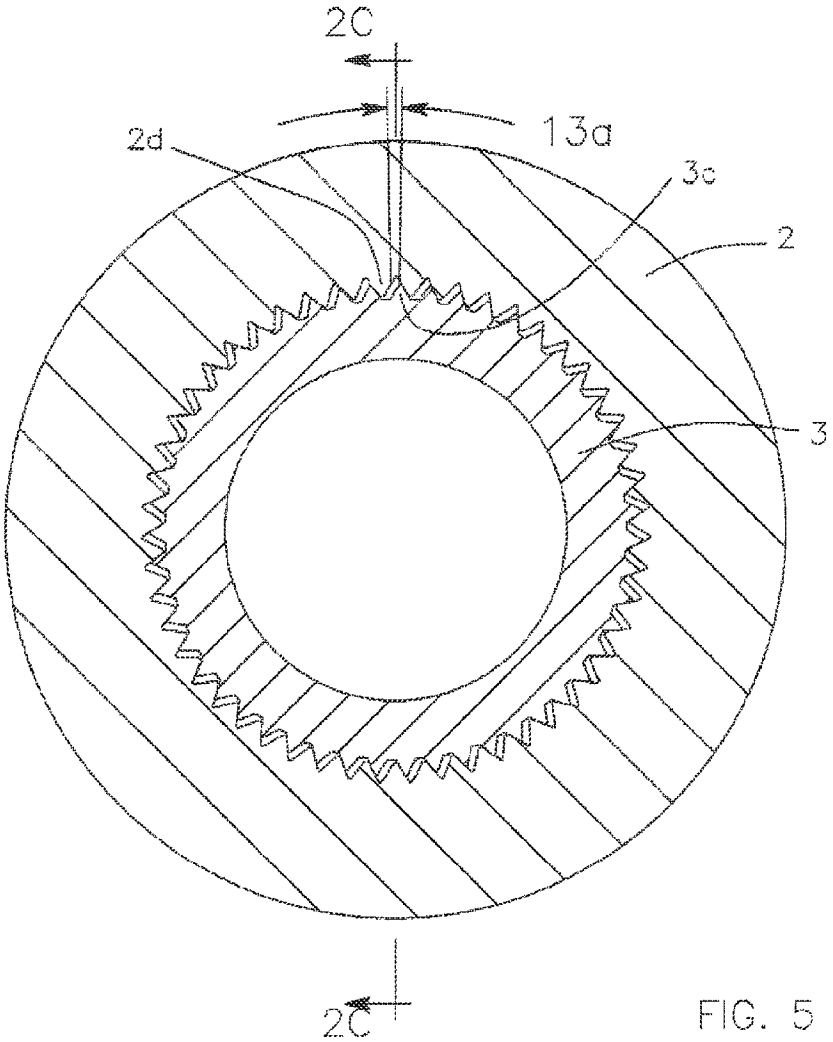
FIG. 5 is a section view, shown in full, defined in FIG. 2C.
Figure 6:
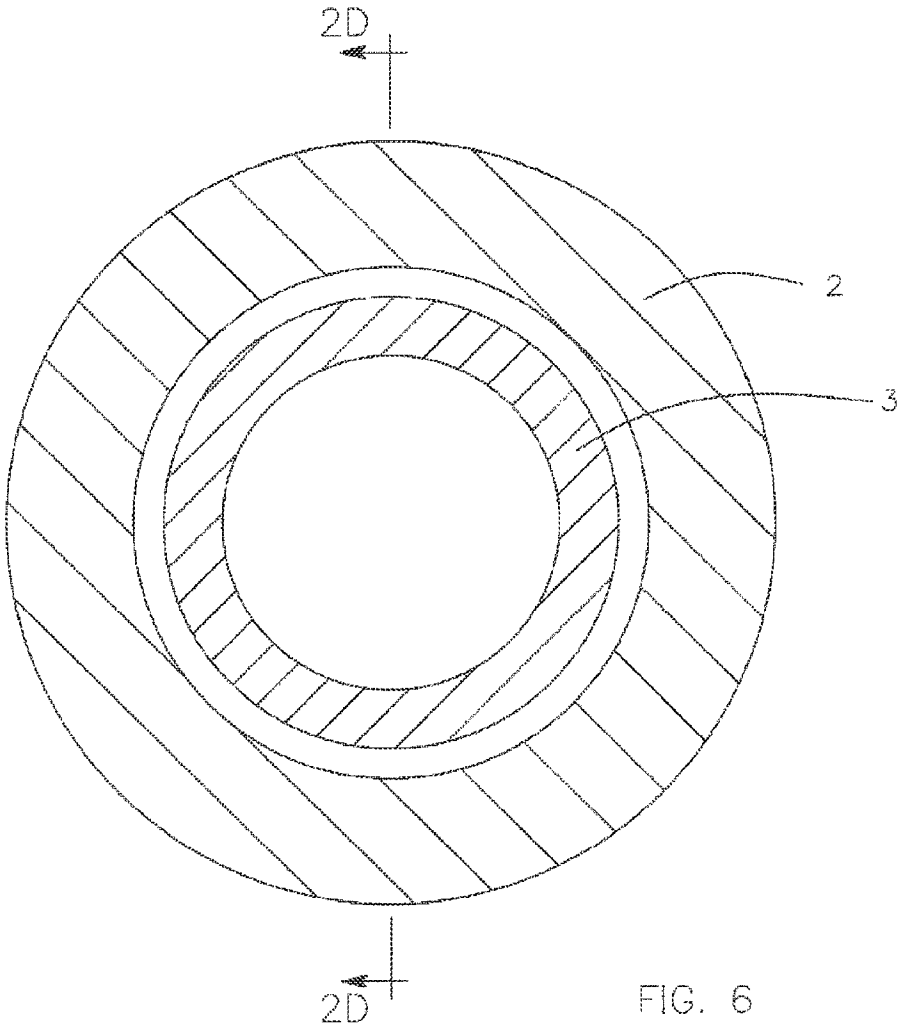
FIG. 6 is a section view, shown in full, defined in FIG. 2D.
Figure 7:
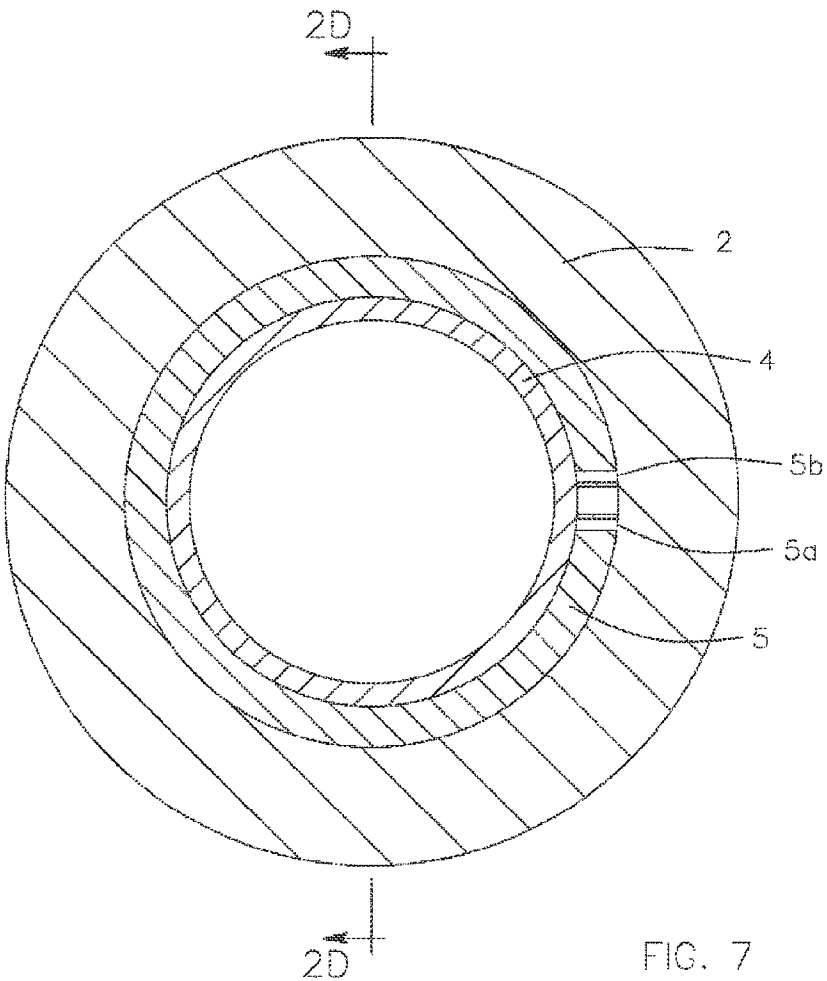
FIG. 7 is a section view, shown in full, defined in FIG. 2D.
Figure 8:
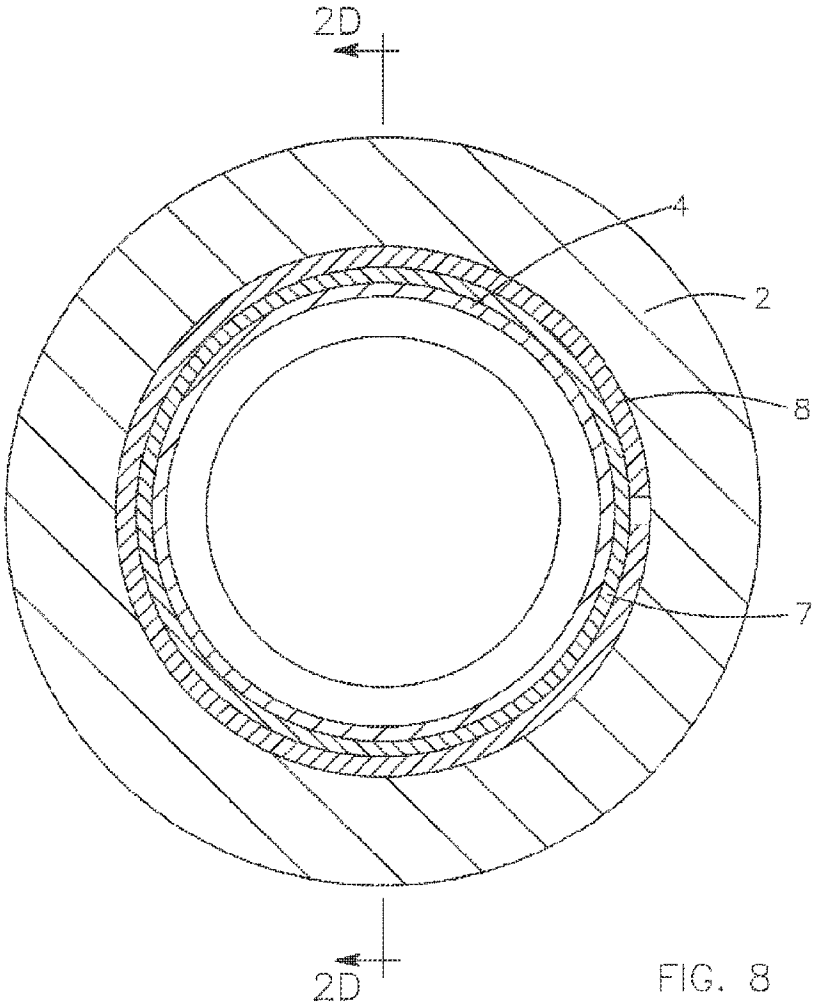
FIG. 8 is a section view, shown in full, defined in FIG. 2D.
Figure 9:
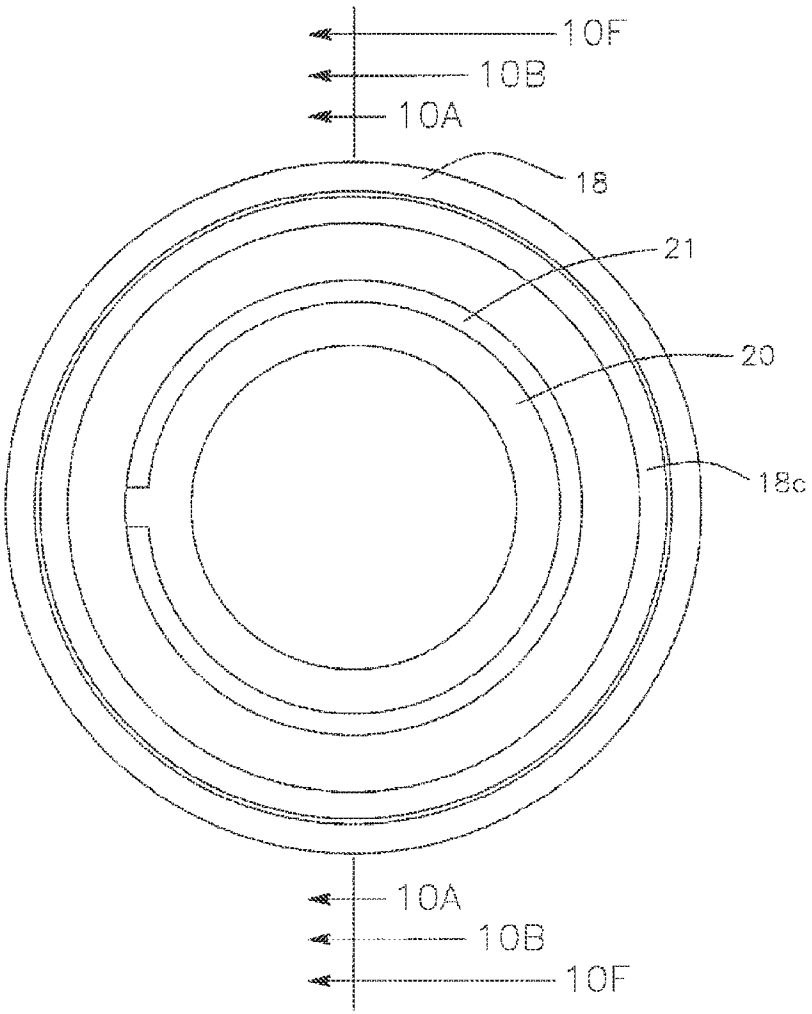
FIG. 9 is an end view defining section views FIGS. 10A, 10B, and 10F.

Referring to FIGS. 2C, 3, and 5, blocking sleeve 3 (FIG. 2C) is disposed radially within upper body 1 and lower body 2. Blocking sleeve 3 has upper serration or splines 3*b* radially engaged with compatible or mating serration 1*d* of upper body 1 and lower serration or splines 3*c* (FIG. 2C) engaged with compatible or mating serration 2*d* of lower body 2. Upper serration 3*b* of blocking sleeve 3 and serration 1*d* of upper body 1 are complementary and have angular clearance 13 (FIG. 3) configured for sliding engagement; accordingly, they may have the same number or angular pitch serration. Lower serration 3*c* of blocking sleeve 3 and serration 2*d* of lower body 2 are complementary and have angular clearance 13*a* (FIG. 5) configured for sliding engagement; accordingly, they may have the same number or angular pitch serration.

Upper serration 3*b* of blocking sleeve 3 and serration 1*d* of upper body 1 have a different number or angular pitch than lower serration 3*c* of blocking sleeve 3 and serration 2*d* of lower body 2. Angular clearance 13 (FIG. 3) added with angular clearance 13*a* (FIG. 5) results in a clearance that is greater than incremental pitch 14 (FIG. 22D) between lower serration 3*c* and upper serration 3*b*.

Figure 22:
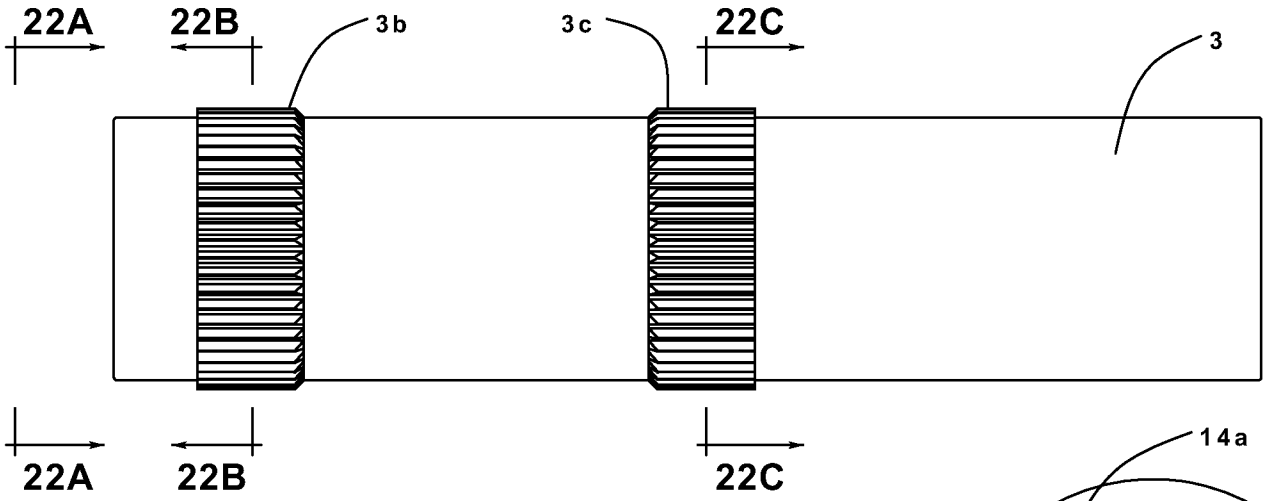
FIG. 22 is a side view of a blocking sleeve.
Figure 22D:
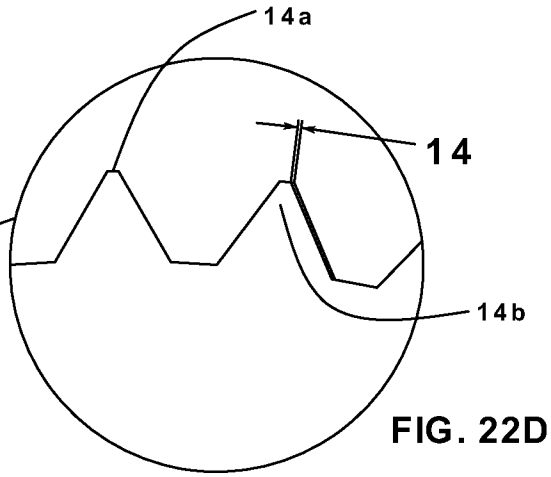
FIG. 22D is a detail view, defined in FIG. 22A.
Figure 22A:
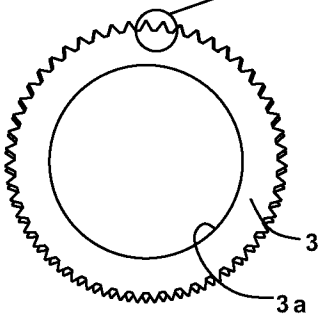
FIG. 22A is an end view, defined in FIG. 22.
Figure 22B:
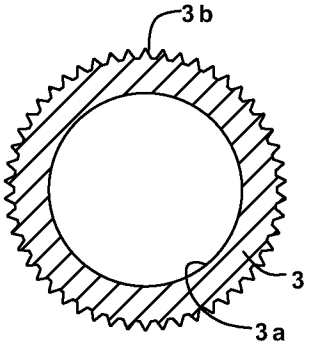
FIG. 22B is a section view, defined in FIG. 22.
Figure 22C:
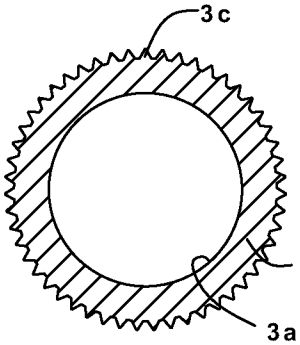
FIG. 22C is a section view, defined in FIG. 22.
Figure 23:
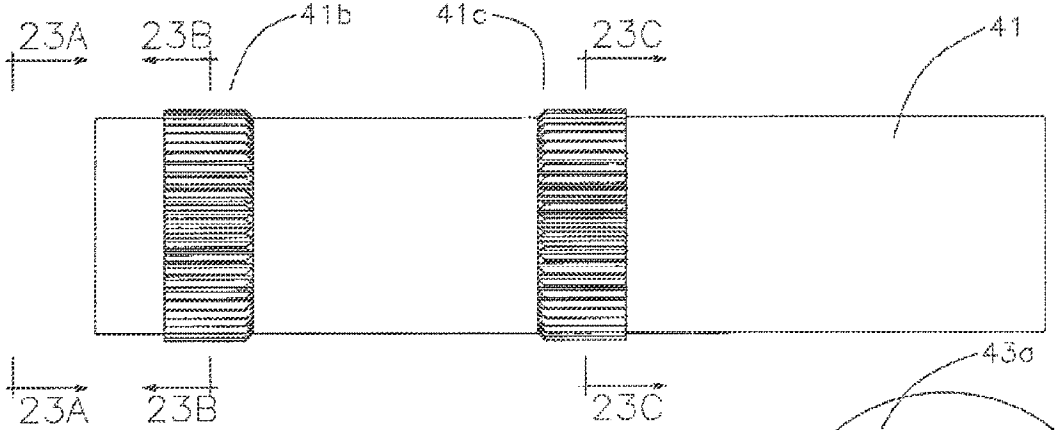
FIG. 23 is a side view of an alternate blocking sleeve.
Figure 24:
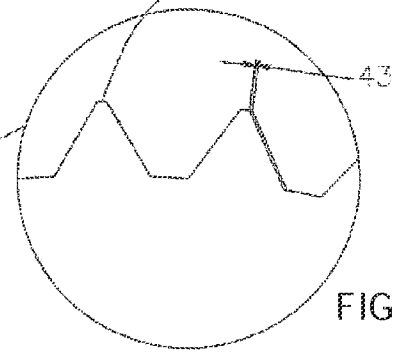
FIG. 24 is a detail view defined in FIG. 23A.
Figure 23A:
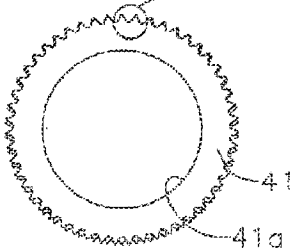
FIG. 23A is an end view defined in FIG. 23.
Figure 23B:
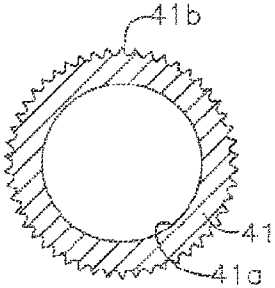
FIG. 23B is a section view, defined in FIG. 23.
Figure 23C:
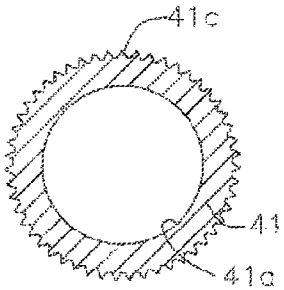
FIG. 23C is a section view, defined in FIG. 23.

Referring to FIGS. 22 and 22A-22D, the incremental pitch 14 (FIG. 22D) between serration 3*b* and serration 3*c* of blocking sleeve 3 is shown adjacent to aligned set of teeth 14*a* (though alignment is not necessary for the pitch increment). FIGS. 22C and 22B illustrate serration 3*c* and serration 3*b* respectively, while FIG. 22A illustrates both serration 3*b* and serration 3*c* as viewed from the axial end of FIG. 22. In this particular embodiment, serration 3*b* includes 50 teeth while serration 3*c* includes 51 teeth. Serration 3*b* and serration 3*c* include a set of aligned teeth 14*a*. Due to the difference in the number of teeth between serration 3*b* and serration 3*c*, the set of teeth 14*b* (FIG. 22D) circumferentially adjacent to aligned set 14*a* are not angularly aligned like the aligned set of teeth 14*a*, but instead are out of phase by the amount of incremental pitch 14. Additional sets of teeth along the circumference of serrations 3*b* and 3*c* will be further out of phase, with the next additional set circumferentially adjacent to set 14*b* out of phase by twice the incremental pitch, the next circumferentially adjacent set out of phase by triple the incremental pitch, etc., until serration 13*b* and serration 13*c* are completely out of phase at a point along the circumference of serrations 3*b* and 3*c* diametrically opposed to aligned set of teeth 14*a*. In this embodiment, serration 1*d* (FIG. 3) includes 50 teeth (matching serration 3*b*) and serration 2*d* (FIG. 5) of lower body 2 includes 51 teeth (matching serration 3*c*), mirroring the incremental pitch 14*a* of serration 3*b* and 3*c* of blocking sleeve 3.

Having the same incremental pitch, serration 1*d* and serration 2*d*, regardless of angular alignment, will include sets of teeth in phase and sets of teeth incrementally out of phase, with the incremental shift into and out of phase by each set of teeth governed by the incremental pitch. Thus, aligning the in phase sets of teeth of serrations 3*b* and 3*c* with the corresponding in phase sets of teeth of serrations 1*d* and 2*d* allows upper serration 3*b* to engage serration 1*d* simultaneously with the engagement between lower serration 3*c* and serration 2*d*, regardless of the rotational alignment of serration 1*d* and serration 2*d* when tool joint 15 is properly assembled. Thus, it may not be necessary to compromise desired assembly torque to adjust the angular alignment of upper body 1 and lower body 2 for engagement with blocking sleeve 3, nor are match-fit parts required.

Figure 2D:
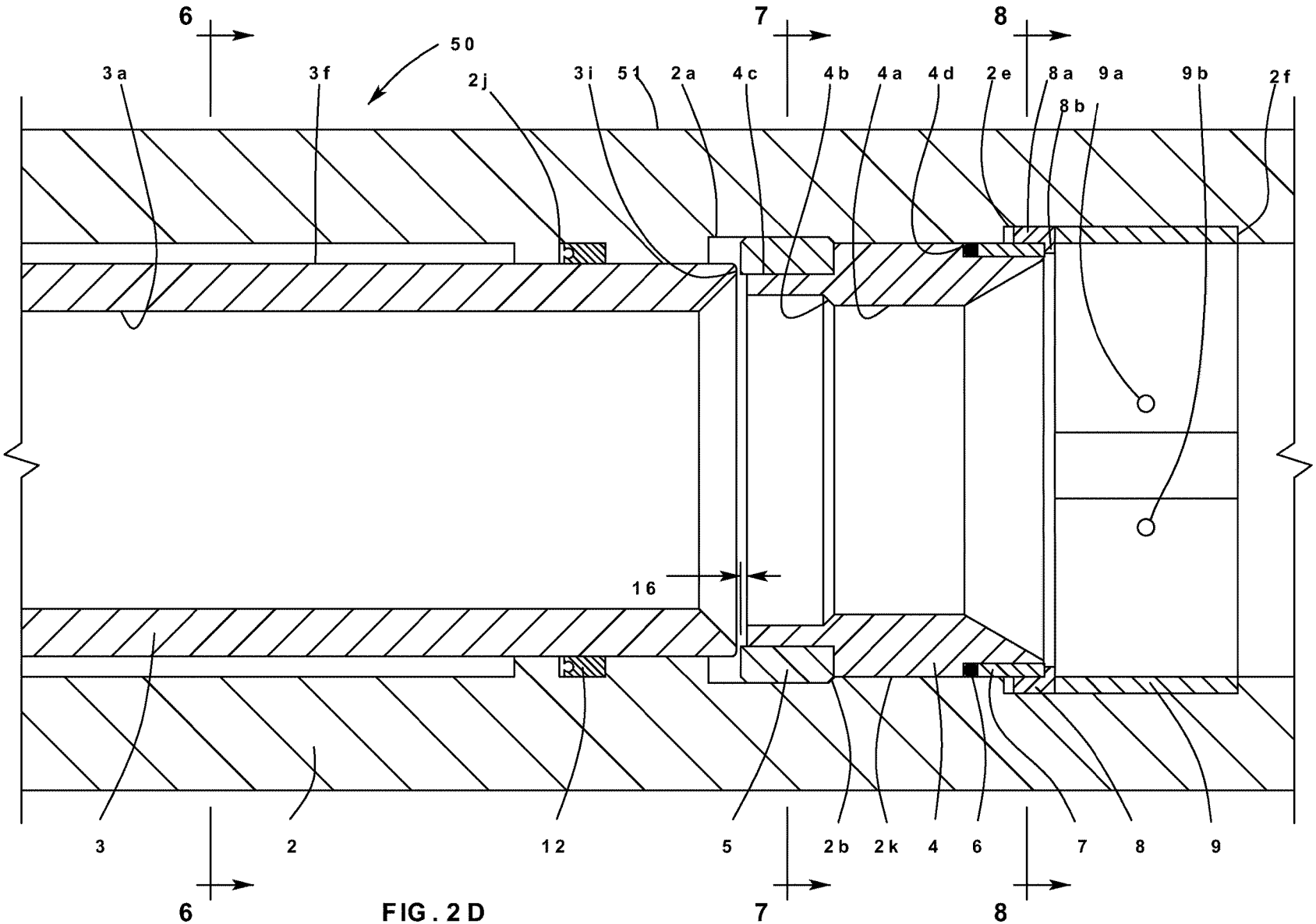
FIG. 2D is an intermediate section view of the DSD.

Blocking sleeve 3, so engaged, prevents relative rotation between upper body 1 and lower body 2. Referring to FIGS. 2C and 2D, blocking sleeve 3 includes an upper seal surface 3*e*, lower seal surface 3*f*, intermediate gap 3*d*, internal diameter 3*a*, upper end 3*g* of upper serration 3*b*, lower end 3*h* of lower serration 3*c*, upper end 3*j*, and lower end 3*i*. Blocking sleeve 3 may be prevented from axial upward movement by engagement between upper end 3*j* of blocking sleeve 3 and shoulder 1*e* of upper body 1. Blocking sleeve 3 is prevented from being displaced axially lower by lower end 3*i* engaging "c" ring 5, which may be disposed axially below blocking sleeve 3.

Tool joint 15 is sealed by the contact of the rotary shoulders incorporated therein, while upper seal 10 within groove 1*m* and lower seal 12 within groove 2*j* function as debris barriers and maintain lubrication of serrations 1*d*, 3*b*, 2*d* and 3*c*. Upper seal surface 3*e* may be the same or very nearly the same diameter as lower seal surface 3*f* to assure ease of movement in a high hydrostatic pressure fluid environment.

Now referring to FIG. 2D, "c" ring 5 is held in a radially expanded condition within groove 2*a* of lower body 2 by support surface 4*c* of lock sleeve 4. Filler "c" ring 9, which serves to assist in assembly, is configured to be inserted within groove 2*e* in order to trap and transfer loads from retaining ring 8 and lower body 2. Ring 7 and shock absorber 6, which is possibly made of elastomeric material, secure lock sleeve 4 in position for lock sleeve 4 to axially support "c" ring 5 and transfer loads axially from lock sleeve 4 to retaining ring 8. Retaining ring 8 is robust and may require a force to shear. In an exemplary embodiment, tens of thousands of pounds of force may shear the retaining ring 8. Lock sleeve 4 is lighter than blocking sleeve 3 and thus will create proportionately smaller inertial forces when subjected to the forces of rotary drilling. Shock absorber 6 protects retaining ring 8 from the affects of vibration and impact shock that take place during rotary drilling.

Axial gap 16 between "c" ring 5 and the axial upper end of lock sleeve 4 assures that forces acting to move blocking sleeve 3 downward are transferred from blocking sleeve 3, through "c" ring 5, to the shoulder 2*b* of groove 2*a* of lower body 2. Internal diameter 3*a* of blocking sleeve 3 may be smaller than internal diameter 4*a* of lock sleeve 4, thereby providing protection from forces associated with lowering service tools through the drill stem, such as measurement while drilling tools and the like. Internal diameter 3*a* may be larger than internal diameter 1*a*, which may provide clearance to internal surfaces during the functioning of a UUT, which will be addressed during the discussion of the operation of the assembly below.

As will be discussed below, blocking sleeve 3 may be unlocked by displacing lock sleeve 4 axially downward. A UUT engages an inner portion or shoulder 4*b* of lock sleeve 4, forcibly compelling shoulder 4*d* to axially compress shock absorber 6 and force ring 7 to shear retaining ring 8. After retaining ring 8 is sheared, forming an outer portion 8*a* which remains in groove 2*e* and an inner portion 8*b* which moves downwardly ahead of lock sleeve 4, the UUT displaces lock sleeve 4 downwardly into a position where support surface 4*c* is no longer in position to axially support "c" ring 5 in the radially expanded position within groove 2*a* of lower body 2.

Subsequently, a UUT axially engages upper shoulder 3*k* (FIG. 2C) and forces blocking sleeve 3 downwardly. As blocking sleeve 3 is displaced downwardly, "c" ring 5 is forced downwardly and out of groove 2*a* while "c" ring 5 continues to forcibly compel lock sleeve 4 and inner portion 8*b* downwardly. With continued axial downward movement, upper serration 3*b* radially expands and passes through "c" ring 11, carried within groove 2*h* of lower body 2. Blocking sleeve 3 is prevented from further downward displacement when lower end 3*i* of blocking sleeve 3, acting through "c" ring 5, lock sleeve 4, shoulder 4*d*, shock absorber 6, ring 7 and inner portion 8*b*, engages shoulder 2*f* of lower body 2.

Blocking sleeve 3, upon being fully displaced axially downward, serration 1*d* of upper body 1 is disengaged from upper serration 3*b* (FIG. 2C) of blocking sleeve 3 and lower serration 3*c* is disengaged from serration 2*d* of lower body 2. Accordingly, upper end 3*g* of upper serration 3*b* is now disposed axially below "c" ring 11, preventing upper serration 3*b* of blocking sleeve 3 from returning to engagement with serration 1*d* of upper body 1. Torque applied in the opposite rotational direction from torque applied during assembly will cause rotation between upper body 1 and lower body 2, assuming the portion of drill stem below lower body 2 is stabilized, such as by being stuck in the well bore, and thus will be prevented from rotation in either direction. Continued rotation in the rotational direction opposite of that used in the assembly of tool joint 15 and lifting of the upper unstuck drill stem will disconnect the drill stem at tool joint 15.

Figure 2E:
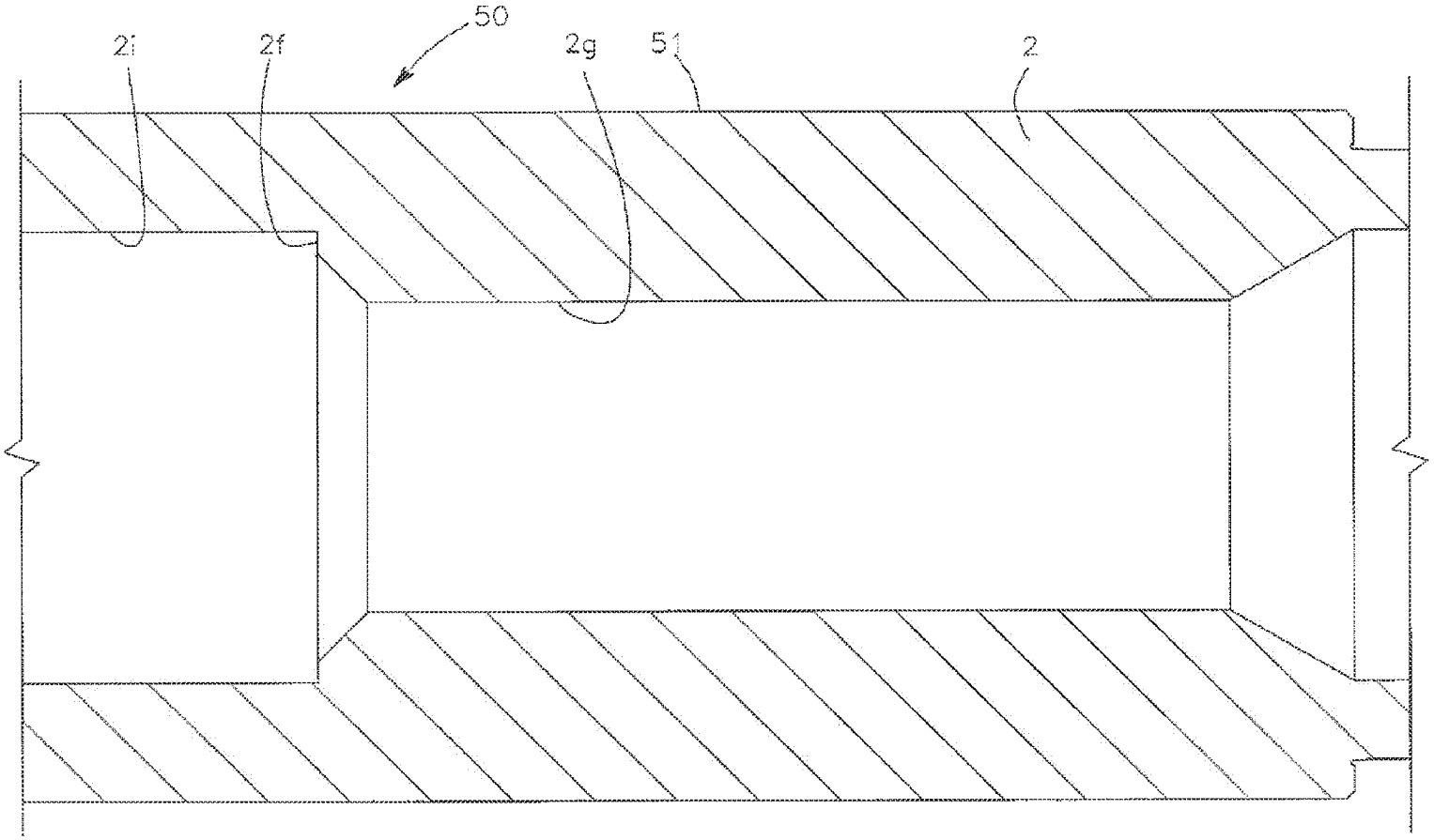
FIG. 2E is an intermediate section view of the DSD.
Figure 2F:
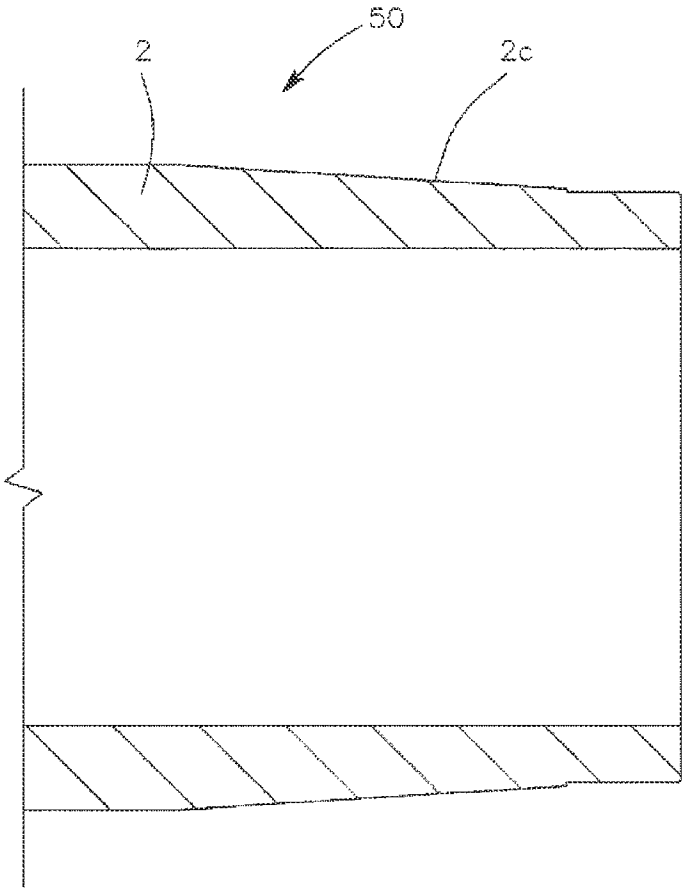
FIG. 2F is a section view of the lower most end of the DSD.

Filler ring 9 (FIG. 2D) may aid in assembly. Initially filler ring 9 is disposed within bore 2*i* (FIG. 2E). Retaining ring 8, ring 7, shock absorber 6, lock sleeve 4, "c" ring 5 and blocking sleeve 3 are displaced downward by a UUT until retaining ring 8 engages shoulder 2*f* of lower body 2. In this configuration, lower serration 3*c* of blocking sleeve 3 and serration 2*d* of lower body 2 are disengaged and upper body 1 may be properly assembled to lower body 2. After proper torque is applied at tool joint 15, blocking sleeve 3 may be rotated for spline engagement, as discussed more fully above, and displaced upwardly until upper end 3*j* engages shoulder 1*e* of upper body 1. Subsequently, "c" ring 5, forcibly compelled by lock sleeve 4, is displaced upwardly and when it reaches groove 2*a* (FIG. 2D) "c" ring 5 radially expands and allows lock sleeve 4 to pass underneath "c" ring 5 and radially support "c" ring 5 with support surface 4*c*. Thereafter, filler ring 9 is displaced axially upward to engage shock absorber 6 and retaining ring 8 with shoulder 4*d* of lock sleeve 4. In this position, filler "c" ring 9 may radially expand and engage shoulder 2*f* of lower body 2.

Filler "c" ring 9 includes hole 9*a* and hole 9*b* to facilitate removal of filler "c" ring 9 from the recess within lower body 2 disposed immediately above shoulder 2*f*. Likewise, "c" ring 5 includes hole 5*a* and hole 5*b* to facilitate removal of "c" ring 5 from lower body 2. "C" ring 11 has hole 11*a* and hole 11*b* for the same purpose.

Alternative embodiments of a drill stem disconnect assembly including a blocking sleeve are illustrated with reference to FIGS. 9, 10A-10F, 11-21, 23, and 23A-24. The alternative embodiments described below include some differences from the embodiments described above with reference to FIGS. 1, 2A-2F, 3-8, 22, and 22A-22D.

Figure 10A:
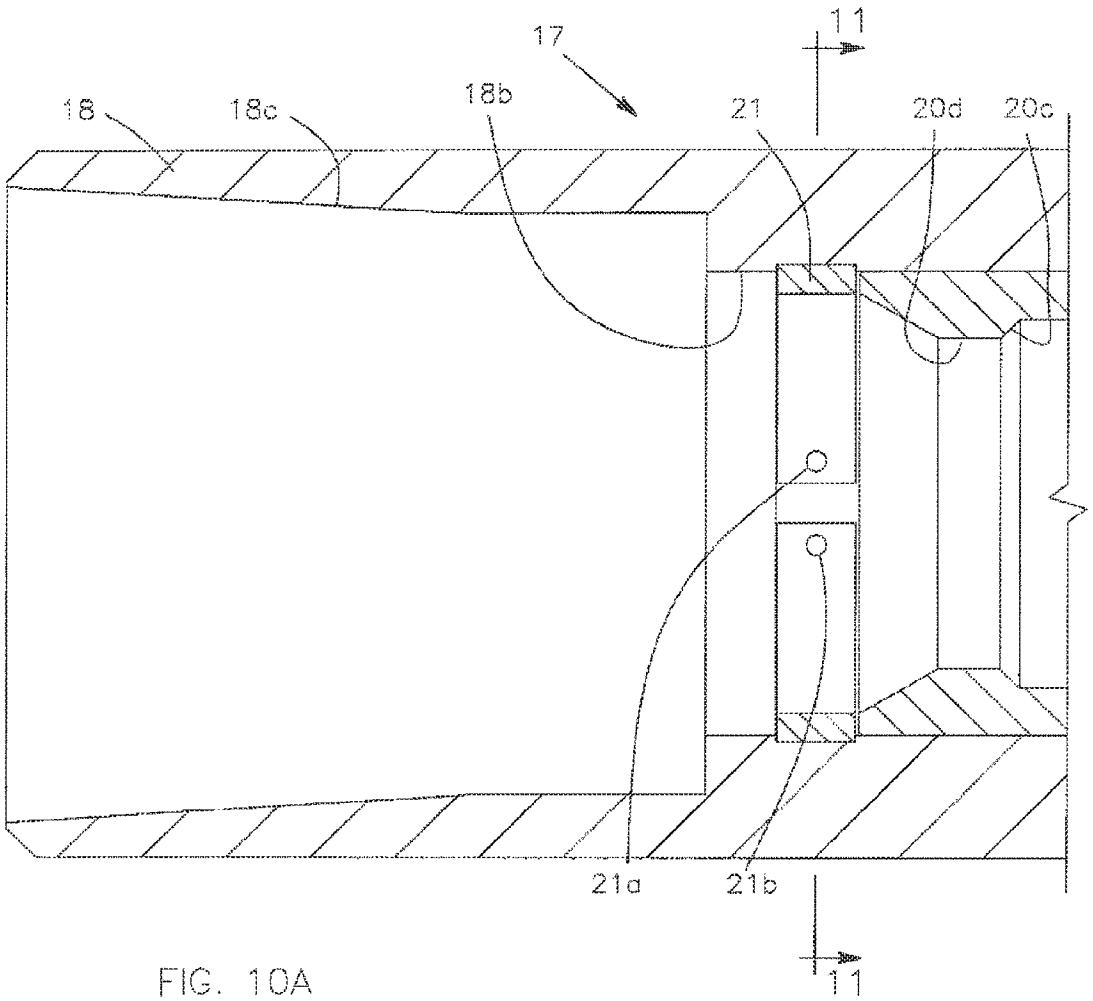
FIG. 10A is a section view of the upper most end an alternate construction DSD.
Figure 10B:
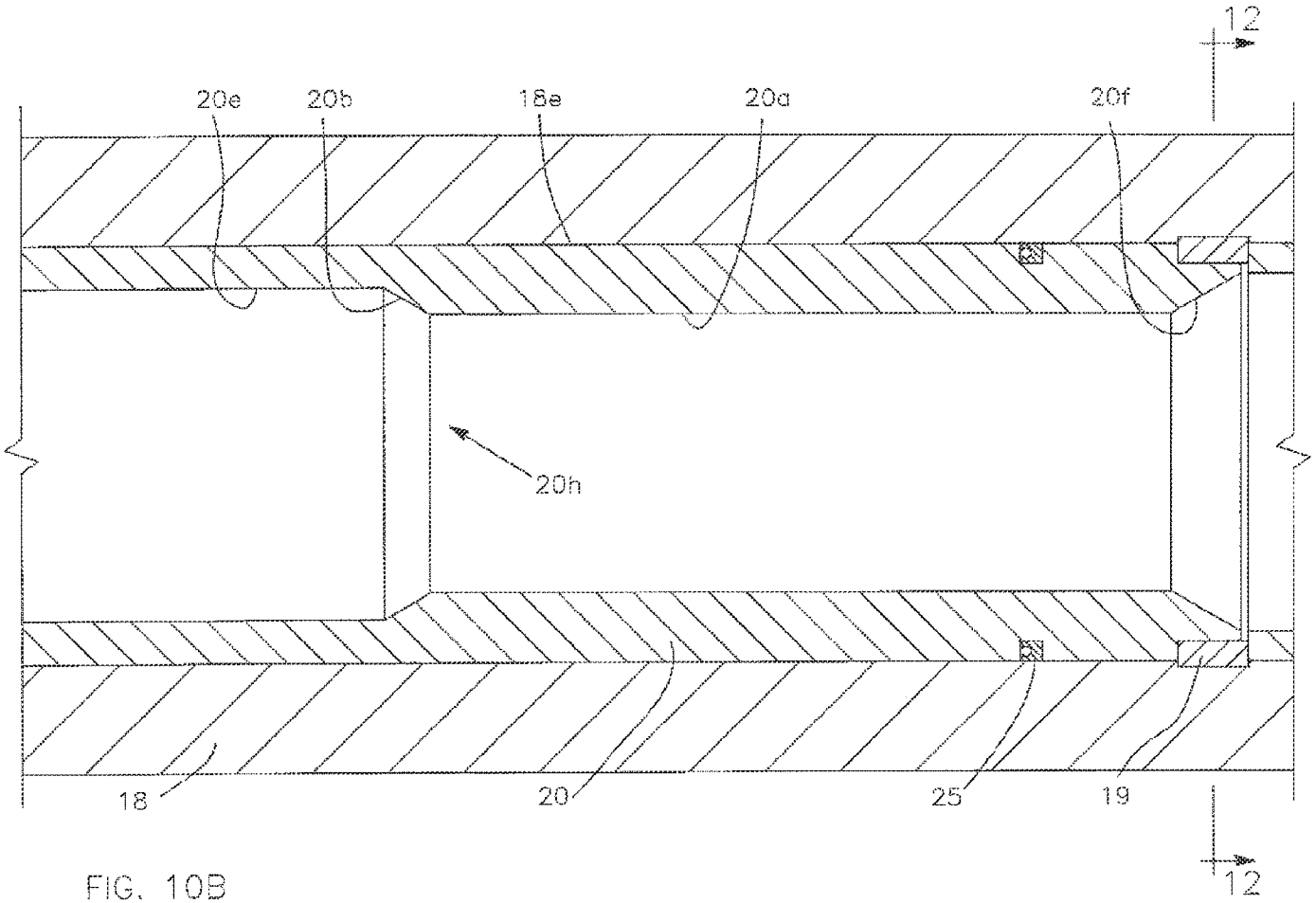
FIG. 10B is an intermediate section view of the alternate construction DSD.
Figure 10C:
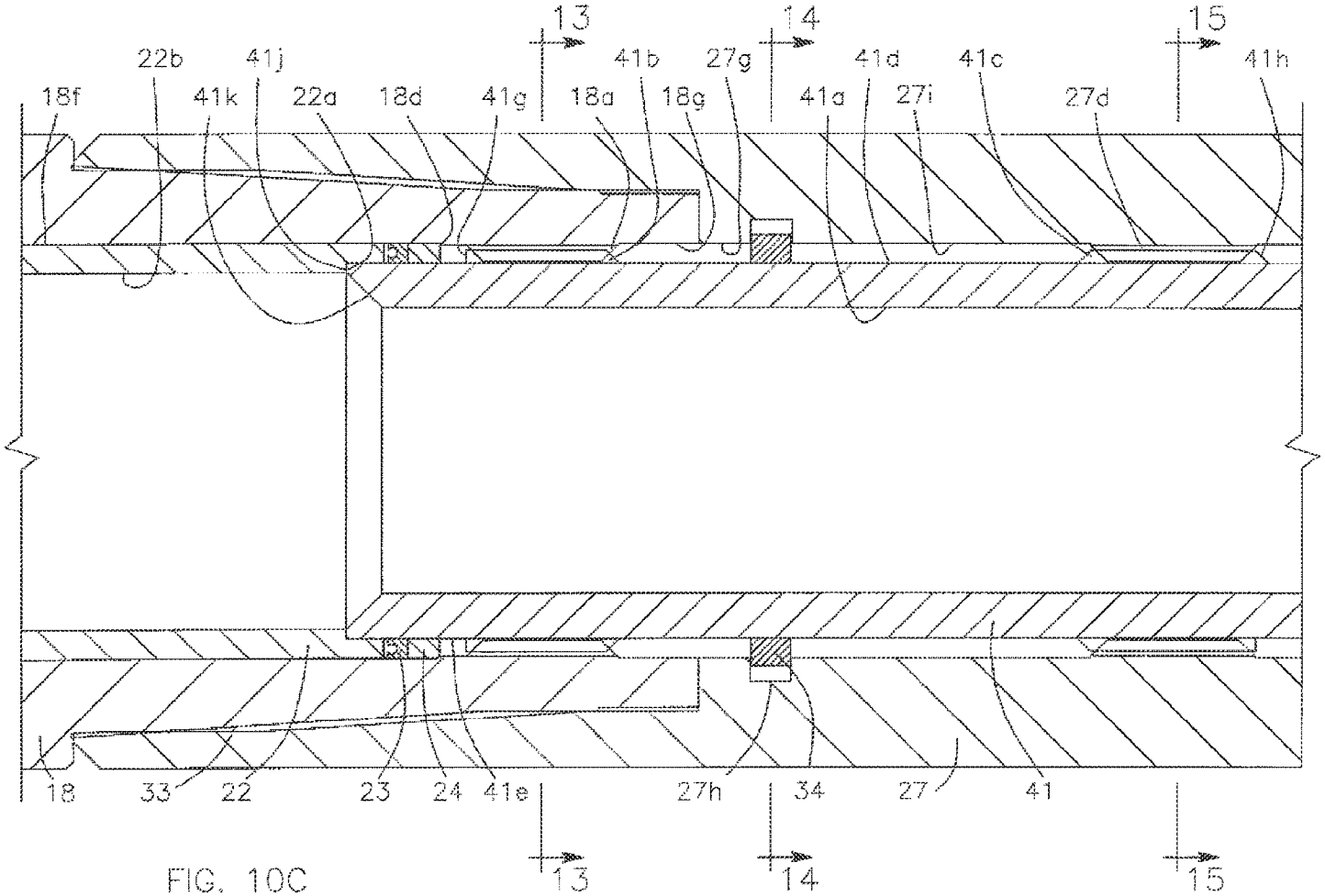
FIG. 10C is an intermediate section view of the alternate construction DSD.

It may be desirable, for certain sizes and tool joint designs, to form the internal body serrations with a broach. Referring to FIGS. 10A-10E, internal diameters 18*b*, 18*e*, 18*f* and 18*g* and internal diameters 27*g* (FIG. 10C), 27*i*, 27*m* (FIG. 10D), 27*n*, 27*o*, 27*p*, 27*q* (FIG. 27E) and 27*r* are sufficiently diametrically large to allow the forming of serration 18*a* (FIG. 10C) and serration 27*d* by displacing a broach with progressively larger teeth axially through an upper sub 18 (FIG. 10B) and a lower sub 27 (FIG. 10C). Serration 18*a* disposed within upper sub 18 and serration 27*d* disposed within lower sub 27 may be formed in different manners such as, but not limited to, broaching, milling, shaping, electro discharge machining and the like.

An upper body 17 (FIG. 10A) may be assembled as a sub-assembly. Upper body 17 includes: upper sub 18 with ring 24 (FIG. 10C) positioned against shoulder 18*d*, spacer 22 trapped axially by "c" ring 19 (FIG. 19), and bushing 20 with a seal 25 that seals between bushing 20 and upper sub 18, with the bushing 20 trapped axially between "c" ring 19 and "c" ring 21 (FIG. 10A). Collectively, these components forming upper body 17 may be interchangeable with upper body 1 of FIGS. 2A and 2B.

A lower body 26 (FIG. 10E) may also be assembled as a sub-assembly. Lower sub 27 includes: "c" ring 45 disposed within groove 27*j*, removable shoulder 29 (FIG. 10D) including first arc piece 29*a*, short arc piece 29*b* and second arc piece 29*c*, installed in groove 27*l*, removable shoulder 28 (FIG. 17) including first arc piece 28*a* (FIG. 18), short arc piece 28*b* and second arc piece 28*c*, installed in groove 27*k* (FIG. 10D), collectively form lower body 26, which may be interchangeable with lower body 2 of FIGS. 2C-2F.

Referring collectively to FIGS. 9, 10A, 10B-10F, 11-21, 23 and 23A-24, upper body 17 is connected to lower body 26 by tool joint 33 (FIG. 10C). Tool joint 33 may be a rotary shouldered and threaded connection.

Upper sub 18 is shown to have an internal upper thread 18*c* (FIG. 10A) often called a female thread or a box thread, which is half of a tool joint for connection within a drill stem (not shown). The lower end of lower sub 27 is shown to have an external lower thread 27*c* (FIG. 10F) often called male thread or pin thread, which is the other half of a tool joint for connection within a drill stem (not shown).

Figure 10D:
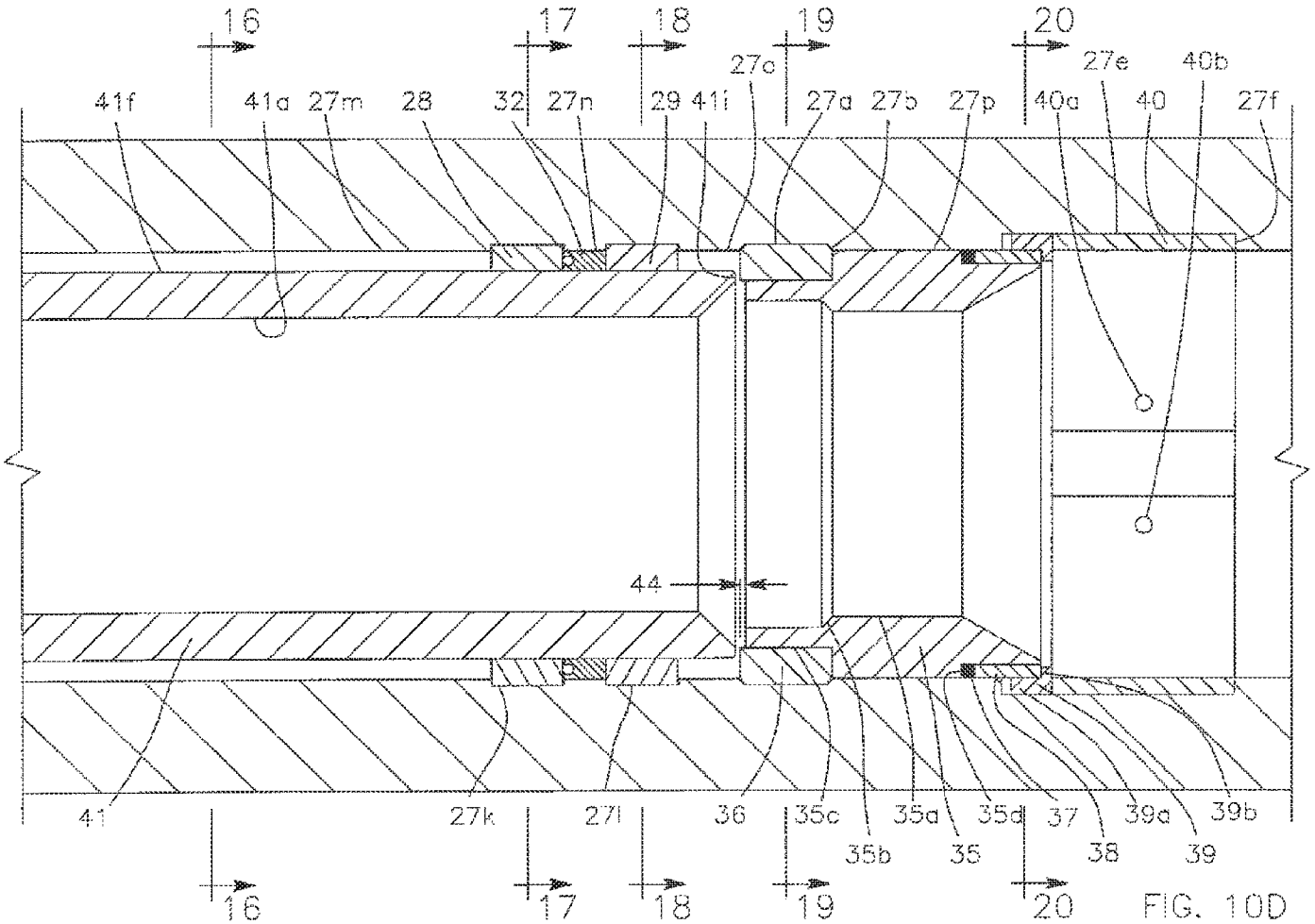
FIG. 10D is an intermediate section view of the alternate construction DSD.
Figure 10E:
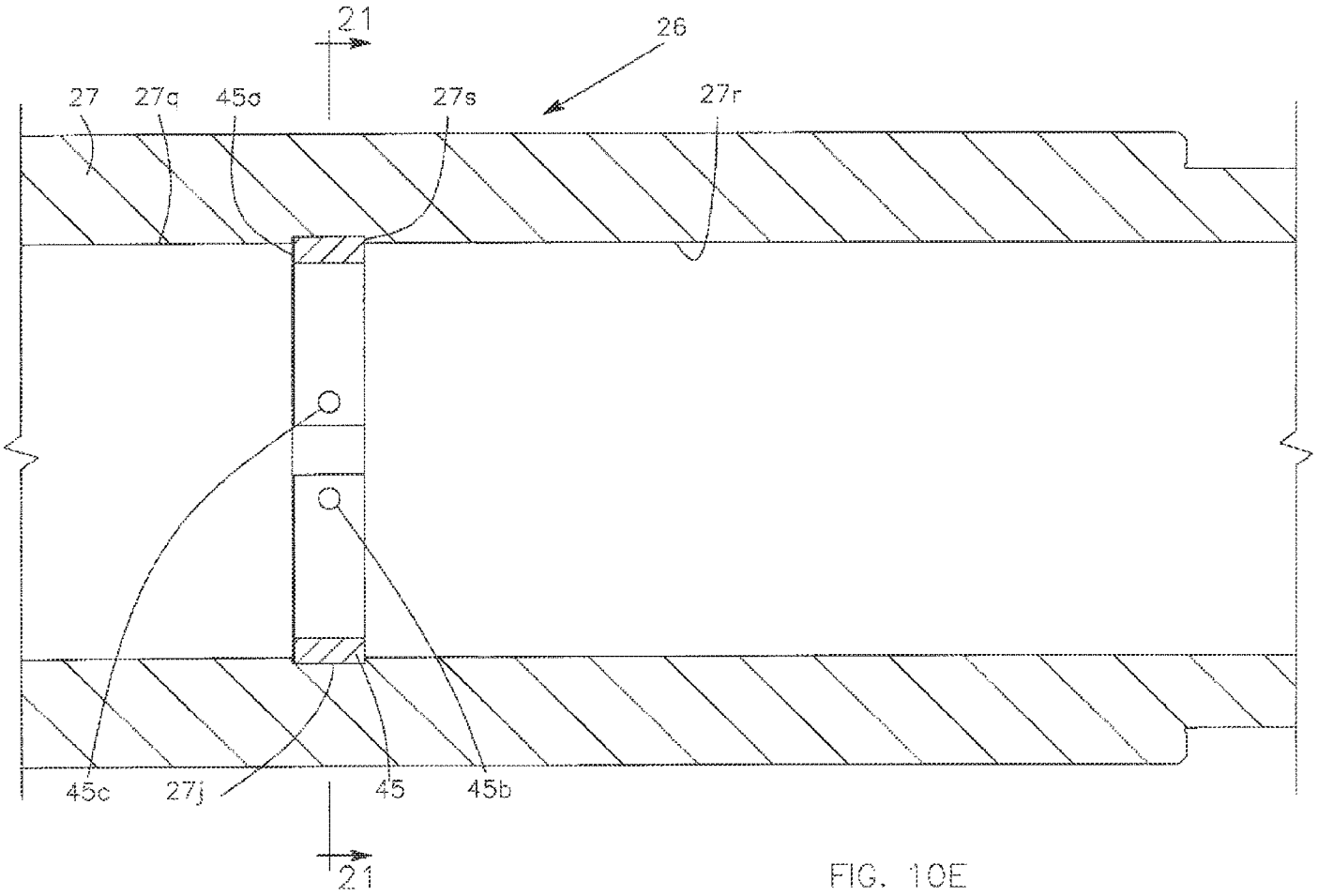
FIG. 10E is an intermediate section view of the alternate construction DSD.
Figure 10F:
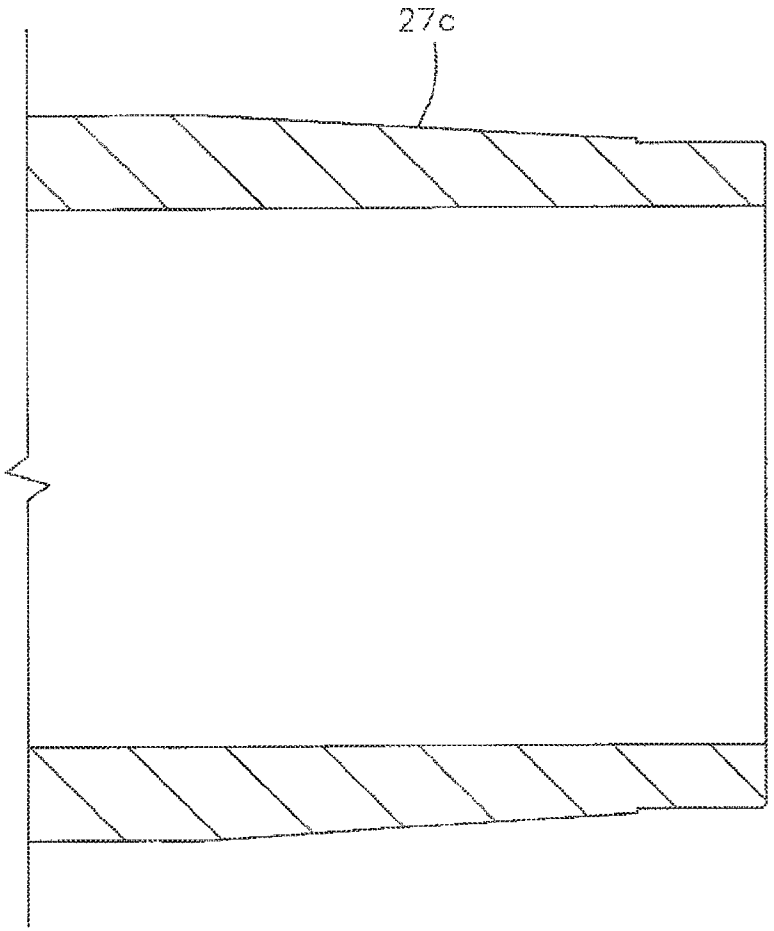
FIG. 10F is a section view of the lower most end of the alternate construction DSD.
Figure 11:
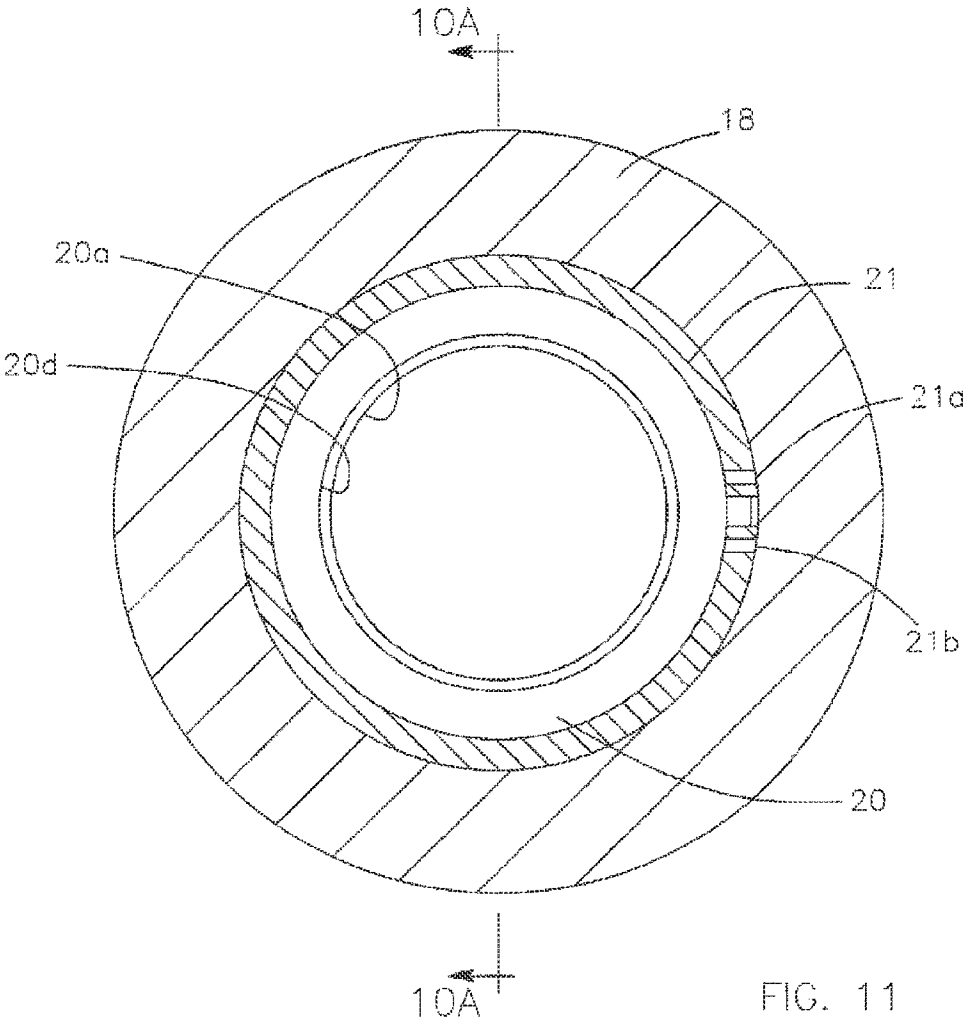
FIG. 11 is a section view, shown in full, defined in FIG. 10A.
Figure 12:
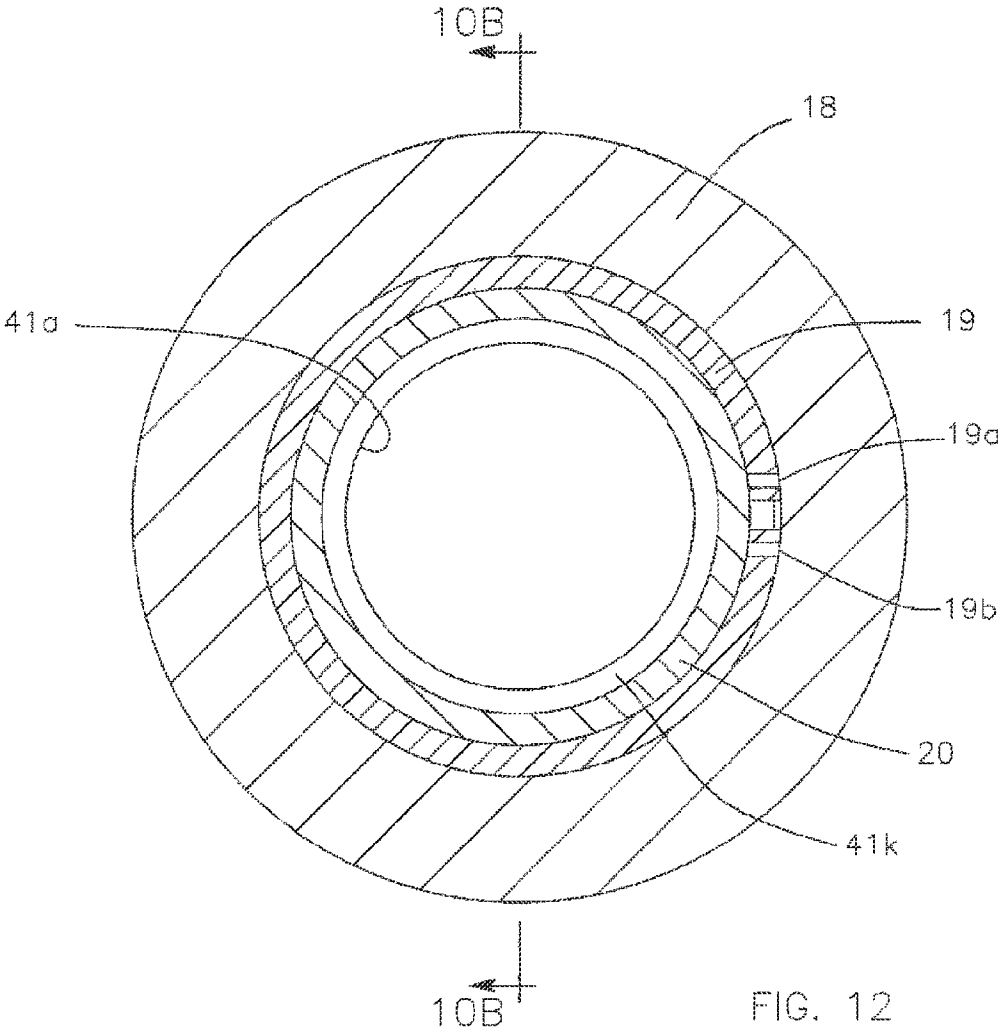
FIG. 12 is a section view, shown in full, defined in FIG. 10B.
Figure 13:
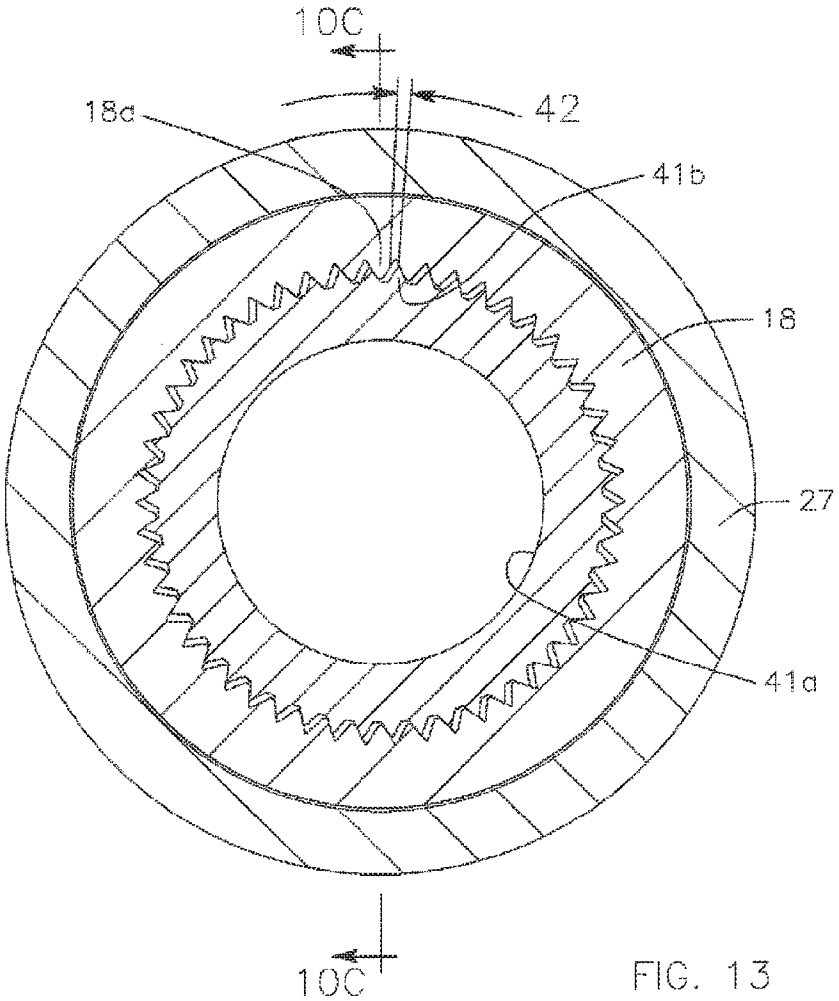
FIG. 13 is a section view, shown in full, defined in FIG. 10C.
Figure 14:
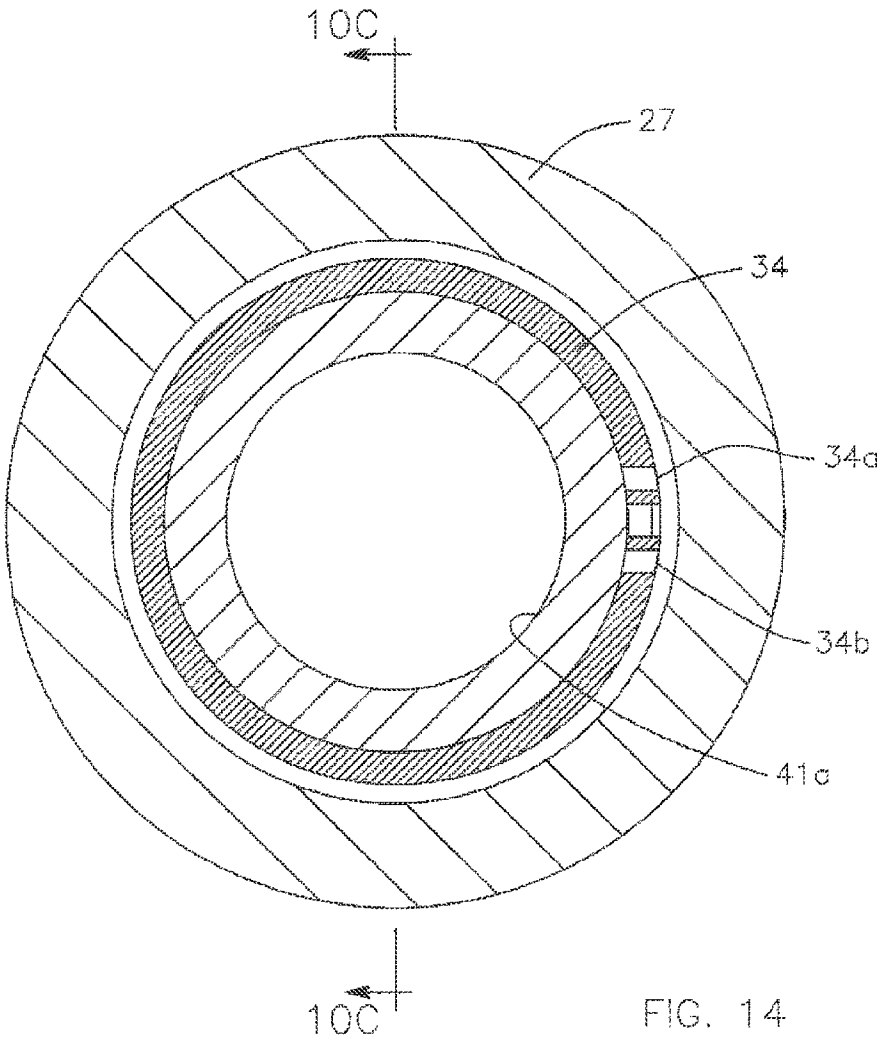
FIG. 14 is a section view, shown in full, defined in FIG. 10C.
Figure 15:
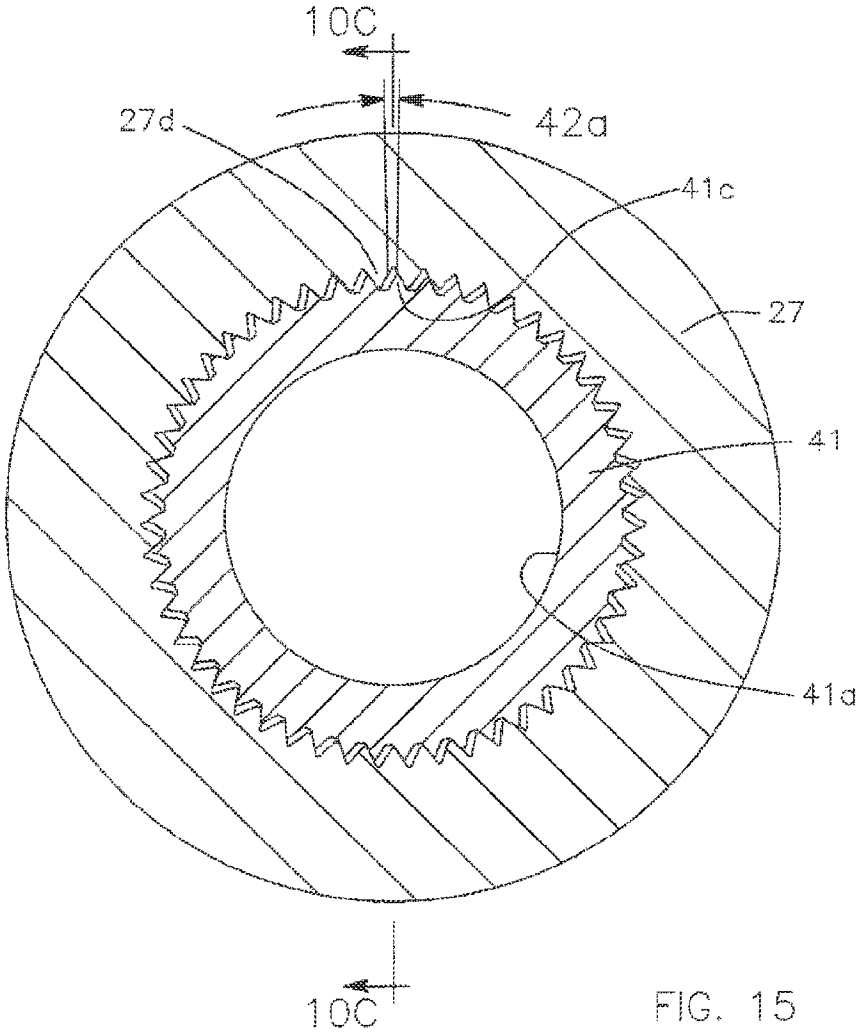
FIG. 15 is a section view, shown in full, defined in FIG. 10C.
Figure 16:
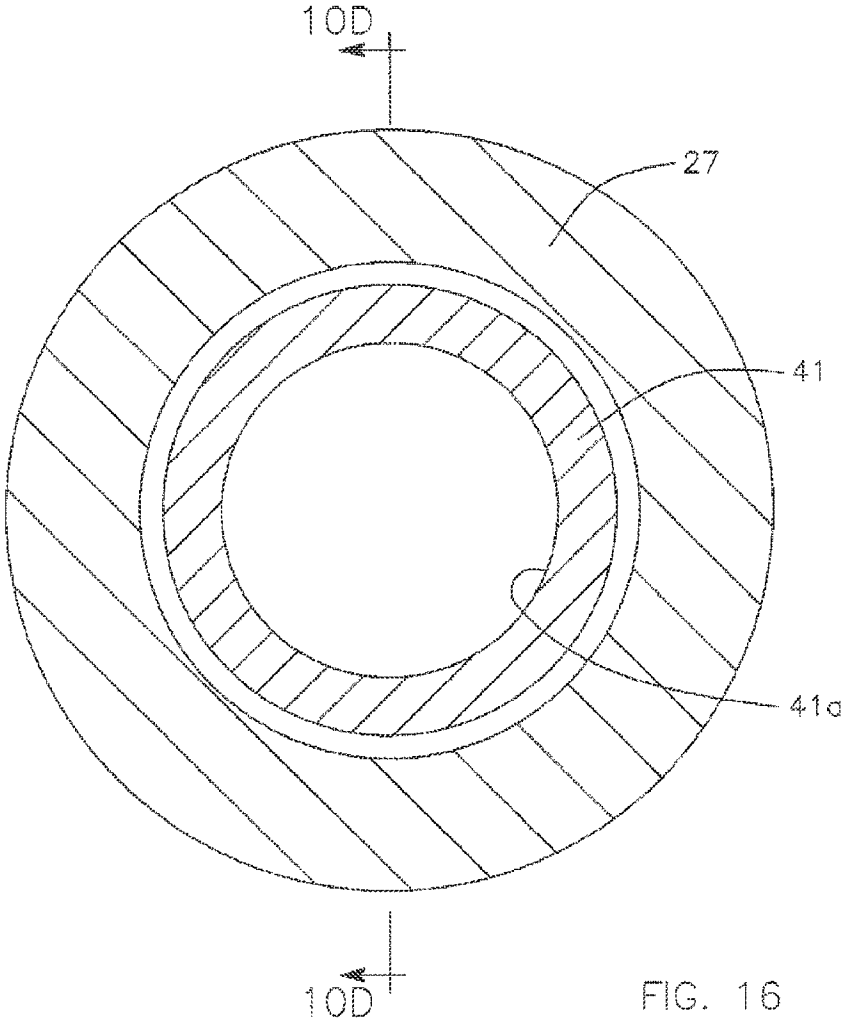
FIG. 16 is a section view, shown in full, defined in FIG. 10D.
Figure 17:
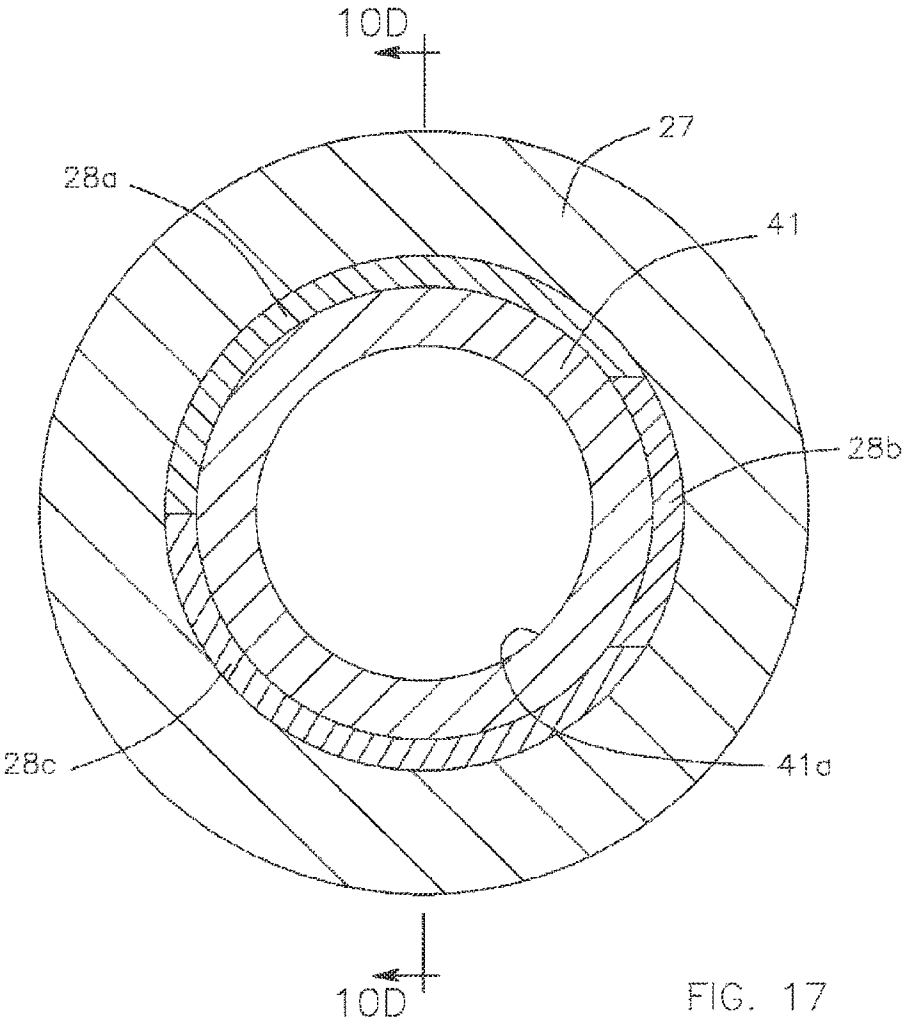
FIG. 17 is a section view, shown in full, defined in FIG. 10D.
Figure 18:
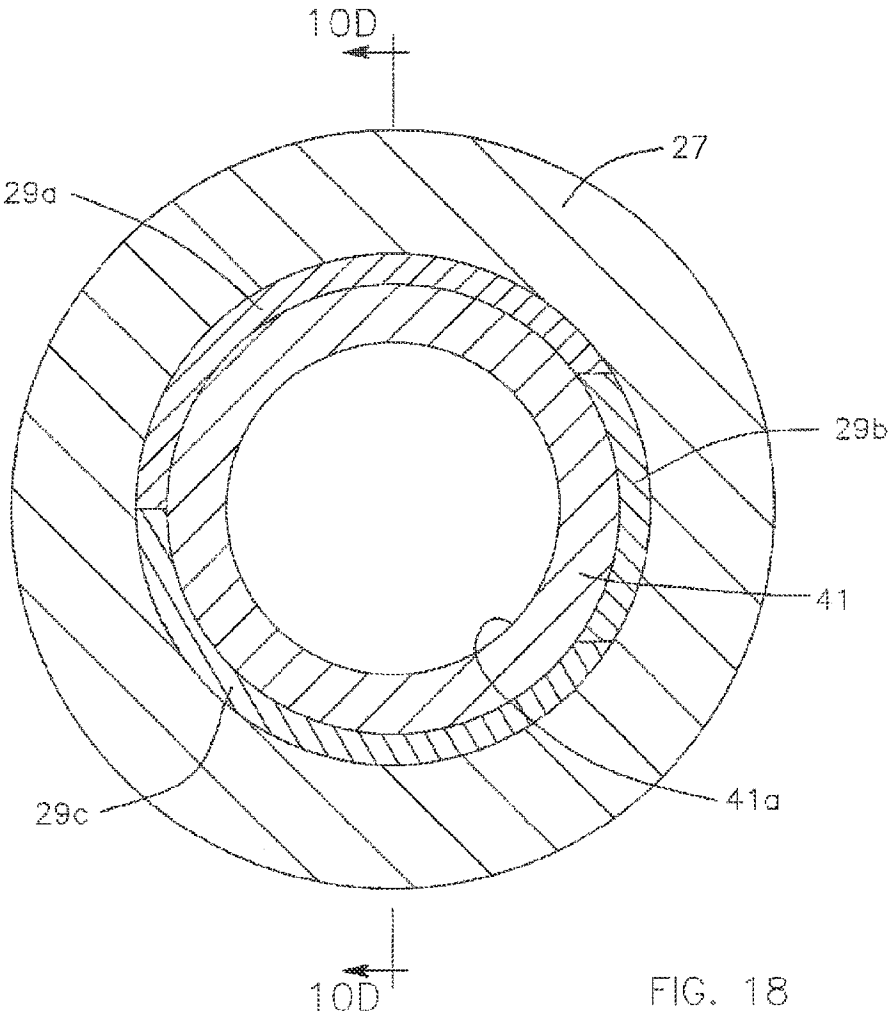
FIG. 18 is a section view, shown in full, defined in FIG. 10D.
Figure 19:
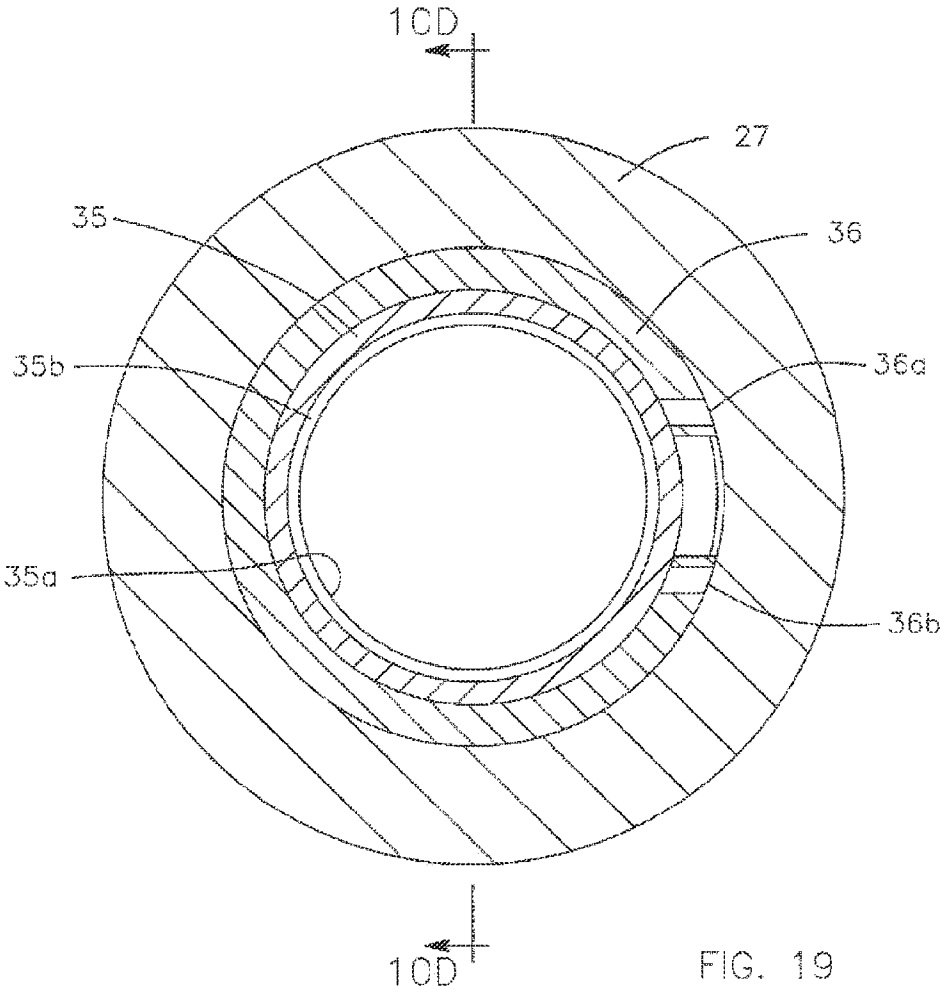
FIG. 19 is a section view, shown in full, defined in FIG. 10D.
Figure 20:
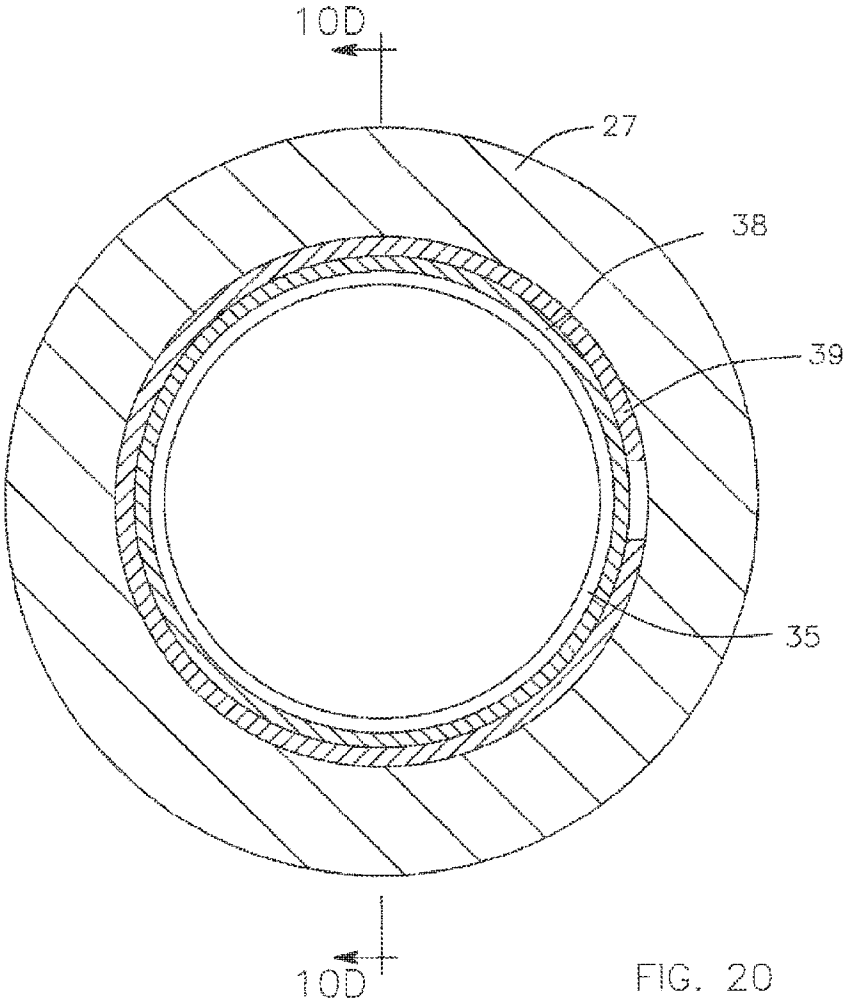
FIG. 20 is a section view, shown in full, defined in FIG. 10D.
Figure 21:
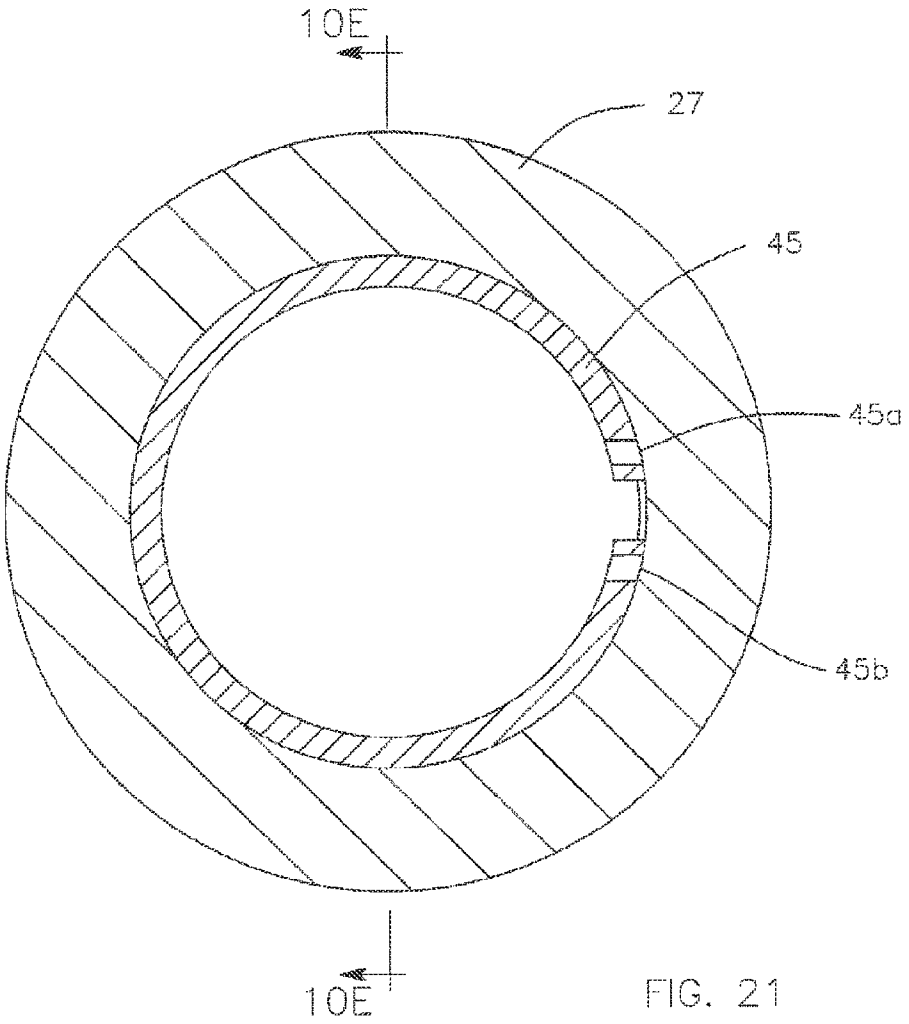
FIG. 21 is a section view, shown in full, defined in FIG. 10E.

Referring to FIGS. 10C and 10D, blocking sleeve 41 (FIG. 10C) is disposed within upper sub 18 and lower sub 27. Blocking sleeve 41 includes upper serration 41*b* engaged with compatible or mating serration 18*a* of upper sub 18 and lower serration 41*c* engaged with compatible or mating serration 27*d* of lower sub 27. Upper serration 18*a* and serration 41*b* are complementary and have angular clearance 42 (FIG. 13) for sliding engagement; accordingly, upper serration 18*a* and serration 41*b* may have the same number or angular pitch serration. Lower serration 41*c* and serration 27*d* are complementary and have angular clearance 42*a* (FIG. 15) for sliding engagement; accordingly, lower serration 41*c* and serration 27*d* may have the same number or angular pitch serration.

Upper serration 41*b* and serration 18*a* of upper sub 18 have a different number or angular pitch than lower serration 41*c* and serration 27*d* of lower sub 27. The summation of angular clearance 42 (FIG. 13) and angular clearance 42*a* (FIG. 15) is greater than the incremental pitch 43 (FIG. 24) between lower serration 41*c* and upper serration 41*b* (FIG. 10C). As best seen in FIGS. 23 and 23A-23D, incremental pitch 43 (FIG. 24) between serration 41*b* and 41*c* of blocking sleeve 41 (FIG. 10C) is shown adjacent to aligned teeth 43*a* (FIG. 24) (though alignment is not necessary for the pitch increment). Blocking sleeve 41 may be rotated such that engagement between upper serration 41*b* and serration 18*a* of upper sub 18 occurs simultaneously with engagement between lower serration 41*c* and serration 27*d* of lower sub 27, regardless of the rotational alignment of serration 18*a* and serration 27*d* when tool joint 33 is properly assembled. Thus, it may not be necessary to compromise desired assembly torque to adjust the angular alignment of upper sub 18 and lower sub 27 for engagement with blocking sleeve 41, nor are match-fit parts required.

Bushing 20 (FIG. 10B) includes an upper shoulder 20*c* (FIG. 10A) axially displaced from lower shoulder 20*b* (FIG. 10B) by an internal recess 20*e* which is disposed axially above internal diameter 20*a*; thus, a landing profile 20*h* is formed for landing and anchoring a UUT. Internal diameter 18*b* (FIG. 10A), which is the internal diameter of the passage of the drill stem axially above upper sub 18, internal diameter 41*a* (FIG. 10C) of blocking sleeve 41, and internal diameter of the drill stem axially below may all be greater in diameter than internal diameter 20*a*, in order to allow for the passage of a UUT. Shoulder 20*f* (FIG. 10B) and shoulder 41*k* (FIG. 10C) form recess 22*b*. Recess 22*b* and diameter 20*d* provide radial clearance for the functioning of a UUT. These features and their relationship with the UUT will be addressed during the discussion of the operation of the assembly below.

Tool joint 33 may be configured or specially lubricated such that it is properly assembled at a lower applied torque than other tool joints in a drill stem. Upper thread 18*c* of upper sub 18 and lower thread 27*c* of lower sub 27 are part of and form tool joints of a drill stem (not shown). These tool joints and others of the drill stem are configured or lubricated to properly assemble at a higher applied assembly torque than tool joint 33.

Blocking sleeve 41 is disposed within upper sub 18 and lower sub 27. Blocking sleeve 41 includes upper serration 41*b* that may be configured to engage compatible or mating serration 18*a* of upper sub 18, and lower serration 41*c* that may be configured to engage compatible or mating serration 27*d* of lower sub 27. Blocking sleeve 41, when engaged, may prevent relative rotation between upper sub 18 and lower sub 27. Blocking sleeve 41 also includes upper seal surface 41*e*, lower seal surface 41*f* (FIG. 10D), intermediate gap 41*d* (FIG. 10C), internal diameter 41*a*, upper end 41*g* of upper serration 41*b*, lower end 41*h* of lower serration 41*c*, upper end 41*j* and lower end 41*i* (FIG. 10D). Blocking sleeve 41 is prevented from upward axial displacement by upper end 41*j* engaging shoulder 22*a* of spacer 22. Internal recess 22*b* (FIG. 10C) is disposed axially above shoulder 22*a*. Blocking sleeve 41 is prevented from downward axial displacement by engagement between lower end 41*i* and "c" ring 36 (FIG. 10D).

Tool joint 33 is sealed by the contact of the rotary shoulders incorporated therein, while upper seal 23 and lower seal 32 function as debris barriers and maintain lubrication of serrations 18*a*, 41*b*, 27*d* and 41*c*. Upper seal surface 41*e* may be the same or very nearly the same diameter as lower seal surface 41*f* to assure ease of movement in a high hydrostatic pressure fluid environment.

Referring to FIG. 10D, "c" ring 36 is held in a radially expanded condition within groove 27*a* of lower sub 27 by support surface 35*c* of lock sleeve 35. Filler "c" ring 40 may be configured to be inserted within groove 27*e* in order to trap and transfer loads from retaining ring 39 and lower sub 27. Ring 38 and shock absorber 37, which is possibly made of elastomeric material, secure lock sleeve 35 in position for lock sleeve 35 to axially support "c" ring 36 and transfer loads axially from shoulder 35*d* of lock sleeve 35 to retaining ring 39. Retaining ring 39 is robust and may require a force to shear. In exemplary embodiments, the force may be tens of thousands of pounds. Lock sleeve 35 is lighter than blocking sleeve 41 and thus will create proportionately smaller inertial forces when subjected to the forces of rotary drilling. Shock absorber 37 protects retaining ring 39 from the affects of vibration and impact shock that take place during rotary drilling.

Axial gap 44 between "c" ring 36 and the axial upper end of lock sleeve 35 assures that forces acting to move blocking sleeve 41 downward are transferred from blocking sleeve 41, through "c" ring 36, to the shoulder 27*b* of groove 27*a* of lower sub 27. Internal diameter 41*a* of blocking sleeve 41 may be smaller than internal diameter 35*a* of lock sleeve 35, thereby providing protection from forces associated with lowering service tools through the drill stem, such as measurement while drilling tools and the like. Internal diameter 20*a* may be smaller than internal diameter 41*a* of blocking sleeve 41.

Blocking sleeve 41 may be unlocked by displacing lock sleeve 35 axially downward. A UUT engages shoulder 35*b* of lock sleeve 35, forcibly compelling shoulder 35*d* to axially compress shock absorber 37 and force ring 38 to shear retaining ring 39. After retaining ring 39 is sheared, forming an outer portion 39*a* which remains in groove 27*e* and an inner portion 39*b* which moves downwardly ahead of lock sleeve 35, the UUT displaces lock sleeve 35 downwardly into a position where support surface 35*c* is no longer in position to axially support "c" ring 36 in the radially expanded position within groove 27*a* of lower sub 27.

Subsequently, a UUT axially engages upper shoulder 41*k* (FIG. 10C) and forces blocking sleeve 41 axially downward. As blocking sleeve 41 is displaced downwardly, "c" ring 36 is forced downwardly and out of groove 27*a* while "c" ring 36 continues to forcibly compel lock sleeve 35 and inner portion 39*b* downwardly. With continued axial downward movement, upper serration 41*b* radially expands and passes through "c" ring 34, carried within groove 27*h* of lower sub 27. Blocking sleeve 41 is prevented from further downward displacement when lower end 41*i* of blocking sleeve 41, acting through "c" ring 36, lock sleeve 35, shock absorber 37, ring 38, inner portion 39*b*, and shoulder 45*a* of "c" ring 45, engages shoulder 27*s* of lower sub 27.

Blocking sleeve 41, upon being fully displaced axially downward, serration 18*a* of upper sub 18 is disengaged from upper serration 41*b* of blocking sleeve 41 and lower serration 41*c* is disengaged from serration 27*d* of lower sub 27. Accordingly, upper end 41*g* of upper serration 41*b* is now disposed axially below "c" ring 34, preventing upper serration 41*b* of blocking sleeve 41 from returning to engagement with serration 18*a* of upper sub 18. Torque applied in the opposite rotational direction from the torque applied during assembly will cause rotation between upper sub 18 and lower sub 27, as long as the portion of drill stem below lower body 26 is stuck or otherwise stabilized such that it will not rotate or move axially up or down. Continued rotation in the rotational direction opposite of that used in the assembly of tool joint 33 and lifting of the upper unstuck drill stem will disconnect the drill stem at tool joint 33.

Filler ring 40 (FIG. 2D) may aid in assembly. Initially filler ring 40 is disposed within internal diameter 27*q* (FIG. 2E). Retaining ring 39, ring 38, shock absorber 37, lock sleeve 35, "c" ring 36 and blocking sleeve 41 are displaced downward by a UUT until retaining ring 39 engages shoulder 45*a* of "c" ring 45. In this configuration, lower serration 41*c* of blocking sleeve 41 and 18*a* of upper sub 18 are disengaged and upper sub 18 may be properly assembled to lower sub 27. After proper torque is applied at tool joint 33, blocking sleeve 41 may be rotated for spline engagement, as discussed more fully above, and displaced upwardly until upper end 41*j* engages shoulder 22*a* of spacer 22. Subsequently, "c" ring 36, forcibly compelled by lock sleeve 35, is displaced upwardly. When "c" ring 36 reaches groove 27*a* it radially expands and allows lock sleeve 35 to pass underneath and radially support "c" ring 36 with support surface 35*c*. Thereafter, filler ring 40 is displaced axially upward to engage shock absorber 37 and retaining ring 39 with shoulder 35*d* of lock sleeve 35. In this position, filler "c" ring 40 may radially expand and engage shoulder 27*f* of lower sub 27.

Filler "c" ring 40 includes hole 40*a* and hole 40*b* to facilitate removal of filler "c" ring 40 from the groove 27*e* within lower sub 27. Likewise, "c" ring 36 includes hole 36*a* and hole 36*b* to facilitate removal of "c" ring 36 from lower sub 27. "C" ring 34 includes hole 34*a* and hole 34*b*, "c" ring 19 has hole 19*a* and 19*b*, "c" ring 21 has hole 21*a* and 21*b*, "c" ring 45 has hole 45*b* and 45*c* for the same purpose.

In further embodiments, it is also possible to assemble upper sub 18 and lower sub 27 with the proper assembly torque and requisite lubricant, then using a broaching process, to configure serration 18*a* and serration 27*d* to achieve aligned angular registry therebetween. In this instance, blocking sleeve 41 may be manufactured with upper serration 41*b* and lower serration 41*c* aligned and matching. The installation of all other components may be made without disassembling tool joint 33.

Referring collectively to FIGS. 25A-25H and 26-46, embodiments of an activation tool, unlocking and unblocking tool, or UUT 90 are illustrated. Referring initially to FIGS. 25A-25H, an upper end includes a fishing neck 100 (FIG. 25A) connected to a mandrel 101 by threads 102. Mandrel 101 is connected to upper control tube 103 (FIG. 25B) by threads 104, which is connected to intermediate control tube 105 (FIG. 25F) by threads 106 (FIG. 25E), which is connected to lower control tube 107 (FIG. 25G) with threads 108. An outer body 109 (FIG. 25A) is connected to core 110 (FIG. 25B) by threads 111, which is connected to upper core extension 112 (FIG. 25F) by threads 135 (FIG. 25E), which is connected to core adapter 113 (FIG. 25F) by threads 114, which is connected to intermediate core extension 115 (FIG. 25G) by threads 116 (FIG. 25F), which is connected to lower core adapter 117 (FIG. 25G) by threads 118, which is connected to lower core extension 119 (FIG. 25H) by threads 120. Core extensions 112, 115, and 117 may also be referred to herein as inner tubular members 112, 115, and 117.

The interaction of shoulder 101*g* (FIG. 25A) with shoulder 109*s* provide an up stop, and the interaction of end surface 101*h* (FIG. 25B) with end surface 110*a* provide a down stop, respectively, limiting the relative motion between the mandrel 101 and body 109 during the functioning of the UUT, and will be further addressed during the discussion of the operation of the assembly below.

Grapple 121 (FIG. 25C) is connected to upper barrel 122 (FIG. 25E) by threads 123 with connector 124 clamped therebetween. Upper barrel 122 is connected to intermediate barrel 125 (FIG. 25G) by threads 126 (FIG. 25F) with intermediate connector 127 therebetween. Intermediate barrel 125 (FIG. 25G) is connected to protector 128 (FIG. 25H) by threads 129 (FIG. 25G) with lower connector 130 (FIG. 25H) therebetween. Barrels 122, 125 and protector 128 may also be referred to herein as outer tubular members 122, 125, and 128.

Figure 25A:
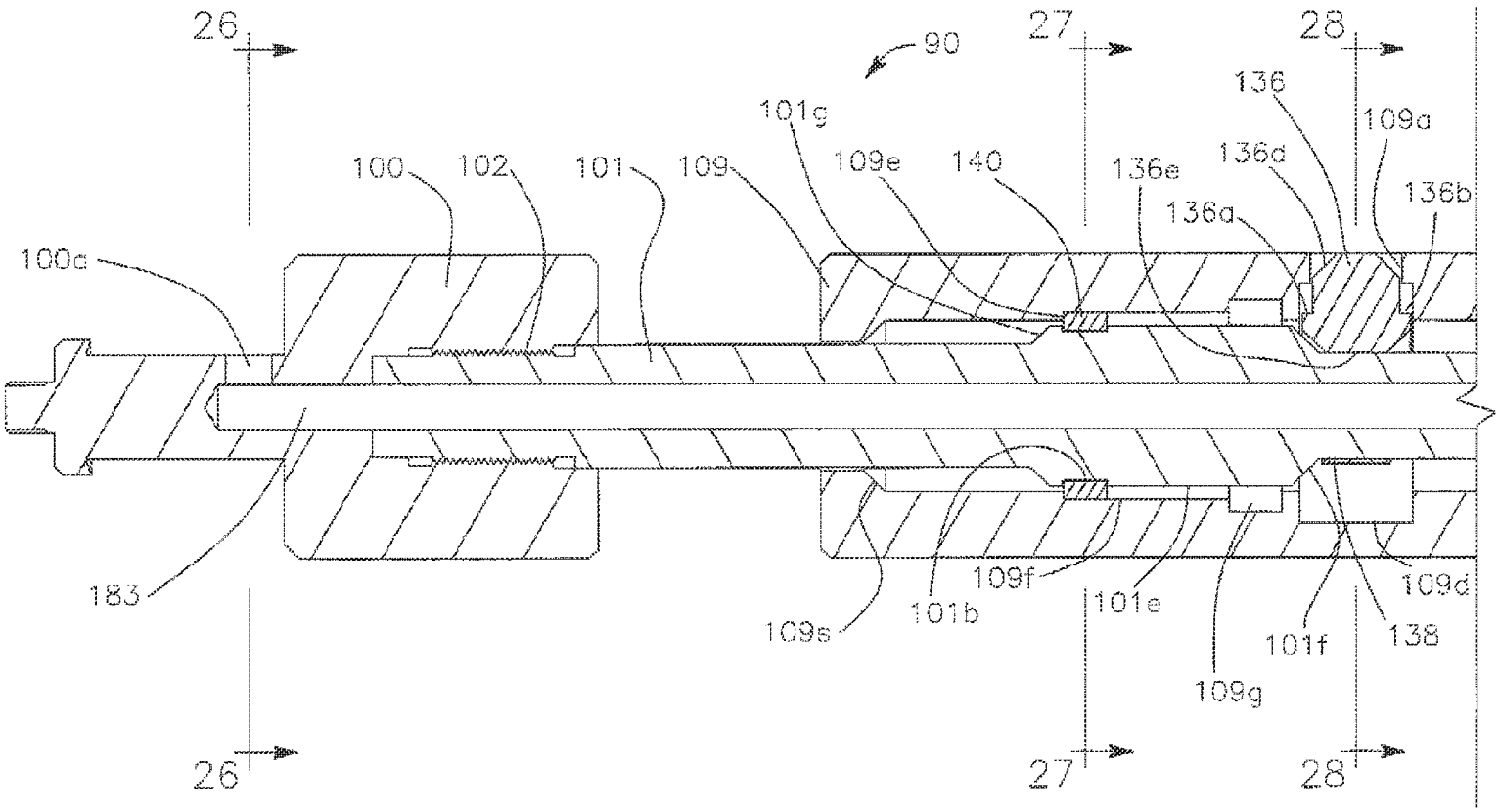
FIG. 25A is a section view of the upper most end of the UUT.
Figure 25B:
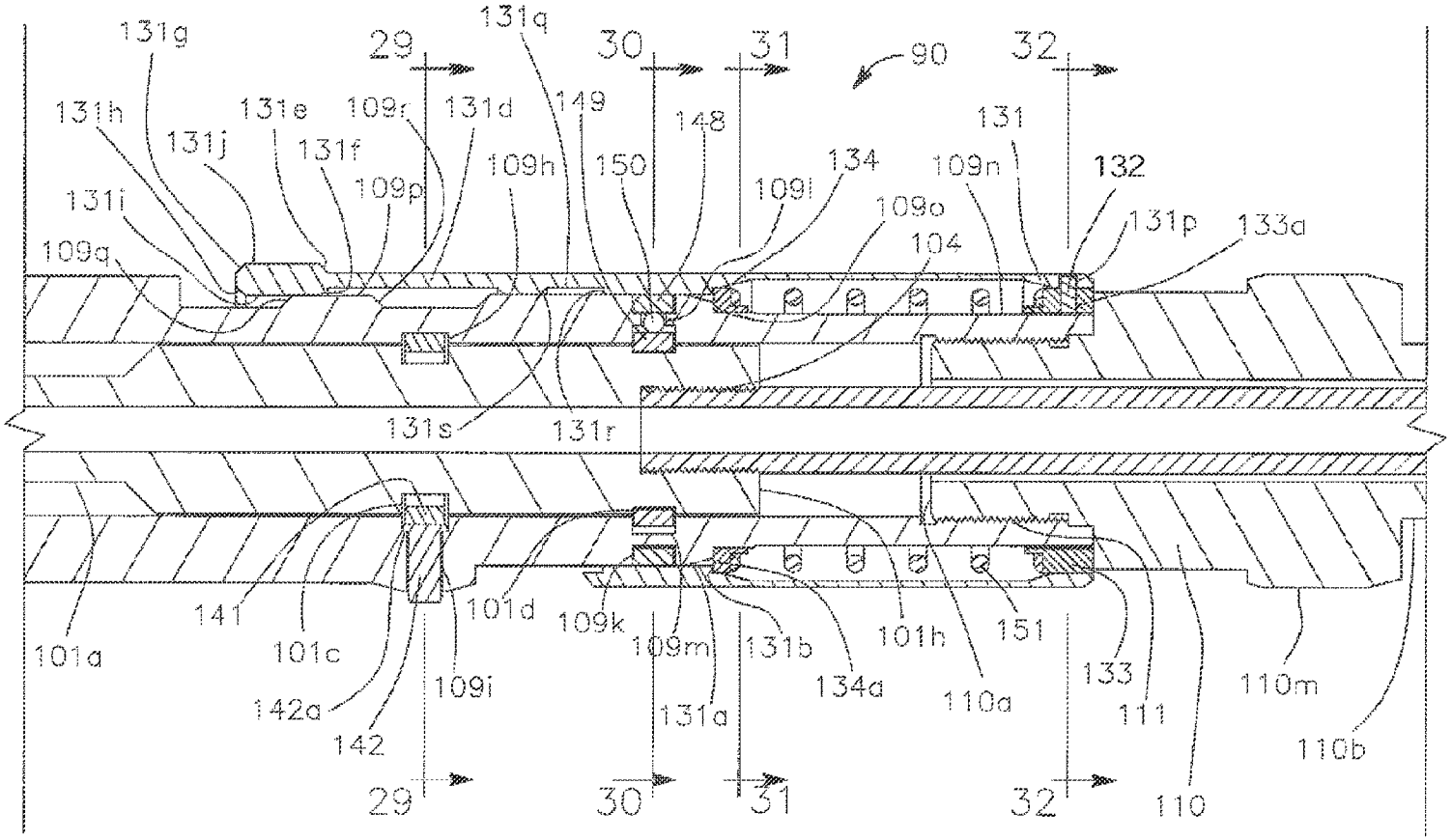
FIG. 25B is an intermediate section view of the UUT.
Figure 32:
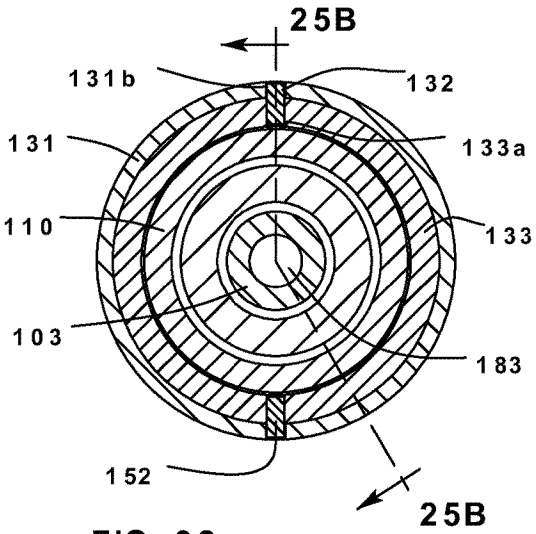
FIG. 32 is a section view, shown in full, defined in FIG. 25B.
Figure 37:
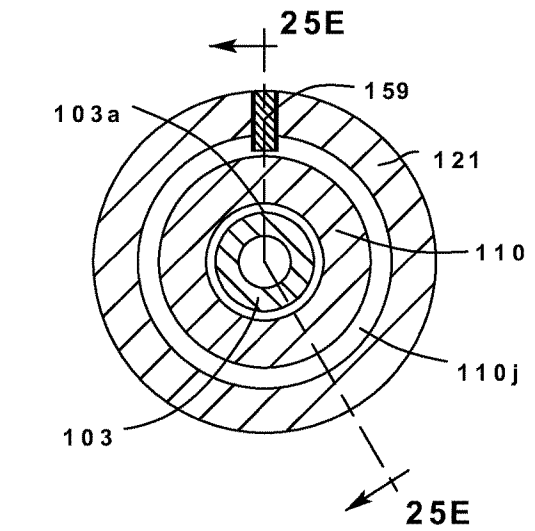
FIG. 37 is a section view, shown in full, defined in FIG. 25E.
Figure 36:
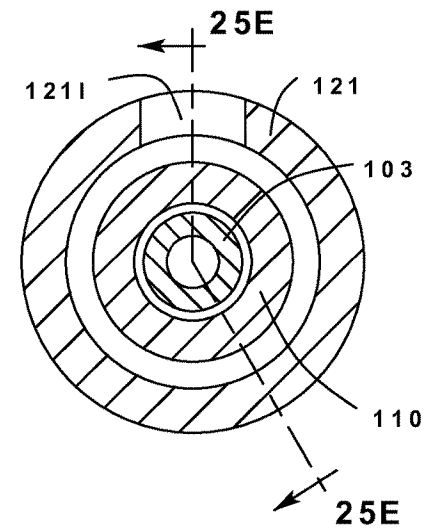
FIG. 36 is a section view, shown in full, defined in FIG. 25E.
Figure 35:
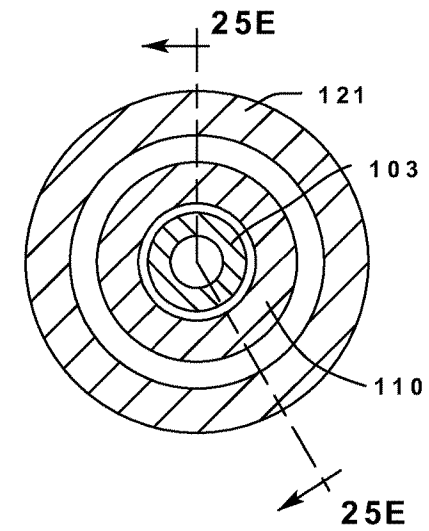
FIG. 35 is a section view, shown in full, defined in FIG. 25E.
Figure 38:
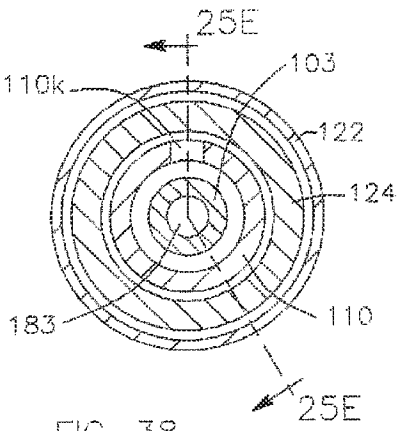
FIG. 38 is a section view, shown in full, defined in FIG. 25E.
Figure 39:
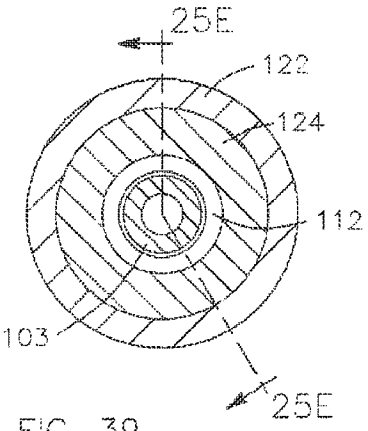
FIG. 39 is a section view, shown in full, defined in FIG. 25E.
Figure 40:
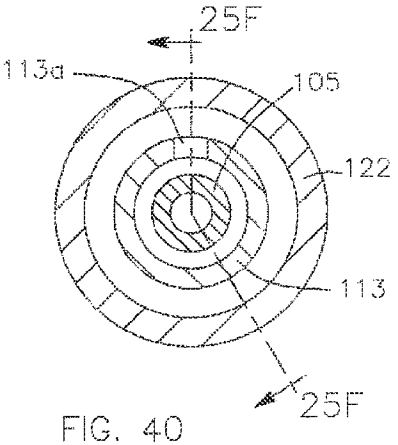
FIG. 40 is a section view, shown in full, defined in FIG. 25F.
Figure 41:
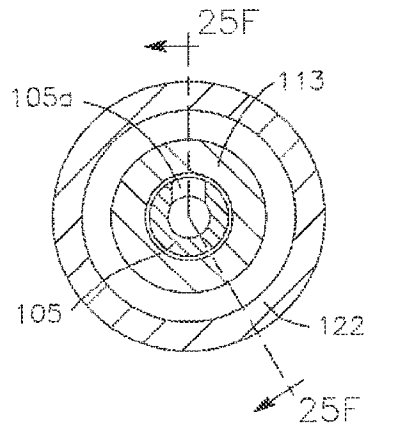
FIG. 41 is a section view, shown in full, defined in FIG. 25F.
Figure 42:
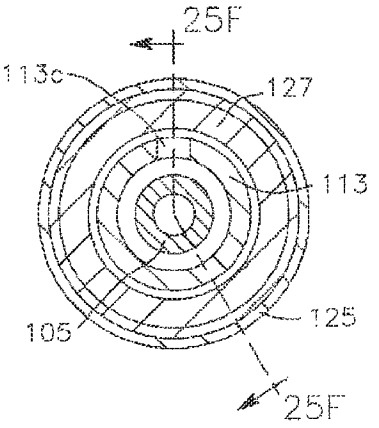
FIG. 42 is a section view, shown in full, defined in FIG. 25F.
Figure 43:
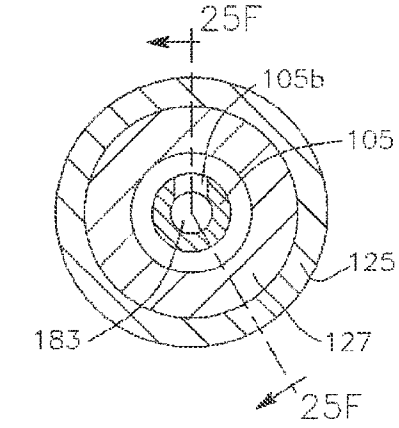
FIG. 43 is a section view, shown in full, defined in FIG. 25F.
Figure 46:
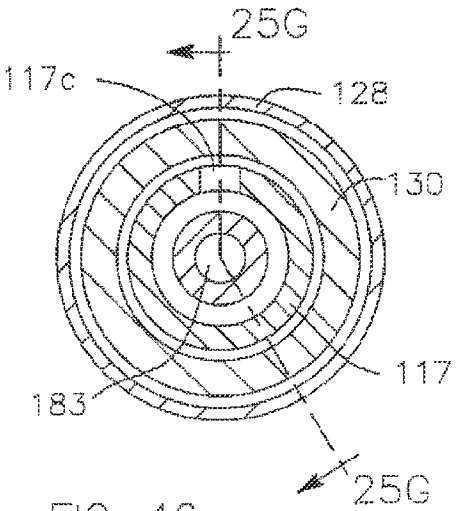
FIG. 46 is a section view, shown in full, defined in FIG. 25G.
Figure 45:
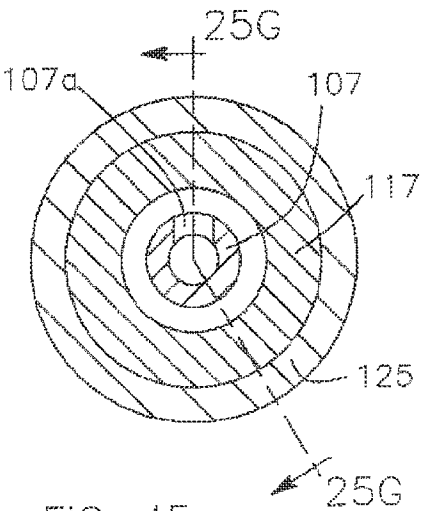
FIG. 45 is a section view, shown in full, defined in FIG. 25G.
Figure 44:
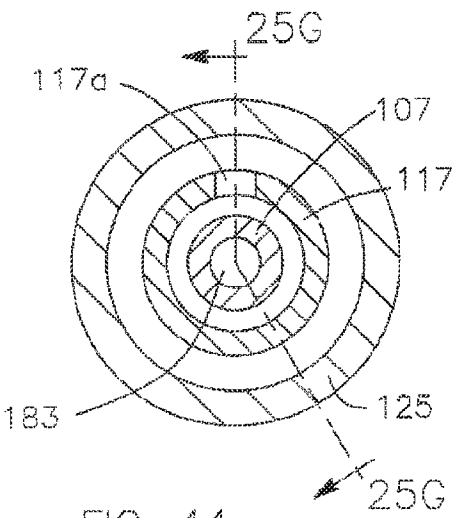
FIG. 44 is a section view, shown in full, defined in FIG. 25G.

Referring to FIGS. 25B and 32, a grapple or collet 131 (FIG. 25B) is connected by shear pin 132 in hole 131*p* and hole 133*a* to a first or lower ring 133. Shear pin 152 is located opposite and is functionally identical to shear pin 132. A second or upper ring 134 contacts shoulder 109*o* and spring 151.

Figure 28:
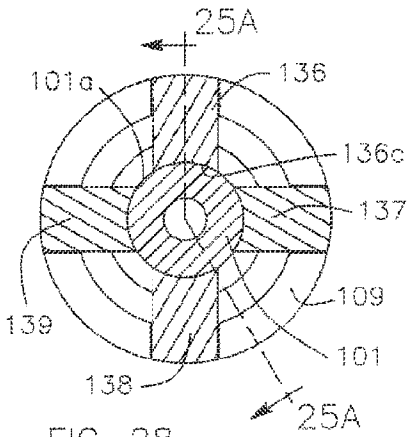
FIG. 28 is a section view, shown in full, defined in FIG. 25A.

Referring to FIGS. 25A and 28, key 136 (FIG. 25A) is radially movable in window 109*a* of body 109. Radial outward motion of key 136 is limited by shoulder 136*a*, shoulder 136*b* and bore 109*d*. Radial inward movement of key 136 is limited by surface 136*c* contacting diameter 101*a*. Key 137, key 138 and key 139 (FIG. 28) are functionally identical and fitted for movement within body 109 the same as key 136. The interaction of key 136 with shoulder 101*f* and diameter 101*e* will be addressed further during the discussion of the operation of the assembly below.

Figure 27:
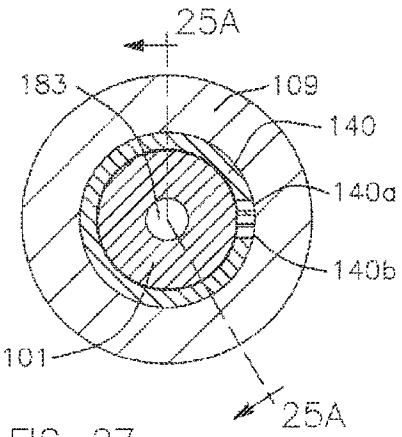
FIG. 27 is a section view, shown in full, defined in FIG. 25A.
Figure 26:
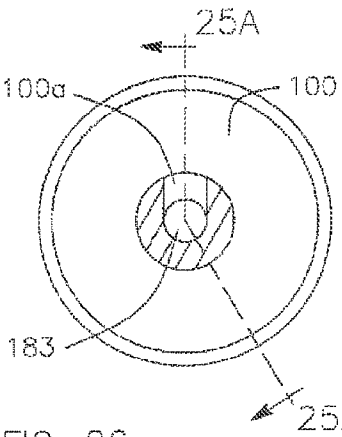
FIG. 26 is a section view, shown in full, defined in FIG. 25A.
Figure 31:
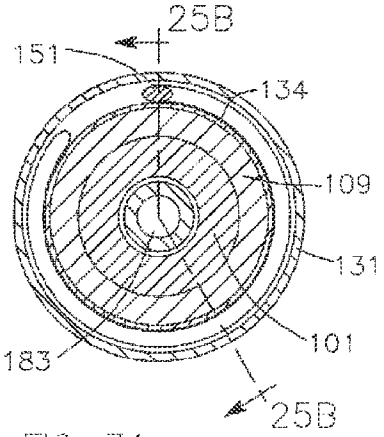
FIG. 31 is a section view, shown in full, defined in FIG. 25B.

Referring to FIGS. 25A and 27, "c" ring 140 is in groove 101*b*, contacting shoulder 109*e* and limiting upward movement of mandrel 101 with respect to body 109. "C" ring 140 is biased radially outward but restrained from expansion by bore 109*f*. The function of groove 109*g* will be addressed during the discussion of the operation of the assembly below. Hole 140*a* and hole 140*b* facilitate assembly and disassembly.

Figure 29:
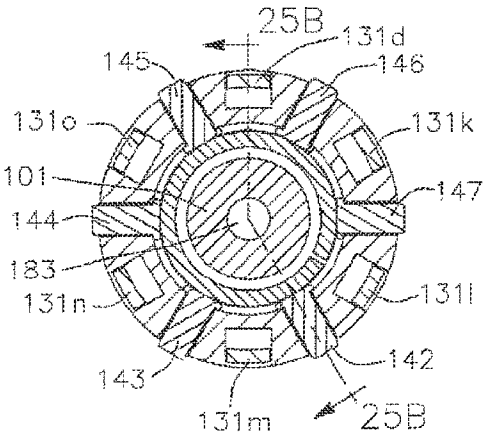
FIG. 29 is a section view, shown in full, defined in FIG. 25B.
Figure 34:
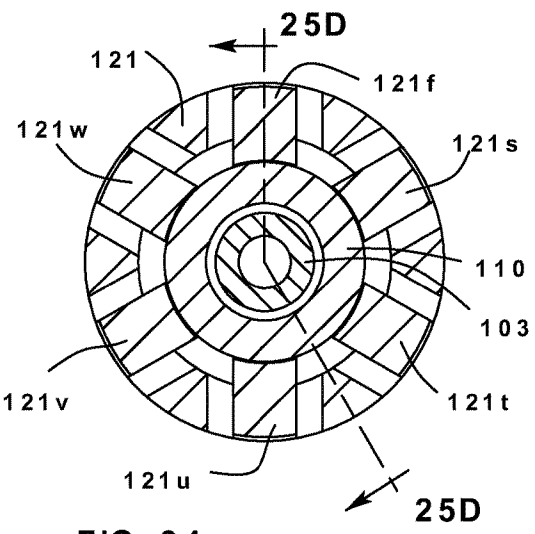
FIG. 34 is a section view, shown in full, defined in FIG. 25D.
Figure 33:
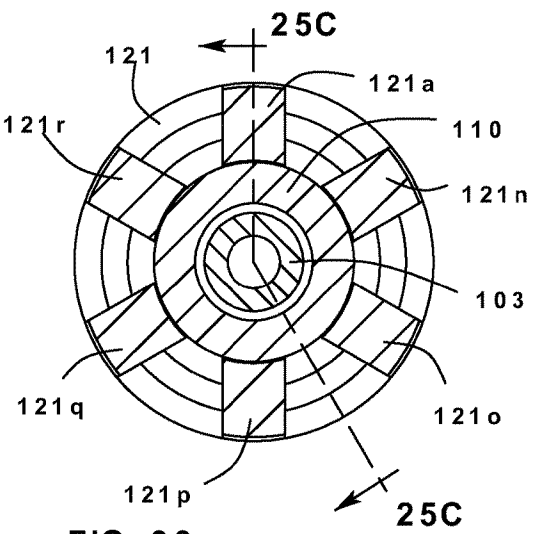
FIG. 33 is a section view, shown in full, defined in FIG. 25C.

Referring to FIGS. 25B and 29, a bore sensor 142 is disposed in the body 109. Bore sensor 142 is radially movable in hole 109*i*. "C" ring 141 is within groove 101*c* and groove 109*h* preventing mandrel 101 from moving down with respect to body 109. "C" ring 141 is biased radially outward, pushing sensor 142 outward. "C" ring 141 may be referred to herein as second inner c-ring 141. Radial outward motion of bore sensor 142 is stopped by flange 142*a* contacting groove 109*h*. Bore sensors 143, 144, 145, 146 and 147 (FIG. 29) are functionally similar and fitted for movement within body 109 the same as bore sensor 142.

Figure 30:
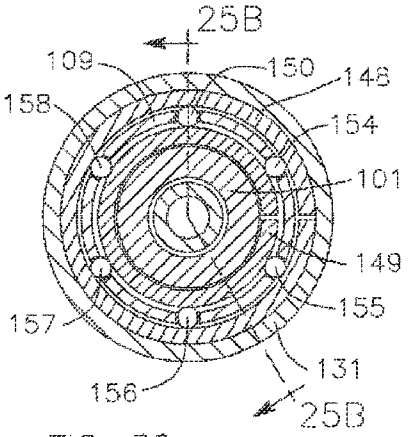
FIG. 30 is a section view, shown in full, defined in FIG. 25B.

Referring to FIGS. 25B and 30, "C" ring 148 is in groove 109*k* and is biased radially outward against bore 131*a*. Radially translatable member or ball 150 is radially movable in an aperture or hole 109*l* and urged radially outward by "c" ring 149 which is within groove 109*m* and groove 101*d*. "C" ring 149 prevents downward movement of mandrel 101 with respect to body 109. Ball 154, ball 155, ball 156, ball 157 and ball 158 (FIG. 30) are functionally identical and fitted for movement within body 109 the same as ball 150. "C" ring 149 may be referred to herein as first inner c-ring 149 and "C" ring 148 may be referred to herein as outer c-ring 148.

Referring to FIG. 25B, spring 151 forcibly compels collet 131, shear pin 132 and lower ring 133 downwardly. The limit of downward motion is lower ring 133 contacting core 110. Spring 151 is sufficiently forceful to overcome friction between "c" ring 148 and bore 131*a*. Lower ring 133 is free to move upwardly against spring 151 along diameter 109*n*. Spring 151 also urges upper ring 134 upwardly. Upper ring 134 is prevented from upward movement along diameter 109*n* by shoulder 109*o*.

Collet 131 has finger 131*d* with lower external shoulder 131*e*, lower internal shoulder 131*f*, upper external shoulder 131*g*, upper internal shoulder 131*h*, internal surface 131*i* and external surface 131*j*. The functional interface of lower internal shoulder 131*f* of collet finger 131*d* with diameter 109*p* and shoulder 109*q* of body 109 will be addressed during the discussion of the operation of the assembly below. In FIG. 25B, finger 131*d* is not biased inwardly for contact between internal surface 131*i* and diameter 109*p*. Collet 131 has fingers 131*k*, 1311, 131*m*, 131*n* and 1310 (FIG. 29) that are similar and functionally the same as finger 131*d*.

Figure 25C:
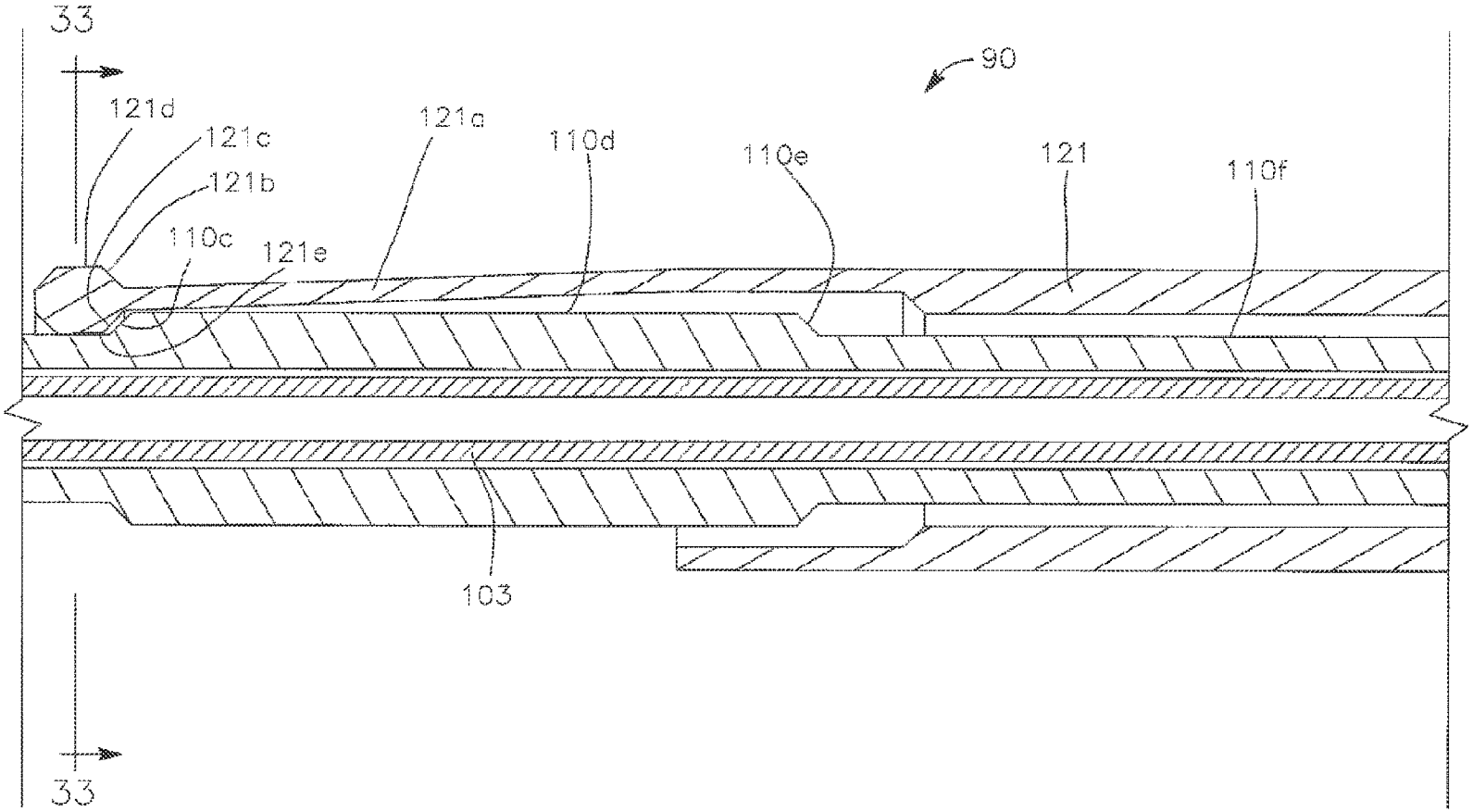
FIG. 25C is an intermediate section view of the UUT.
Figure 25D:
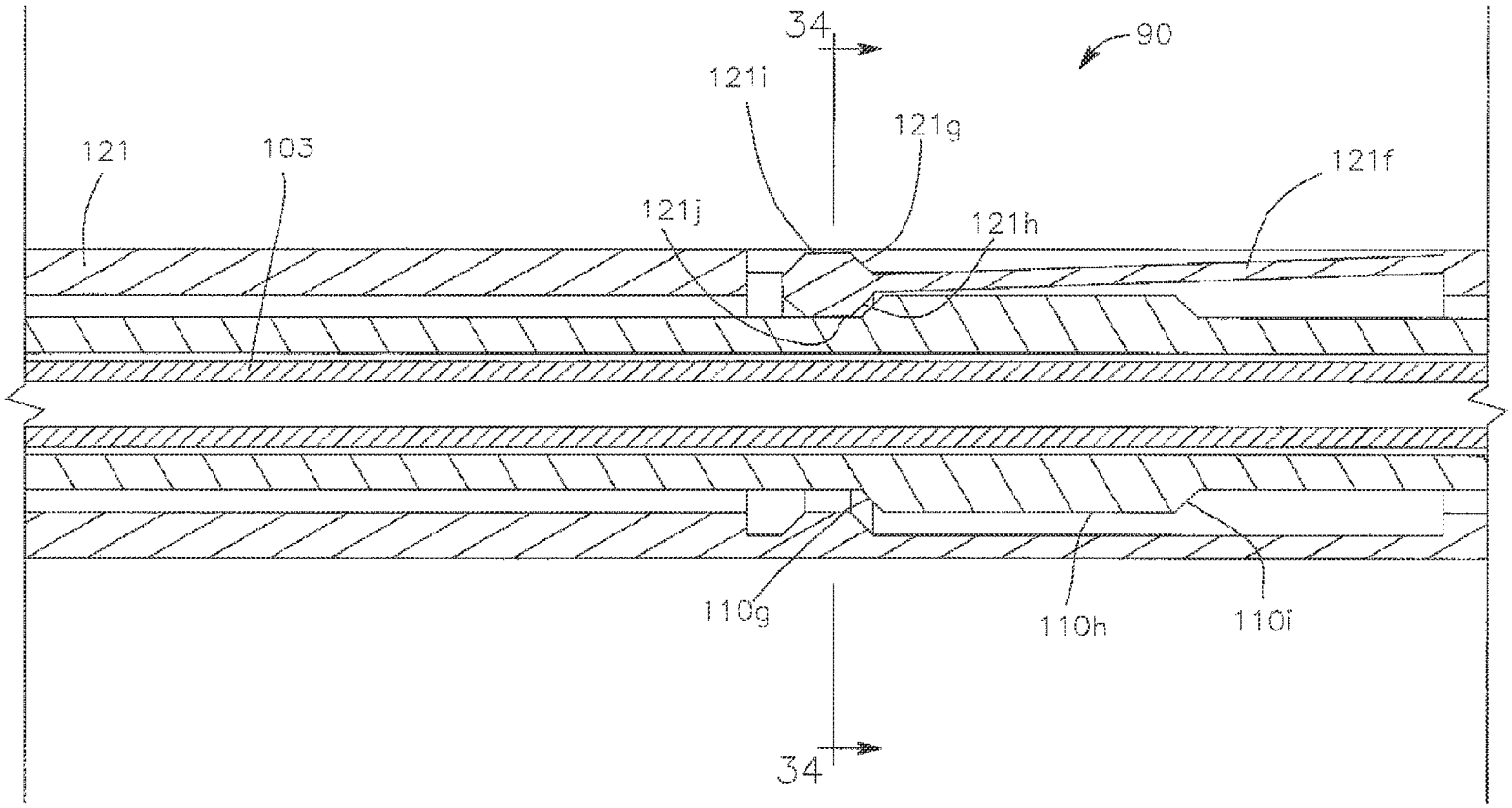
FIG. 25D is an intermediate section view of the UUT.

Referring to FIGS. 25C, 33 and 25D, 34, upper finger 121*a* (FIGS. 25C and 33) may be relaxed and in the inward position shown in FIG. 25C, with internal surface 121*e* adjacent diameter 110*b*. Lower finger 121*f* (FIGS. 25D and 34) may be relaxed and in the inward position shown in FIG. 25D, with internal surface 121*j* adjacent diameter 110*f*. Upper finger 121*n*, upper finger 121*o*, upper finger 121*p*, upper finger 121*q* and upper finger 121*r* (FIG. 33) are similar and functionally the same as upper finger 121*a*. Lower finger 121*s*, lower finger 121*t*, lower finger 121*u*, lower finger 121*v* and lower finger 121*w* (FIG. 34) are similar and functionally the same as lower finger 121*f*.

Figure 25E:
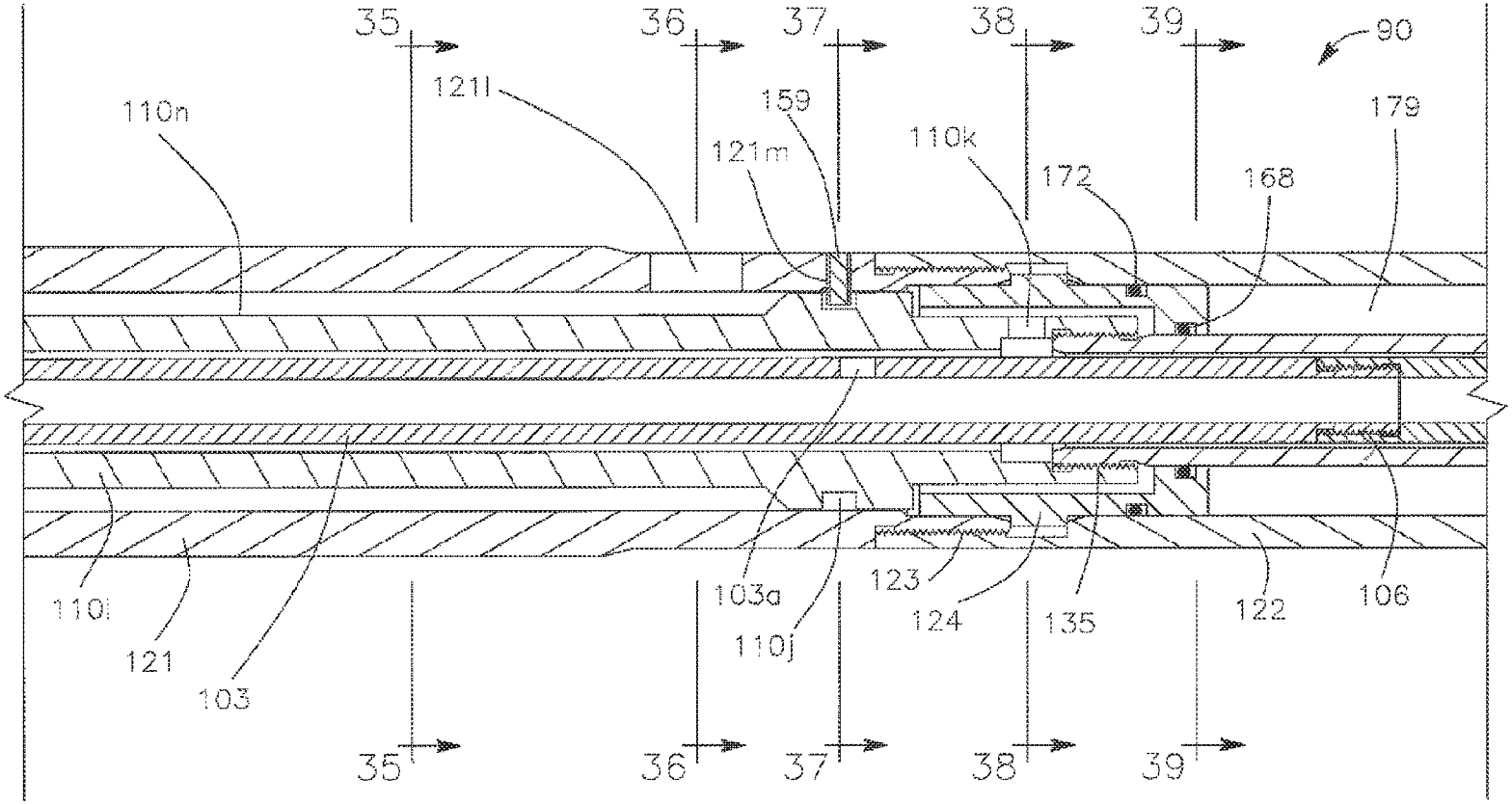
FIG. 25E is an intermediate section view of the UUT.

Referring to FIG. 25E, fluid passage 1211, 103*a* and 110*k* assure fluid communication and equal pressure between the radially outer and inner cylindrical surfaces of grapple 121. Shear screw 159 is secured within threaded hole 121*m* and within groove 110*j*, locating grapple 121 axially along core 110.

The interrelationship of external shoulder 121*b*, external surface 121*d*, external surface 121*i*, external shoulder 121*g*, lower external shoulder 131*e*, external surface 131*j* and shoulder 136*d* with the DSD 50 of FIGS. 1, 2A-2F, 3-8, 22, and 22A-22D will be addressed during the discussion of the operation of the assembly below.

Figure 25F:
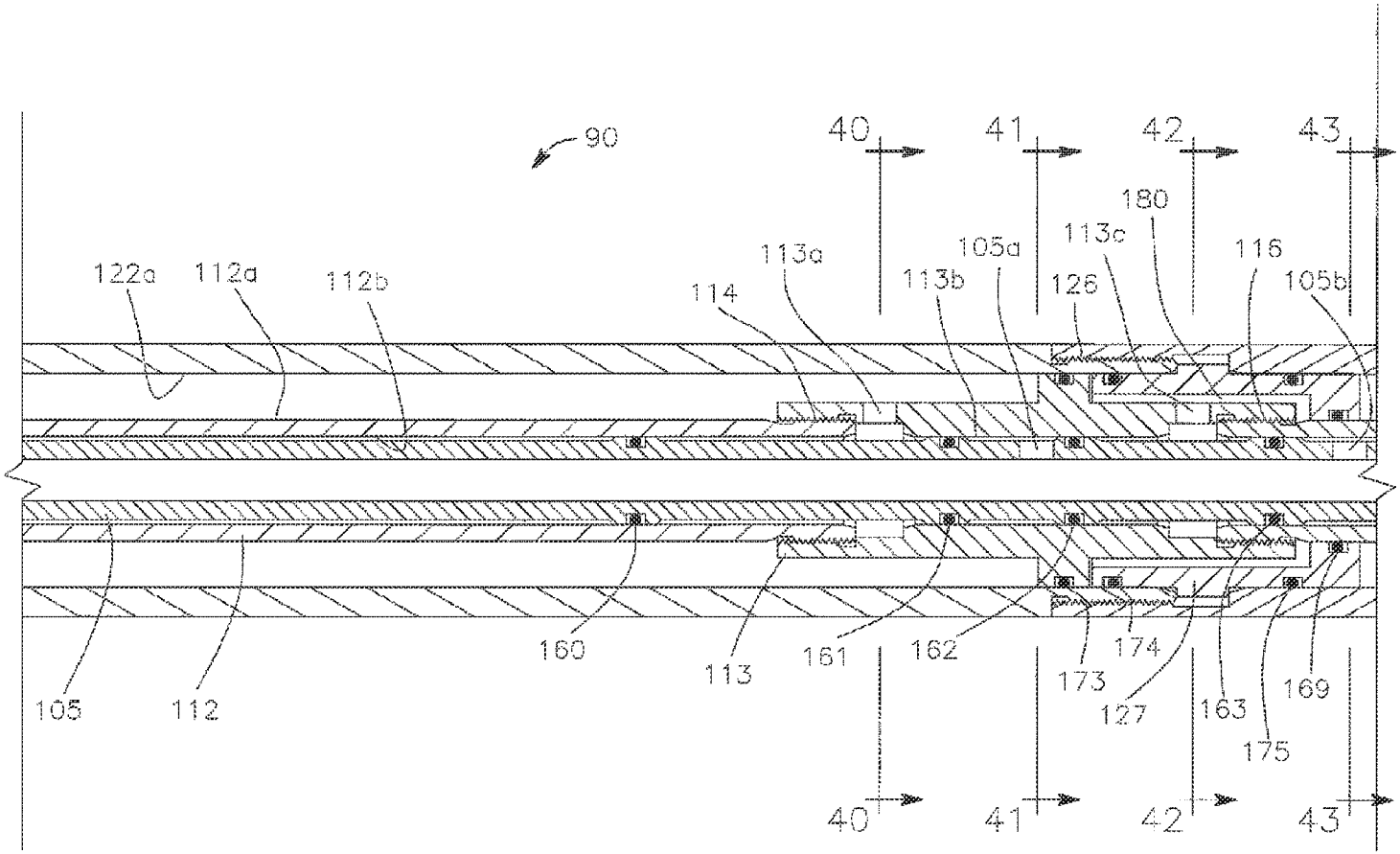
FIG. 25F is an intermediate section view of the UUT.

Referring to FIGS. 25E and 25F, chamber 179 is formed by seal surface 112*a*, seal 168, connector 124, seal 172, seal bore 122*a*, seal 173 and core adapter 113. Fluid passage 113*a* and the leak path of thread 114 are sealed by seal bore 112*b*, seal 160, intermediate control tube 105, seal 161 and seal bore 113*b*.

Referring to FIG. 25F, chamber 180 is formed by seal surface 115*a*, seal 169, intermediate connector 127, seal 174, seal bore 122*a*, seal 173 and core adapter 113. Fluid passage 113*c* and the leak path of thread 116 are sealed by seal bore 113*b*, seal 162, intermediate control tube 105, seal 163 and seal bore 115*b*.

Figure 25G:
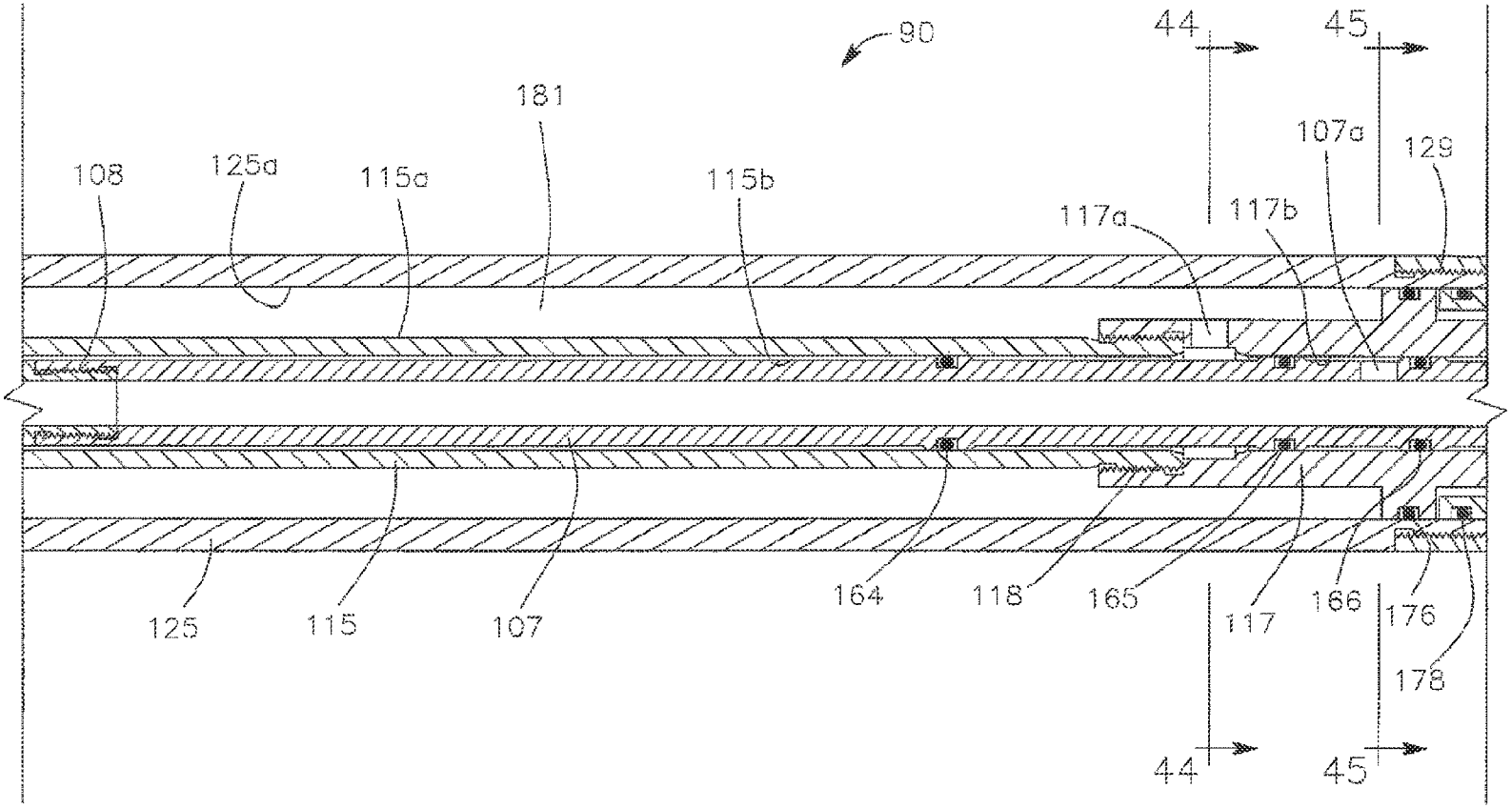
FIG. 25G is an intermediate section view of the UUT.
Figure 25H:
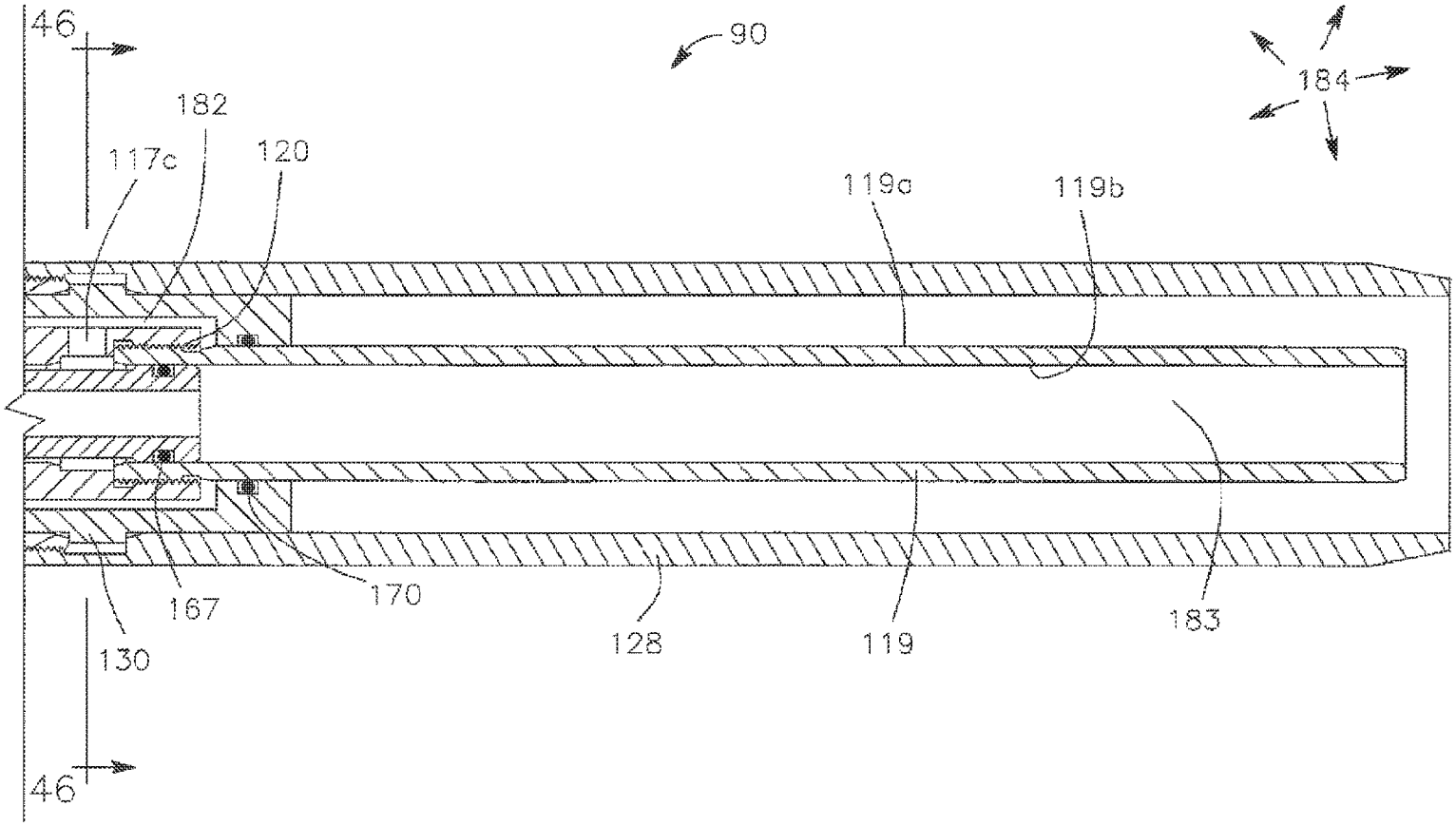
FIG. 25H is a section view of the lower most end of the UUT.

Referring to FIGS. 25F-25H, chamber 181 (FIG. 25G) is formed by seal surface 115*a*, seal 169, intermediate connector 127, seal 175, seal bore 125*a*, seal 176 and lower core adapter 117. Fluid passage 117*a* and the leak path of thread 118 are closed by seal bore 115*b*, seal 164, lower control tube 107, seal 165 and seal bore 117*b*. Chamber 182 (FIG. 2511) is formed by seal surface 119*a*, seal 170, lower connector 130, seal 178, seal bore 125*a*, seal 176 and lower core adapter 117. Fluid passage 117*c* and the leak path of thread 120 are sealed by seal bore 117*b*, seal 166, lower control tube 107, seal 167 and seal bore 119*b*.

Referring to FIGS. 25A-25H, fluid passage 183 (FIG. 2511) extends through the interior of protector 128, seal bore 119*b* to seal 167, lower control tube 107 (FIG. 25G), through fluid passage 107*a*, seal bore 117*b* between seal 165 and seal 166, intermediate control tube 105 (FIG. 25F), through fluid passage 105*b*, seal bore 115*b* between seal 163 and seal 164, through fluid passage 105*a*, seal bore 113*b* between seal 161 and seal 162, upper control tube 103 (FIG. 25E), through fluid passage 103*a*, which is open to hydrostatically pressurized fluid 184 (FIG. 2511), mandrel 101 (FIG. 25A), fishing neck 100 and thru fluid passage 100*a*. When submerged deep within a fluid filled well, high hydrostatically pressurized fluid 184 may enter fluid passage 183 and surround chamber 179 (FIG. 25E), chamber 180 (FIG. 25F), chamber 181 (FIG. 25G) and chamber 182 (FIG. 2511).

Seal bore 119*b* (FIG. 2511), seal bore 117*b* (FIG. 25G), seal bore 115*b*, seal bore 113*b* (FIG. 25F) and seal bore 112*b*, are substantially the same. There is no or very little force caused by high hydrostatically pressurized fluid 184, as would exist deep within a fluid filled well, to move the fishing neck 100 up or down.

As assembled, chamber 179, chamber 180, chamber 181 and chamber 182 contain air at or near the atmospheric pressure in which they were assembled. Seal surface 112*a* (FIG. 25F) and seal surface 119*a* (FIG. 2511) are the same or very nearly the same diameter; thus, there is a balancing upward force acting on lower connector 130 against a downward force acting on connector 124 (FIG. 24E).

Referring to FIG. 25E, grapple 121 and core 110 are designed such that high pressure fluid 184 surrounding the UUT may not result in the severing of shear screw 159.

Referring to FIGS. 25A-25H, as will be more fully described in the discussion of operation of the assembly below, the net result of allowing hydrostatically pressurized fluid 184 into chamber 180 and 182 would be to urge grapple 121 downward and to equally urge body 109 upward.

Allowing hydrostatically pressurized fluid 184 within chamber 180 (FIG. 25F) creates a downward force on intermediate connector 127 and an upward force on core adapter 113. Allowing hydrostatically pressurized fluid 184 within chamber 182 (FIG. 2511) eliminates the upward force upon lower connector 130 that acted to balance the downward force upon core adapter 124 (FIG. 25E), which creates an upward force on lower core adapter 117 (FIG. 25G).

The functional interrelationship of the relative longitudinal position of the fishing neck 100 with respect to body 109 and the affected fluid passages 113*a*, 105*a*, 113*c*, 105*b*, 117*a*, 107*a* and 117*c* and related chambers 179, 180, 181, and 182 will be addressed during the discussion of the operation of the assembly below.

The interrelationship and operation of UUT 90 shown in FIGS. 25A-25H and 26-46 with the DSD 50 shown in FIGS. 1, 2A-2F, 3-8, 22 and 22A-22D is discussed below as if being used in a hypothetical well.

Functionally identical items disclosed in FIGS. 25A, 25B, 28-30 and 32 will not be mentioned below for brevity. In the following discussion, key 136 will be inclusive of functionally identical key 137 (FIGS. 25A and 28), key 138, and key 139. Bore sensor 142 (FIGS. 25B and 29) will be inclusive of functionally identical bore sensor 143, bore sensor 144, bore sensor 145, bore sensor 146 and bore sensor 147. Ball 150 (FIGS. 25B and 30) will be inclusive of functionally identical ball 154, ball 155, ball 156, ball 157 and ball 158. Shear pin 152 (FIGS. 25B and 32) will be inclusive of functionally identical shear pin 153.

In an exemplary embodiment, a well includes multiple DSD's installed at intervals along the length of a rotary drill stem. The spacing, number and location Of the DSD's is based on a risk analysis by those responsible for the drilling program. For example, one DSD may be connected between every nine joints of drill pipe, starting at two thousand feet above the drill bit and continuing to the surface. Thus, there would be twelve disconnects in the well. Further, the drill pipe could be stuck such that the drill pipe will not move up or down, cannot be rotated and circulation of drill fluids is not possible. The pipe could then be stretched and relaxed to hypothetically determine that the pipe is stuck below the eighth DSD.

In such an exemplary situation, a UUT 90 would be connected to a conventional wireline unit, with appropriate weight bar, jars, running tool and the like (not shown), via the fishing neck 100.

Referring to FIGS. 2A-2C, 25A, 25B, 47A-47G, the UUT 90 is lowered, then raised and lowered again within the well drill stem. "C" ring 140 (FIG. 25A) is within groove 101*b* and shoulder 109*e* receives the weight of the UUT 90 and transmits upward forces from the wireline (not shown) in all of the motions. During the movements of the UUT 90, mandrel 101 and body 109 do not move relative to one another and thus the lower portions of the UUT 90 are inactive.

Figure 47A:
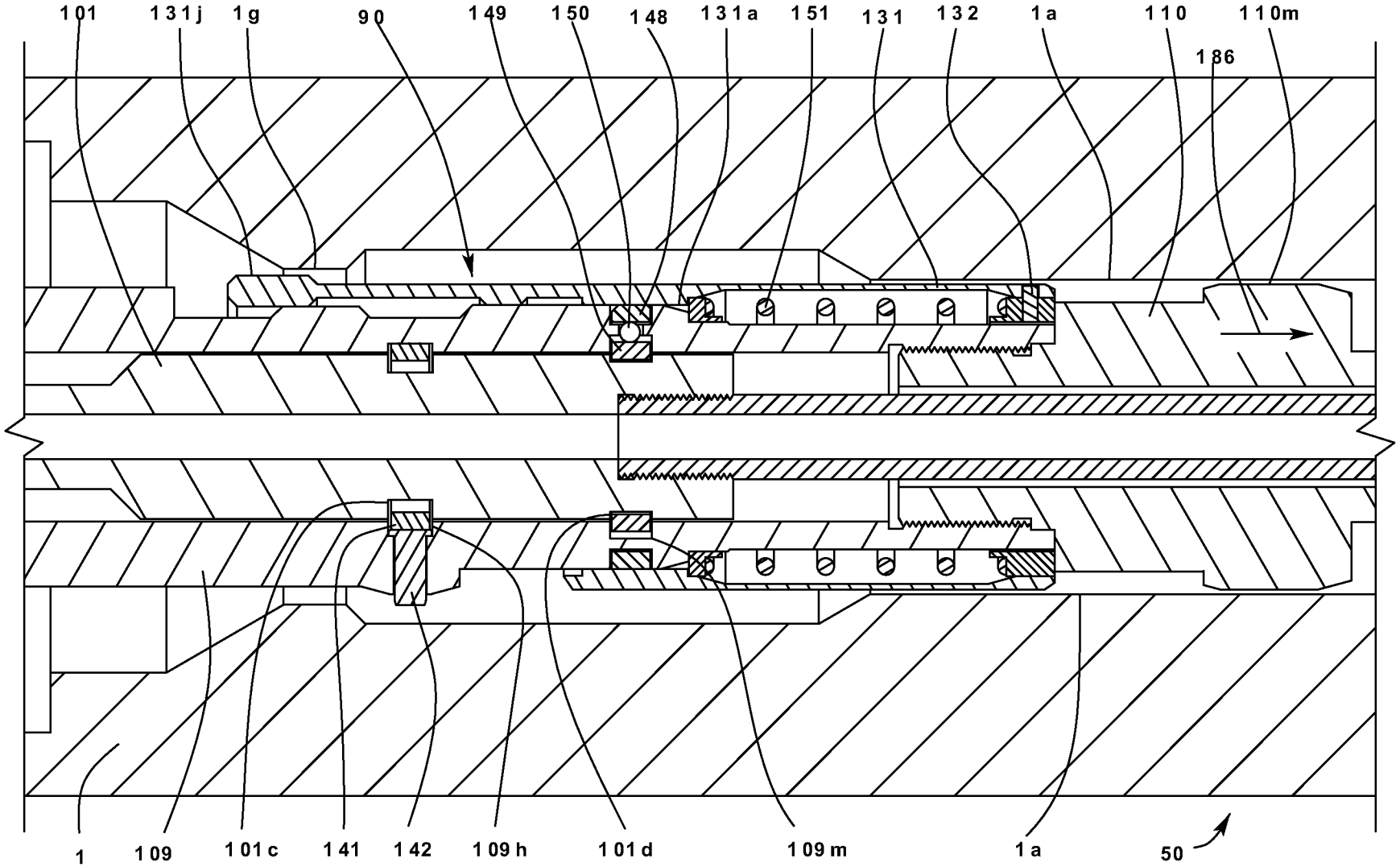
FIG. 47A is a partial section view of the UUT as shown in FIG. 25A and FIG. 25B; as it is lowered through a drill stem above the DSD as shown in FIG. 2A and FIG. 2B.

FIG. 47A shows the portion of the UUT 90 described previously in FIG. 25B, as it is received within the first DSD 50 of the twelve identical DSD's of this exemplary situation. Arrow 186 indicates the direction of the axial motion of UUT 90. Outer diameter 110*m* of core 110 slides axially through internal diameter 1*a* of upper body 1, with a clearance existing between the two diameters. The external surface 131*j* passes through internal diameter 1*g* with a clearance existing between the two diameters. Bore 131*a* prevents the radially outward biased "c" ring 148 from expanding outwardly, and because of ball 150, radially outward biased "c" ring 149 is prevented from expanding outwardly. "C" ring 149 is within groove 101*d* and groove 109*m*, preventing relative movement between mandrel 101 and body 109. Bore sensor 142 is radially displaced outward by "c" ring 141 and is disposed within groove 101*c* and 109*h*, preventing relative movement between mandrel 101 and body 109. Shear pin 132 remains unsevered and spring 151 forcibly urges collet 131 downward.

Figure 47B:
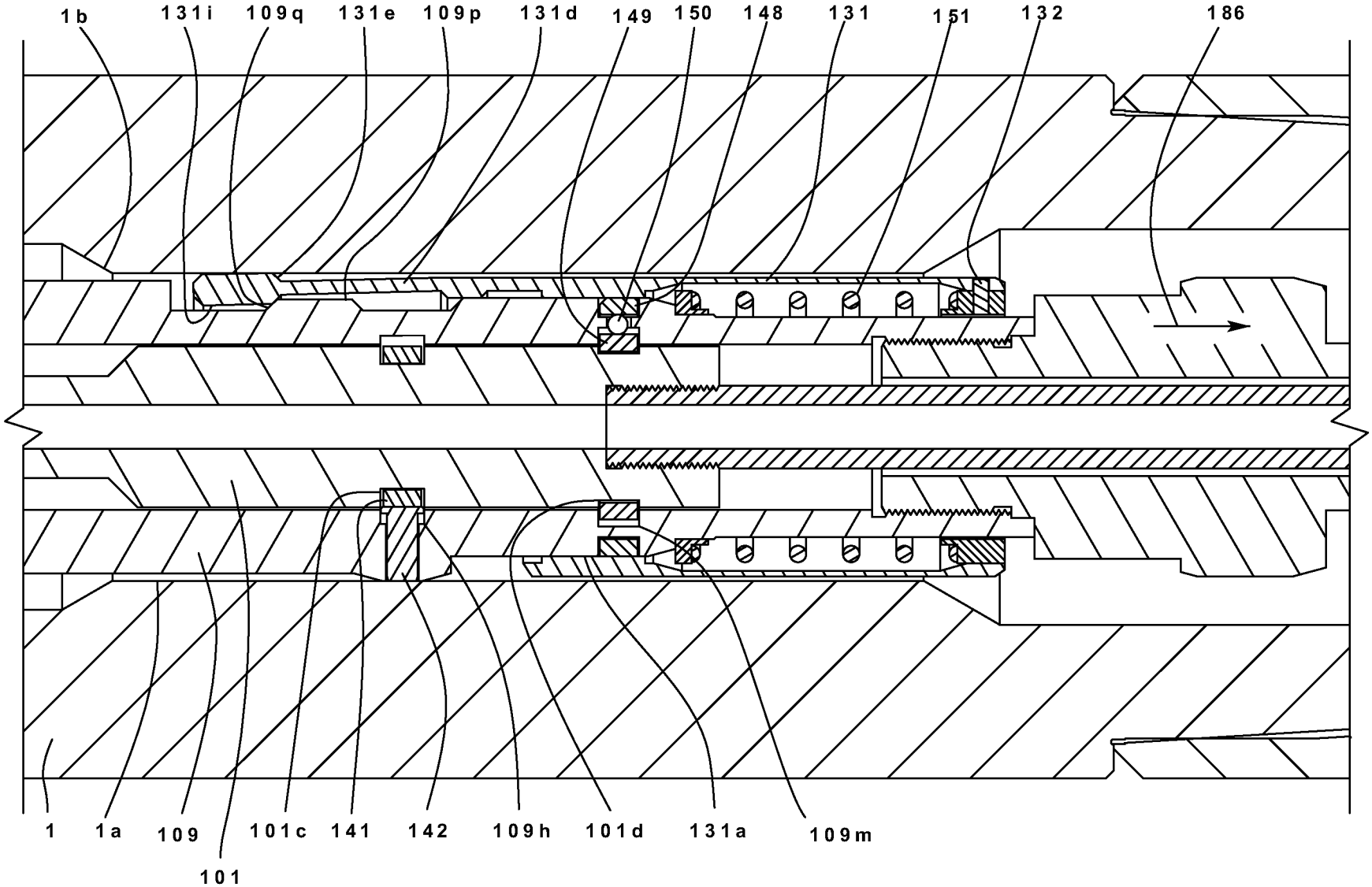
FIG. 47B is a partial section view of the UUT as shown in FIG. 25A and FIG. 5B; as it is lowered within the DSD as shown in FIG. 2B and FIG. 2C.

FIG. 47B shows the portion of the UUT 90 described previously in FIG. 25B, as it is lowered further into the DSD 50 and downwardly displaced from its position illustrated in FIG. 47A, but still within the first of the twelve identical DSD's of this exemplary situation. Arrow 186 indicates the direction of motion of the UUT 90. As UUT 90 is displaced downward from the position in FIG. 47A to the position in FIG. 47B, lower exterior shoulder 131*e* contacts lower shoulder 1*b*, forcibly preventing collet 131 from further travelling downward. As the UUT 90 is lowered further through the drill stem, diameter 109*p* slides under internal surface 131*i* compressing spring 151 until finger 131*d* is no longer supported by diameter 109*p*. Subsequent downward lowering of body 109 further compresses spring 151 and causes finger 131*d* to radially deflect inward, sliding radially down shoulder 109*q* and subsequently move axially downward, sliding along internal diameter 1*a*. Bore sensor 142 is displaced radially inward by lower shoulder 1*b*, displacing "c" ring 141 radially deeper within groove 101*c* and out of engagement with groove 109*h*. Bore 131*a* prevents "c" ring 148 from expanding radially outward, and because of ball 150, "c" ring 149 is prevented from expanding radially outward. "C" ring 149 is within groove 101*d* and groove 109*m*, preventing relative axial movement between mandrel 101 and body 109. Shear pin 132 remains unsevered and spring 151 forcibly urges collet 131 downward.

Figure 47C:
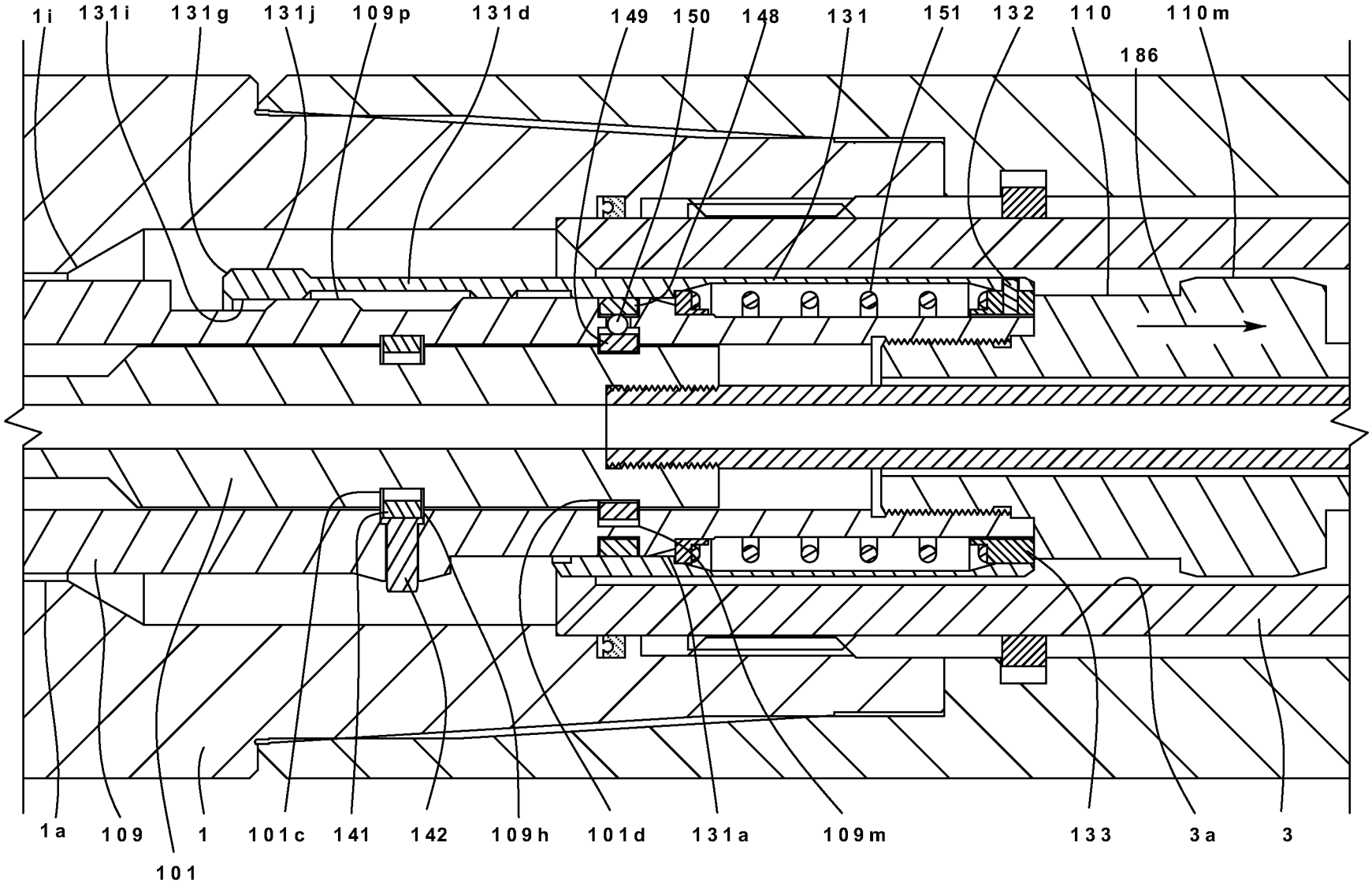
FIG. 47C is a partial section view of the UUT as shown in FIG. 25A and FIG. 5B; as it is lowered further within the DSD as shown in FIG. 2B and FIG. 2C.

FIG. 47C shows continued downward movement of the UUT 90 through the DSD 50. As UUT 90 is displaced downward from the position of FIG. 47B to the position of FIG. 47C, upper external shoulder 131*g* slides axially downward and radially outwards along shoulder 1*i* and external surface 131*j* moves axially out of internal diameter 1*a*. Shear pin 132 is remains unsevered and spring 151 forcibly moves collet 131 downward to a position of lower ring 133, causing collet 131 to contact core 110. Finger 131*d* moves radially outward to a relaxed position with internal surface 131*i* radially adjacent diameter 109*p*. Bore sensor 142 returns to the radial outward position by the outward urging of radially biased "c" ring 141 as "c" ring 141 returns to its initial position within groove 101*c* and groove 109*h*, preventing relative axial movement between mandrel 101 and body 109. Bore 131*a* prevents "c" ring 148 from radially expanding outward, and because of ball 150, "c" ring 149 is prevented from radially expanding outward. "C" ring 149 is disposed within groove 101*d* and groove 109*m*, preventing relative axial movement between mandrel 101 and body 109. The UUT 90 has now returned to the condition as shown in FIG. 47A; however, now in the position shown in FIG. 47C, instead of the outer diameter 110*m* of core 110 being within internal diameter 1*a* of upper body 1, outer diameter 110*m* of core 110 is now within internal diameter 3*a* of blocking sleeve 3 with clearance, existing between the two diameters.

As the UUT 90 is moved further down the drill stem it will repeat the above positioning of components illustrated in FIGS. 47A-47C as it passes through the internal diameter 1*a* of each DSD 50 encountered. The UUT 90 is thus capable of passing downward through any number of DSD's.

In this exemplary situation, after passing the eighth DSD 50, known to the wireline operator by a depth indicator at the surface of the well, the UUT 90 is slowly elevated until upper external shoulder 131*g* of collet 131 contacts shoulder 1*i* of the eighth DSD, known to the wireline operator by a weight indicator at the surface of the well.

After confirming the downhole depth, the UUT 90 is lowered downward at a high enough acceleration to create sufficient velocity for the momentum of the weight bar, jars, running tool and UUT to sever shear pin 152 of FIG. 25B.

Figure 47D:
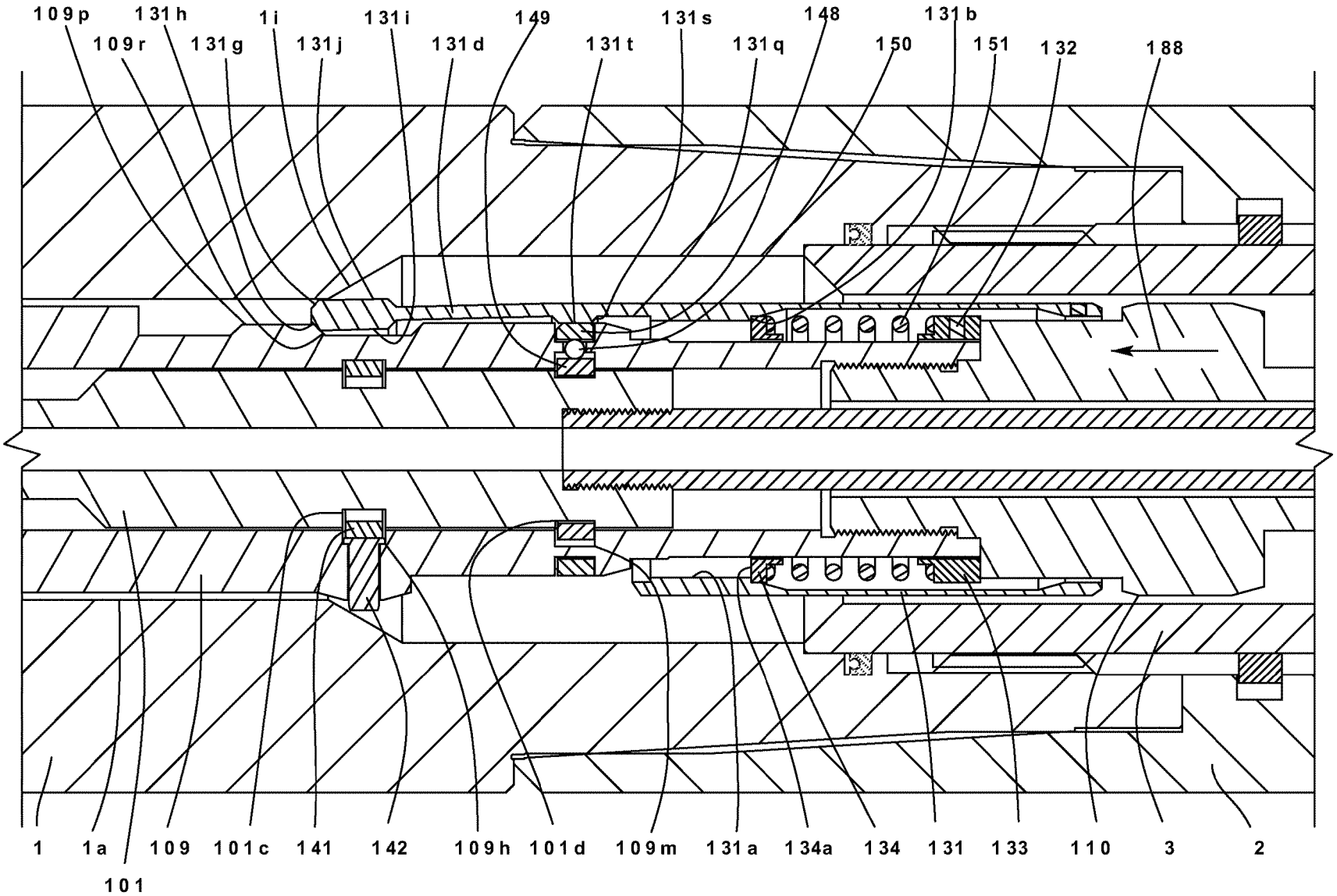
FIG. 47D is a partial section view of the UUT as shown in FIG. 25A and FIG. 25B; as it is lifted within the DSD from below as shown in FIG. 2B and FIG. 2C.

FIG. 47D shows the portion of the UUT 90 previously described in FIG. 25B, as it is raised upward through, but still within, the eighth of twelve identical DSD's in this exemplary situation. Arrow 188 indicates the direction of the upward motion of UUT 90. As UUT 90 is displaced from the position of FIG. 47C to the position of FIG. 47D, external surface 131*j* passes through blocking sleeve 3 with a clearance between the two surfaces, and upper external shoulder 131*g* contacts shoulder 1*i*, forcibly preventing collet 131 from any further upward movement. Initially, momentum of UUT 90 carries core 110 upward, which in turn forcibly compels lower ring 133 upward, severing shear pin 132 placing collet 131 from an unarmed position into an armed positon. Further, the lower end of spring 151 no longer pushes collet 131 downward, as shear pin 132 is now severed and lower ring 133 is no longer connected to collet 131. Spring 151 now acts to radially expand collet 131 as end surface 134*a* of upper ring 134 contacts shoulder 131*b*. Body 109 then begins moving upward within collet 131, with diameter 109*p* moving upward and sliding under internal surface 131*i* of collet 131. Core 110 moves upward and forcibly compels lower ring 133 to compress spring 151.

As body 109 moves upward in relation to collet 131, "c" ring 148 slides axially upward and along bore 131*a* and radially outwards into groove 131*q*, with ball 150 and "c" ring 149 moving radially outward disengaging "c" ring 149 from groove 101*d* in mandrel 101. However, because bore sensor 142 remains disposed radially outward due to the force acting on it from outwardly biased "c" ring 141 which resides in groove 109*h* and groove 101*c*, axial motion remains inhibited between mandrel 101 and body 109. Core 110 continues to move upward, forcibly compelling lower ring 133 to further compress spring 151.

Continued motion of body 109 causes bevel 131*s* of collet 131 to deflect "c" ring 148 radially inward, until "c" ring 148 enters a bore 131*t*. As "c" ring 148 deflects radially inward, ball 150 forcibly compels "c" ring 149 radially inward such that it is disposed within groove 101*d* and groove 109*m*, thereby preventing further axial motion between mandrel 101 and body 109. Core 110, as it travels upward, forcibly compels lower ring 133 to further compress spring 151.

Continued upward movement of body 109 further compresses spring 151, as diameter 109*p* continues to slide upward and along internal surface 131*i* until upper internal shoulder 131*h* slides downward along shoulder 109*r* and deflects finger 131*d* radially inward, resulting with external surface 131*j* sliding into internal diameter 1*a*. Once external surface 131*j* of collet 131 slides upward into internal diameter 1*a*, lower ring 133, forcibly acted upon by core 110, does not compress spring 151 any further.

Figure 47E:
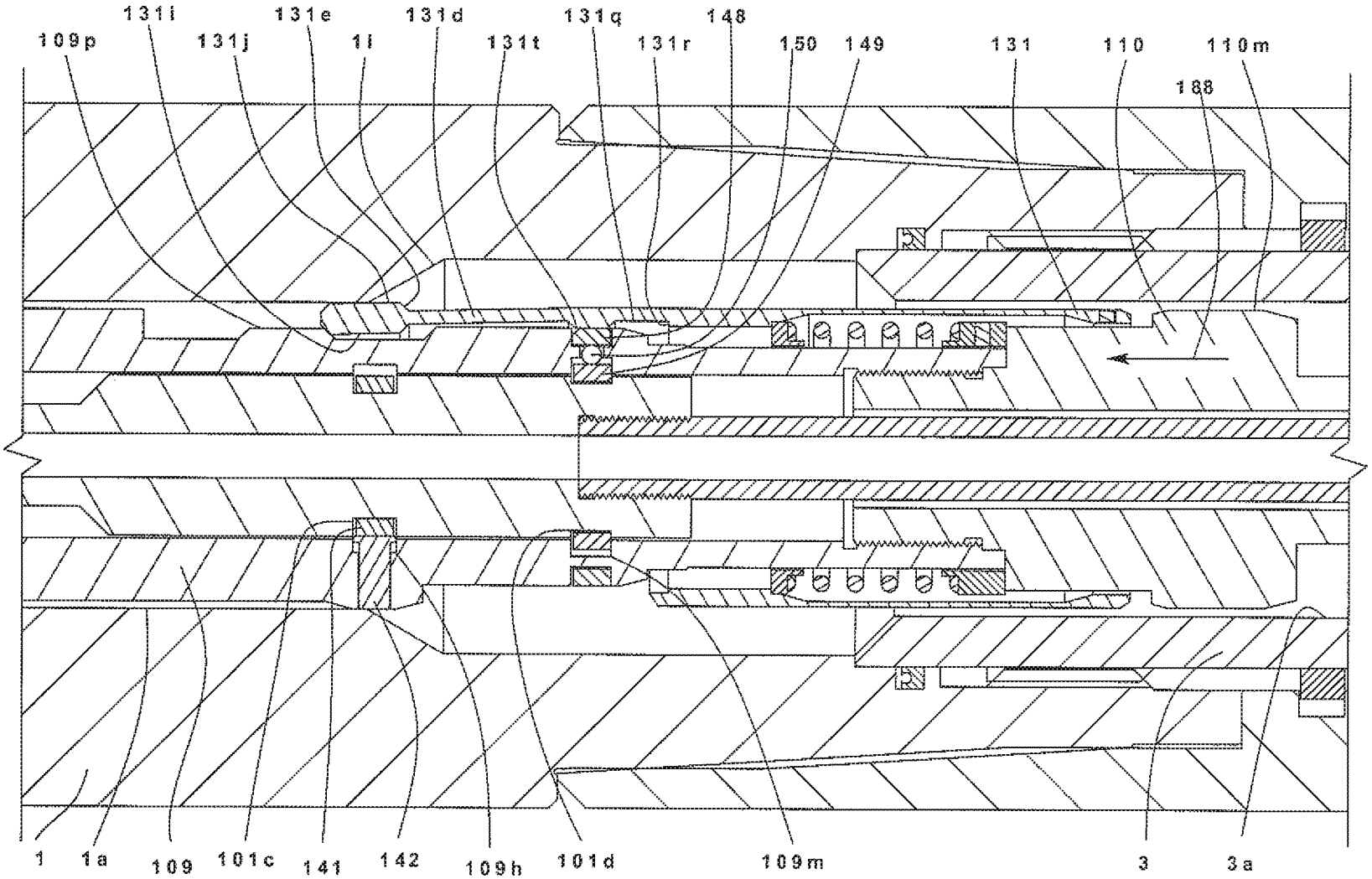
FIG. 47E is a partial section view of the UUT as shown in FIG. 25A and FIG. 25B; as it is lifted further within the DSD from below as shown in FIG. 2B and FIG. 2C.

FIG. 47E shows the position of UUT 90 as it is displaced upward from the position shown in FIG. 47D, while still within the eighth of twelve identical DSD's in this exemplary situation. Arrow 188 indicates the direction of motion of the UUT 90. In this position, outer diameter 110*m* of core 110 is disposed within internal diameter 3*a* of blocking sleeve 3. Bore sensor 142, having been displaced further upward, has entered internal diameter 1*a* and is now displaced radially inward by shoulder 1*i*, in turn displacing "c" ring 141 radially inward, deeper within groove 101*c* and out of engagement with groove 109*h*; however, "c" ring 149 is disposed within groove 101*d* and 109*m*, preventing relative axial motion between mandrel 101 and body 109. Spring 151 now urges collet 131 upward. Continued upward motion of UUT 90 axially displaces external surface 131*j* of collet 131 upward, within internal diameter 1*a*. Body 109 and mandrel 101 may be further displaced upward with external surface 131*j* moving axially within internal diameter 1*a*.

Figure 47F:
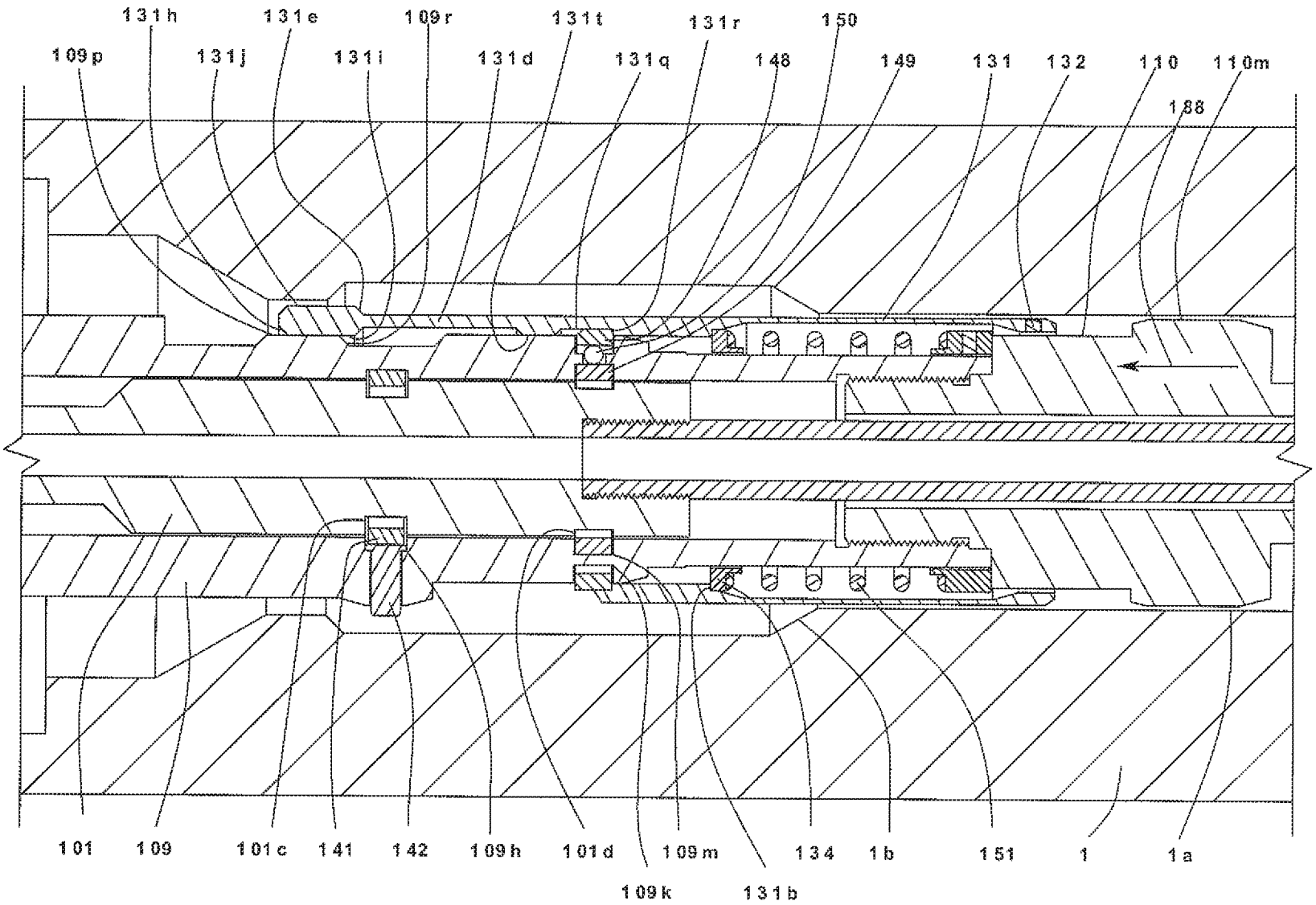
FIG. 47F is a partial section view of the UUT as shown in FIG. 25A and FIG. 25B; as it is lifted even further within the DSD from below as shown in FIG. 2A and FIG. 2B.

FIG. 47F shows a portion of UUT 90 as it is displaced upward, above the eighth of the twelve identical DSD's in this exemplary situation. Arrow 188 indicates motion of the UUT in either direction. Bore sensor 142, upon exiting internal diameter 1*a* due to its upward displacement, is radially displaced outward by "c" ring 141, disposing it within groove 101*c* and 109*h*, preventing relative axial movement between mandrel 101 and body 109. During the transition from the position of FIG. 47E to the position of FIG. 47F, external surface 131*j* of collet 131 is displaced upward through internal diameter 1*a*, and bore sensor 142 exits internal diameter 1*a* before external surface 131*j* because while external surface 131*j* is in sliding contact with internal diameter 1*a*, bore sensor 142 is disposed above the lowermost edge of external surface 131*j*, where external surface 131*j* meets lower external shoulder 131*e*. Thus, as bore sensor 142 displaces radially outward, "c" ring 141 engages groove 101*c* and groove 109*h* before external surface 131*j* of collet 131 axially exits internal diameter 1*a*, preventing relative axial motion between mandrel 101 and body 109.

As collet 131 is displaced upward to exit internal diameter 1*a*, lower external shoulder 131*e* slides axially along lower shoulder 1*b*, allowing finger 131*d* to displace radially outward as upper internal shoulder 131*h* is displaced radially outwardly as it slides along shoulder 109*r* until internal surface 131*i* slides axially along diameter 109*p*. As collet 131 moves upward relative to body 109, bore 131*t* slides upward in relation to "c" ring 148, allowing "c" ring 148 to radially expand into groove 131*q* and ultimately engage shoulder 131*r* of collet 131. "C" ring 149 radially expands out of groove 101*d* as ball 150 follows the radial expansion of "c" ring 148. However, because bore sensor 142 remains radially outward from the urging of radially biased "c" ring 141, which is disposed in groove 109*h* and groove 101*c*, relative axial motion is prevented between mandrel 101 and body 109.

As situated in FIG. 47F, outer diameter 110*m* of core 110 is disposed within internal diameter 1*a* of upper body 1. Spring 151 forcibly compels upper ring 134 axially against shoulder 131*b*, axially displacing collet 131 upward such that shoulder 131*r* engages "c" ring 148 within groove 109*k*. Finger 131*d* is disposed in the relaxed position with internal surface 131*i* supported on diameter 109*p*. "C" ring 141 is disposed radially within both groove 101*c* and in groove 109*h*, preventing relative axial movement between mandrel 101 and body 109. Bore sensor 142 is disposed in a radially outward position. Shear pin 132 is severed and spring 151 now urges collet 131 upward.

If UUT 90 is displaced axially upward through another DSD in the drill stem, collet 131 will frictionally engage internal diameter 1*a* while body 109 continues to travel upward, allowing finger 131*d* of collet 131 to radially collapse along shoulder 109*r* and pass through internal diameter 1*a* of the DS, at which time finger 131*d* may radially expand again to engage diameter 109*p* and return to the condition of FIG. 47F. In this manner, the UUT may be raised and removed from the well, passing thru any number of DSDs in the drill stem.

Figure 47G:
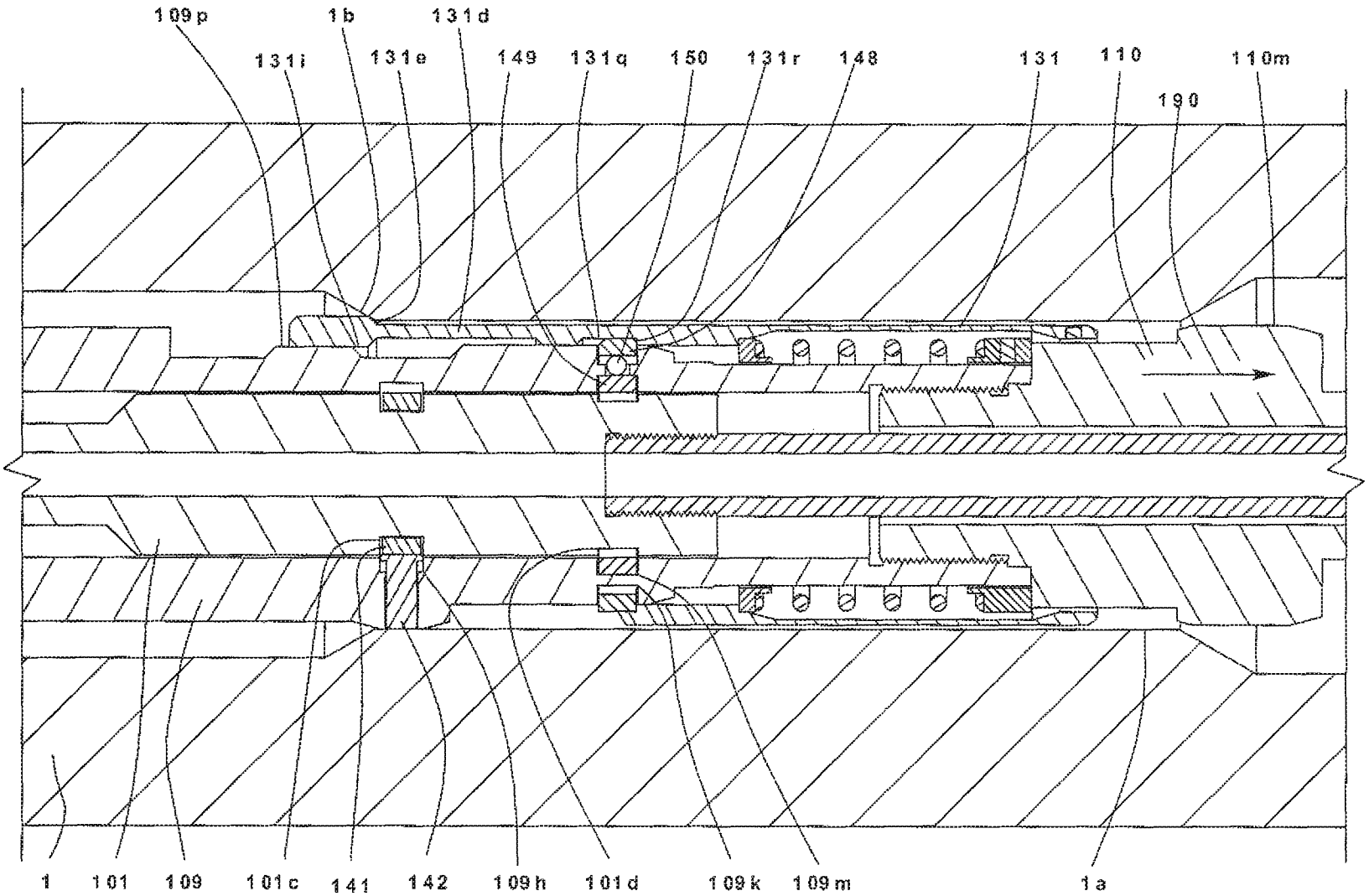
FIG. 47G is a partial section view of the UUT as shown in FIG. 25A and FIG. 25B; after landing in the DSD as shown in FIG. 2A and FIG. 2B.

FIG. 47G shows a portion of the UUT 90 as it is axially displaced downward into the eighth of the twelve identical DSD's in the hypothetical drill stem of this exemplary situation. Arrow 190 indicates axial motion of UUT 90. Finger 131*d* is disposed in the relaxed position with internal surface 131*i* supported on diameter 109*p*. Lower external shoulder 131*e* of collet 131 engages lower shoulder 1*b* and axial downward movement of the body 109 is prevented by the engagement of "c" ring 148, which is radially disposed within both groove 109*k* and shoulder 131*r*. While "c" ring 149 is radially disposed outside of groove 101*d*, Bore sensor 142 is radially disposed within internal diameter 1*a* and has radially displaced "c" ring 141 outwards so that it is no longer disposed within groove 109*h*; thus, for the first time in the sequence of movements of UUT 90 of this exemplary situation, relative axial movement between mandrel 101 and body 109 is possible.

As described in the exemplary situation above, an embodiment of UUT 90 may be selectively landed in any one of multiple DSD's and be retrieved from the well at any time. In the following description, the functioning of an embodiment of the UUT to unlock and unblock a DSD will be explained. The following actions performed by an embodiment of the UUT are initiated by relative axial movement of fishing neck 100 with respect to body 109.

FIGS. 48A-48E, 49A-49E, 50A-50E, 51A-51E, 52A-52E, 53A-53E and 54A-54E are sectional views showing progressive operation of the components of the embodiment of UUT 90 shown in FIGS. 25A-25H and 26-46 and the embodiment of DSD 50 shown in FIGS. 1, 2A-2F, 3-8, 22 and 22A-22D.

Hydrostatically pressurized fluid 184 is located within fluid passage 183, completely surrounding UUT 90, within the drill stem connected axially upward of body 1, within DSD 50, and in the stuck drill stem connected axially downward of lower body 2.

Referring to FIGS. 25A-25H and 26-46, as previously described, fishing neck 100 (FIG. 25A) is connected to mandrel 101, upper control tube 103 (FIG. 25C), intermediate control tube 105 (FIG. 25F) and lower control tube 107 (FIG. 25G). Also, body 109 (FIG. 25A) is connected to core 110 (FIG. 25B), upper core extension 112 (FIG. 25F), core adapter 113, intermediate core extension 115 (FIG. 25G), lower core adapter 117 and lower core extension 119 (FIG. 2511). Grapple 121 (FIG. 25C) is connected to upper barrel 122 (FIG. 25E), connector 124, intermediate connector 127 (FIG. 25F), intermediate barrel 125 (FIG. 25G), lower connector 130 (FIG. 2511) and protector 128.

Figure 48A:
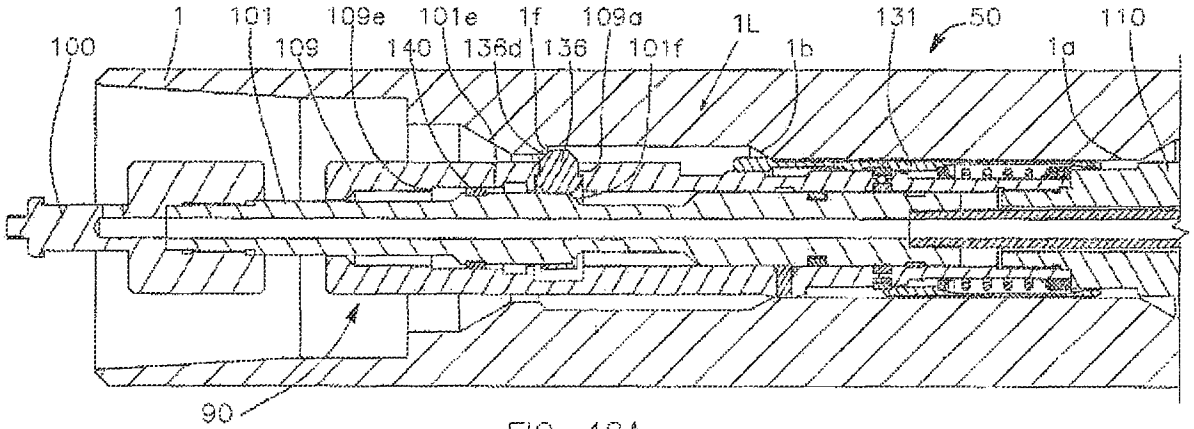
FIG. 48A is a section view of the upper most end of the UUT landed in the DSD.
Figure 49A:
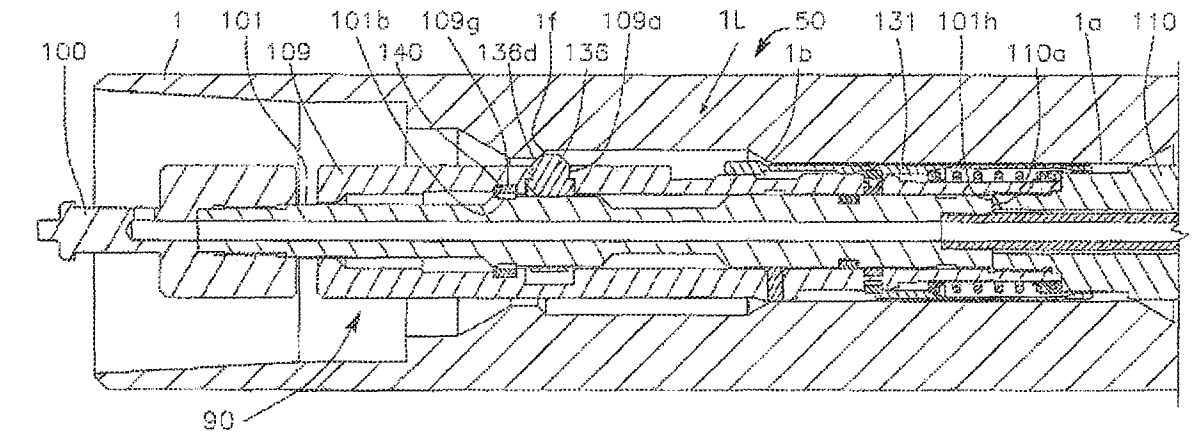
FIG. 49A is a section view of the upper most end of the UUT landed in the DSD.
Figure 48B:
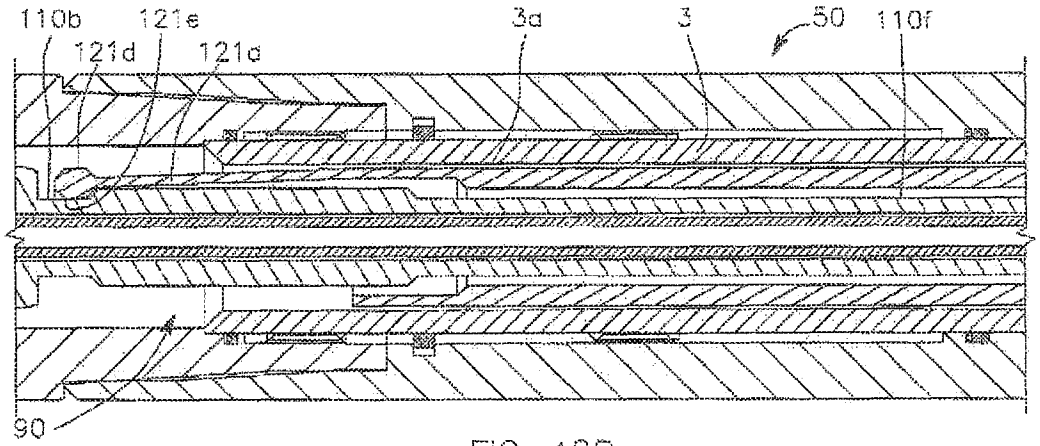
FIG. 48B is an intermediate section view of the UUT landed in the DSD.
Figure 49B:
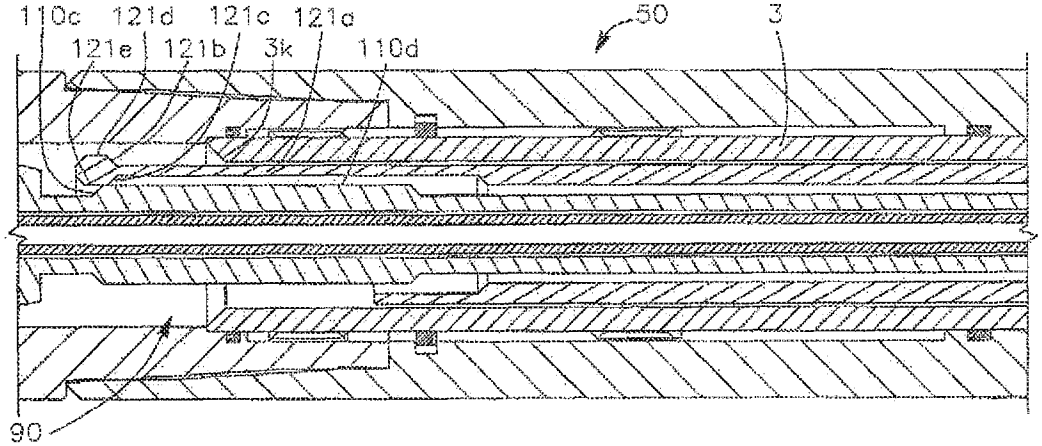
FIG. 49B is an intermediate section view of the UUT locked in the DSD.
Figure 48C:
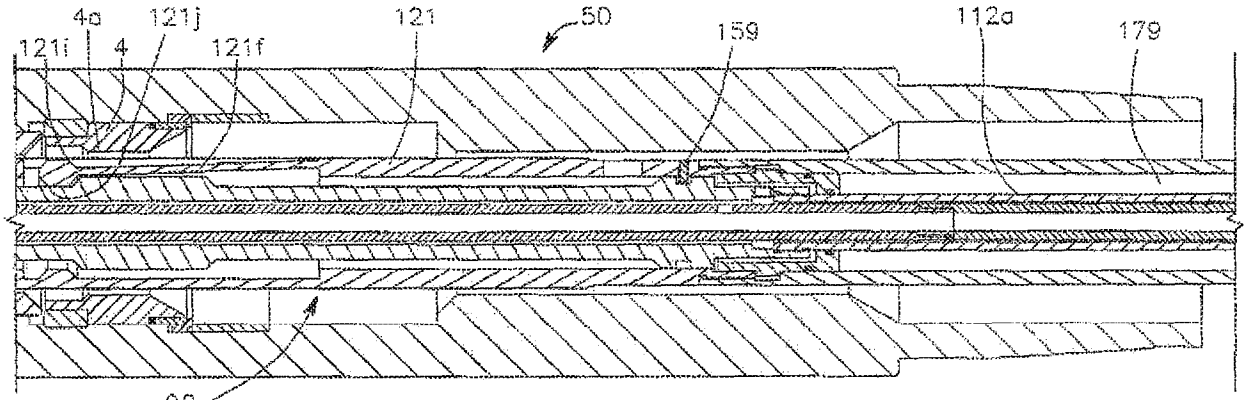
FIG. 48C is an intermediate section view of the UUT landed in the DSD.
Figure 49C:
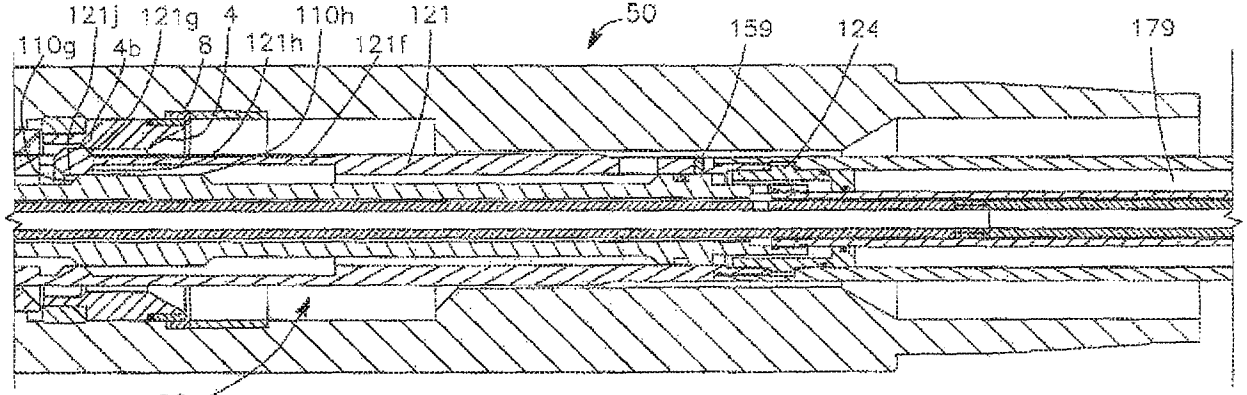
FIG. 49C is an intermediate section view of the UUT locked in the DSD.

Referring to FIGS. 48A-48E, collet 131 has landed on and engaged shoulder 1*b*, preventing axial downward movement of body 109, as shown in FIG. 48A. Body 109 is connected to grapple 121, by shear screw 159 (FIG. 48C).

Figure 48D:
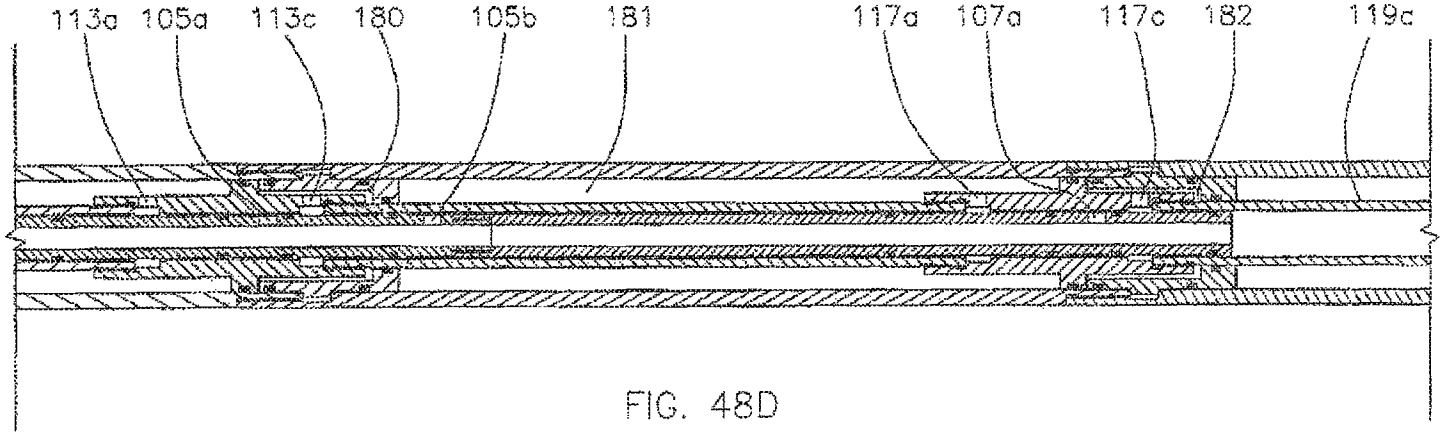
FIG. 48D is an intermediate section view of the UUT landed in the DSD.
Figure 48E:
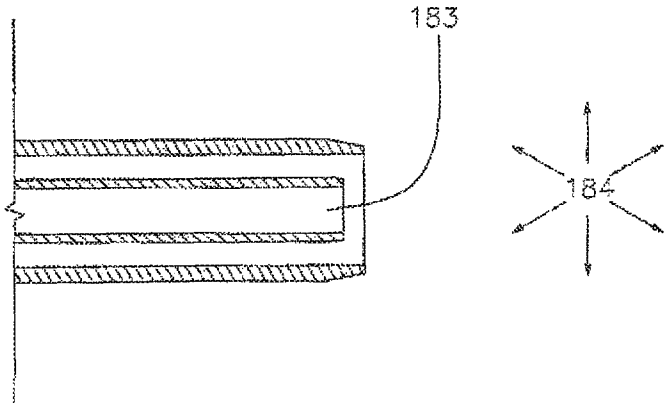
FIG. 48E is a section view of the lower most end of UUT landed in the DSD.

The weight of the wireline tools has resulted in the axial movement of fishing neck 100 (FIG. 48A) downward such that "c" ring 140 is no longer engaging shoulder 109*e* of body 109. Shoulder 101*f* of mandrel 101 has moved axially downward within landing profile 1L of upper body 1 and is now disposed radially inwards of radially outwards displaced key 136. Diameter 101*e* radially engages key 136 within window 109*a* of body 109 with shoulder 136*d* in proximity of shoulder 1*f*. Body 109 is axially anchored within landing profile 1L of upper body 1, as are all parts connected to it, including, through shear screw 159, grapple 121 (FIG. 48C) and all parts connected to it. Although fishing neck 100 has been axially displaced in relation to body 109, flow passages 113*a*, 113*c*, 105*a*, 105*b*, 117*a*, 117*c* and 107*a* are all blocked, as shown in FIG. 48D. Chambers 179 (FIG. 48C), 180, 181 and 182 (FIG. 48D) may be preassembled and thus contain air at or near atmospheric pressure. Seal surface 112*a* (FIG. 49C) and seal surface 119*a* (FIG. 49D) may be structurally similar. Thus, high hydrostatically pressurized fluid 184 surrounding DSD 50 and within passage 183, as is present deep within a fluid filled well, will not result in the application of forces or relative motion between grapple 121 and core 110 that would sever shear screw 159.

All components of the embodiment of DSD 50 are as shown in FIGS. 1, 2A-2F, 3-8, 22 and 22A-22D. Referring to FIGS. 48A-48E, diameter 110*b* of core 110 (FIG. 48B) is disposed radially adjacent of internal surface 121*e* of upper finger 121*a*. External surface 121*d* of upper finger 121*a* is displaced axially downward from internal diameter 1*a* of upper body 1, where internal diameter 1*a* is smaller than internal diameter 3*a* of blocking sleeve 3, which in turn is smaller than internal diameter 4*a* of lock sleeve 4. Diameter 110*f* of core 110 is disposed radially adjacent of internal surface 121*j* of lower finger 121*f*. External surface 121*i* of lower finger 121*f* is displaced downward from internal diameter 1*a*.

Figure 49D:
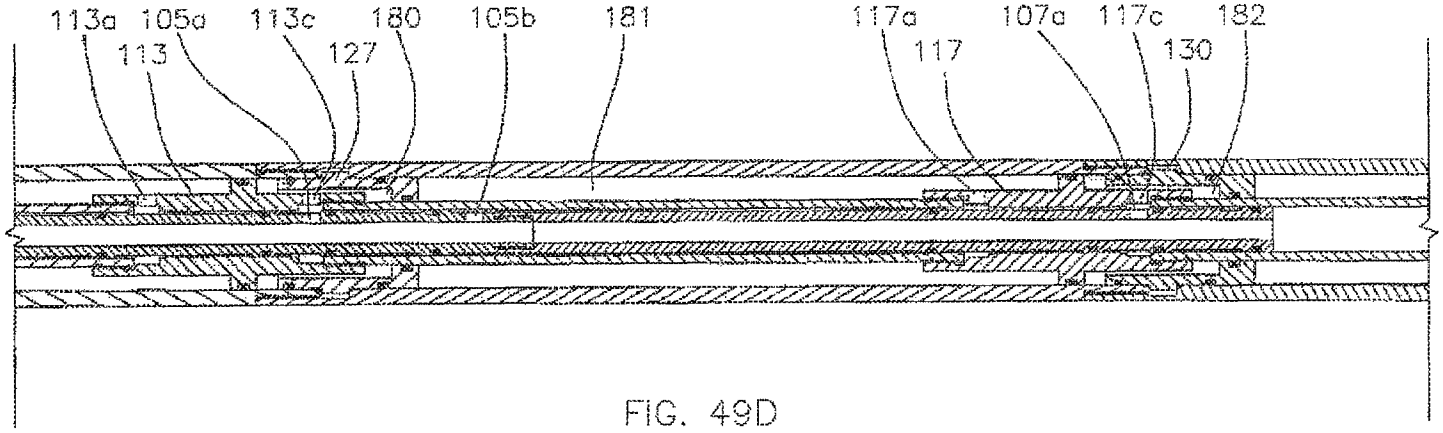
FIG. 49D is an intermediate section view of the UUT locked in the DSD.
Figure 49E:
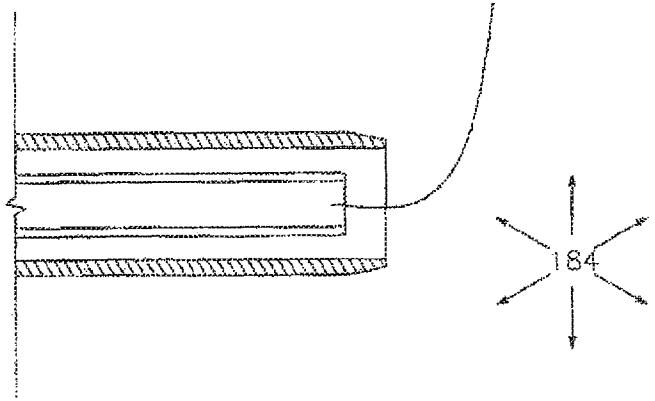
FIG. 49E is a section view of the lower most end of UUT locked in the DSD.
Figure 51A:
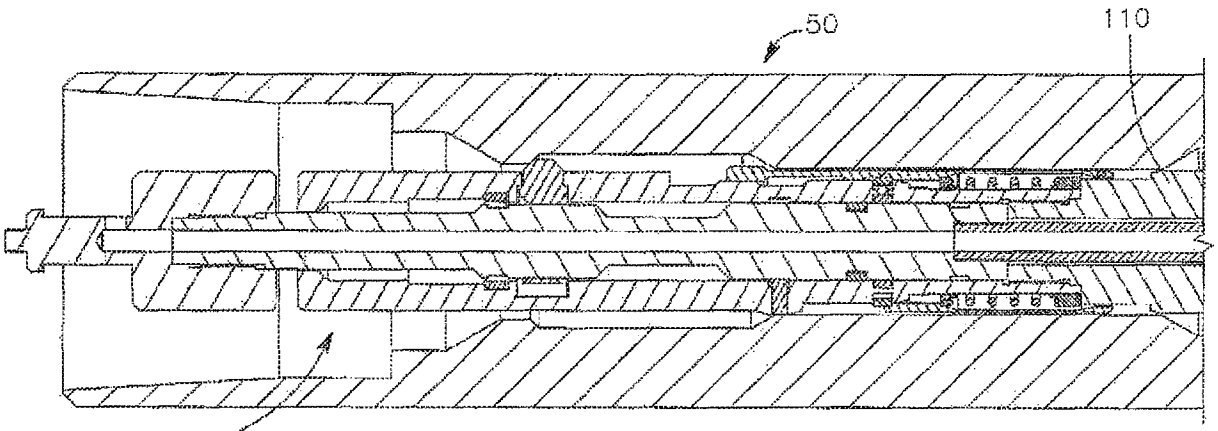
FIG. 51A is a section view of the upper most end of the UUT, the locking sleeve released and the blocking sleeve further moved.
Figure 51B:
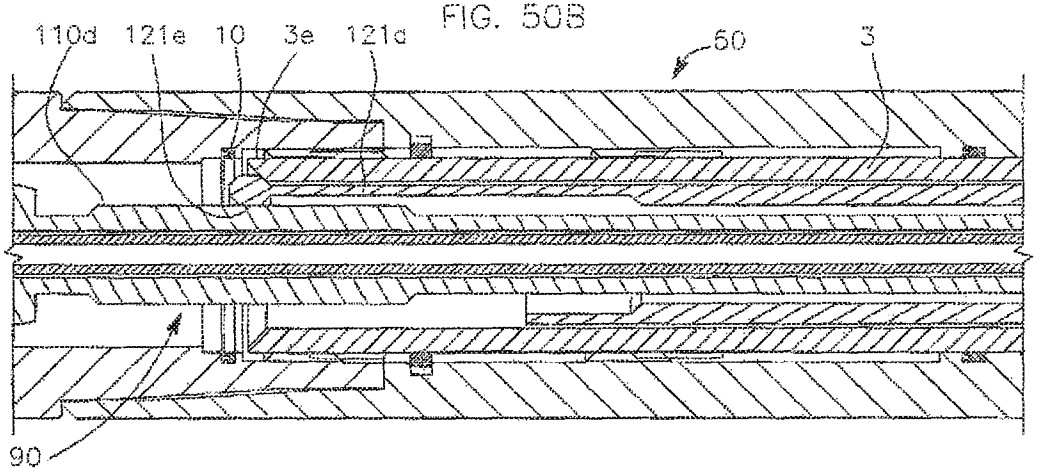
FIG. 51B is an intermediate section view of the UUT, the locking sleeve released and the blocking sleeve further moved.

Referring to FIGS. 49A-49E, the weight of the wireline tools results in the downward axial displacement of fishing neck 100 (FIG. 49A) until end surface 101*h* of mandrel 101 engages end surface 110*a* of core 110. Due to this axial displacement, "c" ring 140 has radially expanded within groove 109*g* of body 109 and is no longer radially disposed within groove 101*b* of mandrel 101. Flow passages 113*a*, 105*b* and 117*a* (FIG. 49D) remain blocked. Thus, chambers 179 (FIG. 49C) and 181 (FIG. 49D) continue to contain air at or near atmospheric pressure. However, passages 113*c*, 105*a*, 117*c* and 107*a* are now in fluid communication with hydrostatically pressurized fluid 184 via passage 183 (FIG. 49E). Chamber 180 and chamber 182 now begin to rapidly fill with hydrostatically pressurized fluid 184. As chamber 180 fills with pressurized fluid 184, chamber 180 applies an axial downward force on intermediate connector 127 (FIG. 49D) and an axial upward force on core adapter 113. As chamber 182 fills with pressurized fluid 184, chamber 182 applies an axial downward force on lower connector 130, effectively removing the axial upward force of lower connector 130 acting to balance the axial downward force of core adapter 124; chamber 182 also applies an axial upward force on lower core adapter 117. As explained above, filling chamber 180 and chamber 182 with pressurized fluid 184 forcibly compels grapple 121 axially downward and, with equal and opposite magnitude, forcibly compels body 109 axially upward.

Further, the compulsion of grapple 121 downward and body 109 upward results in shear screw 159 being severed, grapple 121 and connected parts being displaced axially downward, and lower finger 121*f* expanding radially outward as internal shoulder 121*h* traverses shoulder 110*g* of core 110. Internal surface 121*j* is radially supported by diameter 110*h* and shoulder 121*g* engages shoulder 4*b* of lock sleeve 4. Grapple 121 is temporarily prevented from further axial displacement as retaining ring 8 is not yet severed. As internal shoulder 121*c* (FIG. 49B) of upper finger 121*a* traverses shoulder 110*c* of core 110, internal surface 121*e* is radially supported by diameter 110*d*; thus, external surface 121*d* is radially expanded outward and exterior shoulder 121*b* is radially positioned to contact upper shoulder 3*k* of blocking sleeve 3, but spaced axially away for later engagement. This axial spacing assures that the forces generated within UUT 90 are not diminished by friction about the blocking sleeve 3 and are retained for severing retaining ring 8.

The equal and opposite forces generated as pressure rapidly builds within chamber 180 and chamber 182 displaces body 109 axially upward until window 109*a* engages key 136, and shoulder 136*d* engages upper shoulder 1*f* of landing profile 1L within upper body 1. Body 109 is prevented from further upward axial displacement by key 136 and shoulder 1*f* of upper body 1. Collet 131 does not contact shoulder 1*b*. Downward axial displacement of grapple 121 is briefly restrained by retainer 8 while pressure rapidly builds within chamber 180 and 182.

Figure 50A:
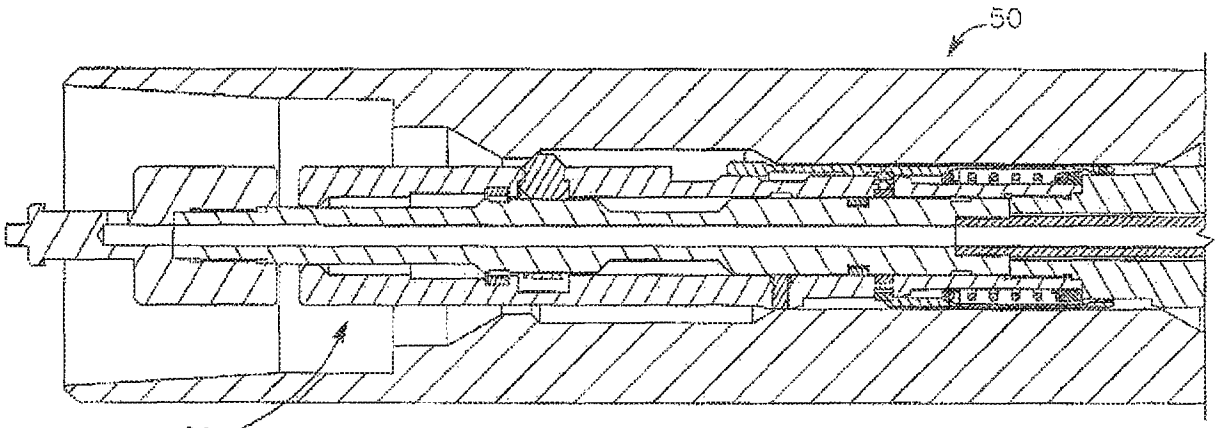
FIG. 50A is a section view of the upper most end of the UUT activated, the DSD unlocked and unblocking initiated.
Figure 50B:
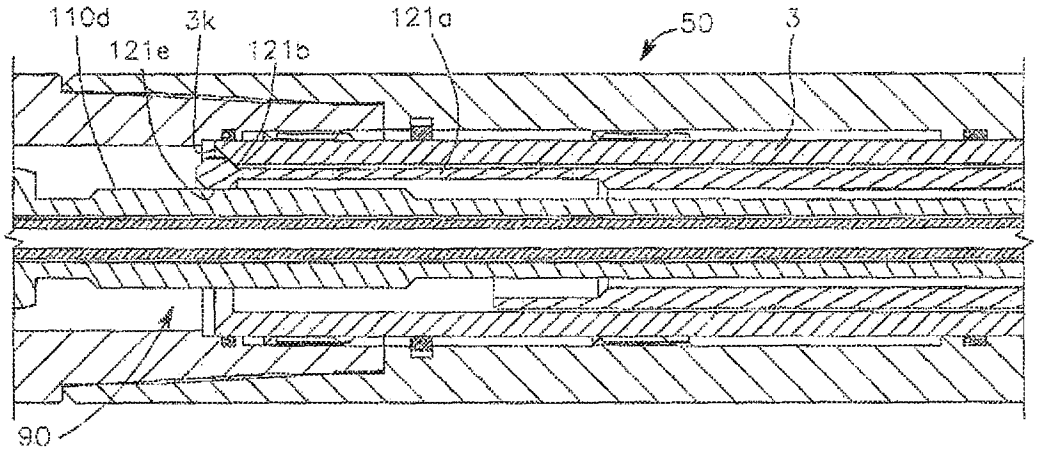
FIG. 50B is an intermediate section view of the UUT activated, the DSD unlocked and unblocking initiated.
Figure 50C:
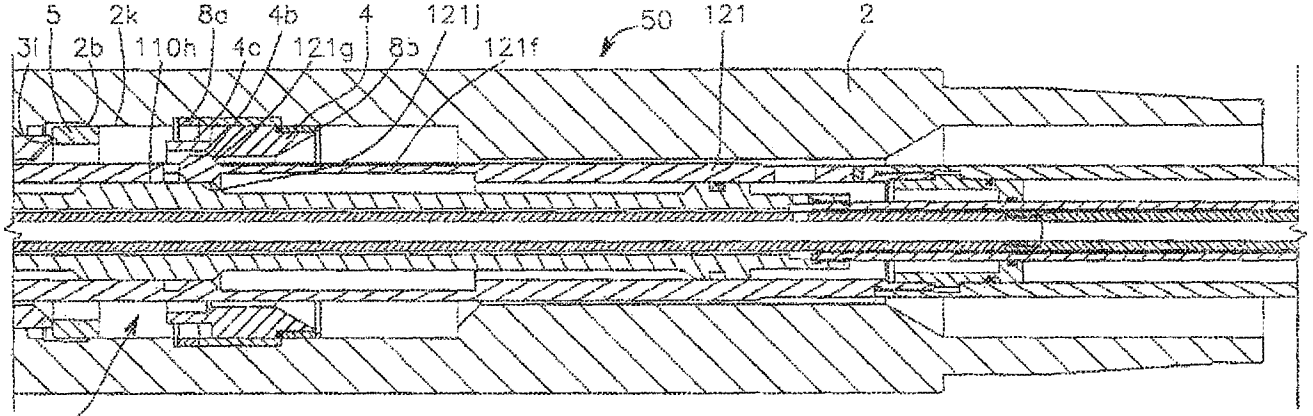
FIG. 50C is an intermediate section view of the UUT activated, the DSD unlocked and unblocking initiated.
Figure 51C:
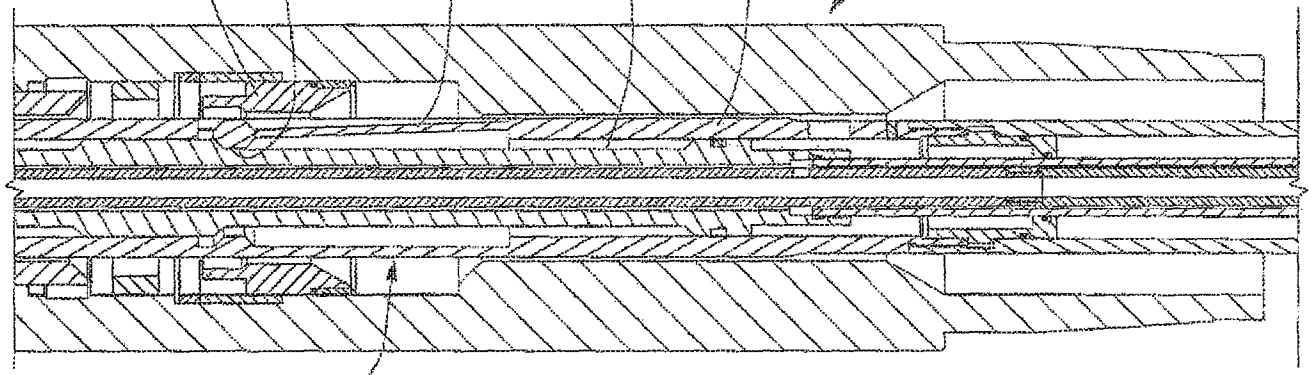
FIG. 51C is an intermediate section view of the UUT, the locking sleeve released and the blocking sleeve further moved.
Figure 50D:
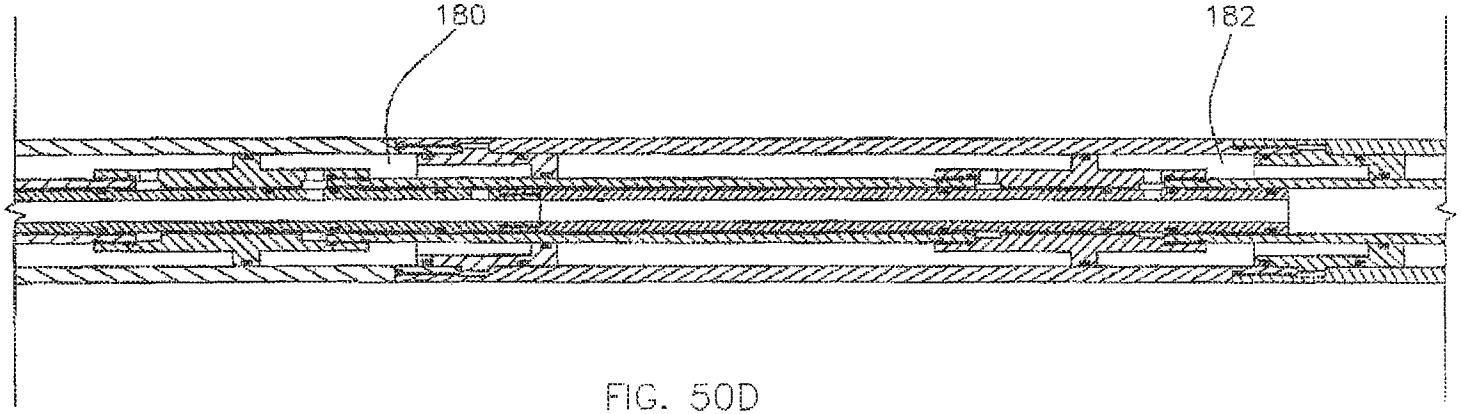
FIG. 50D is an intermediate section view of the UUT activated, the DSD unlocked and unblocking initiated.
Figure 51D:
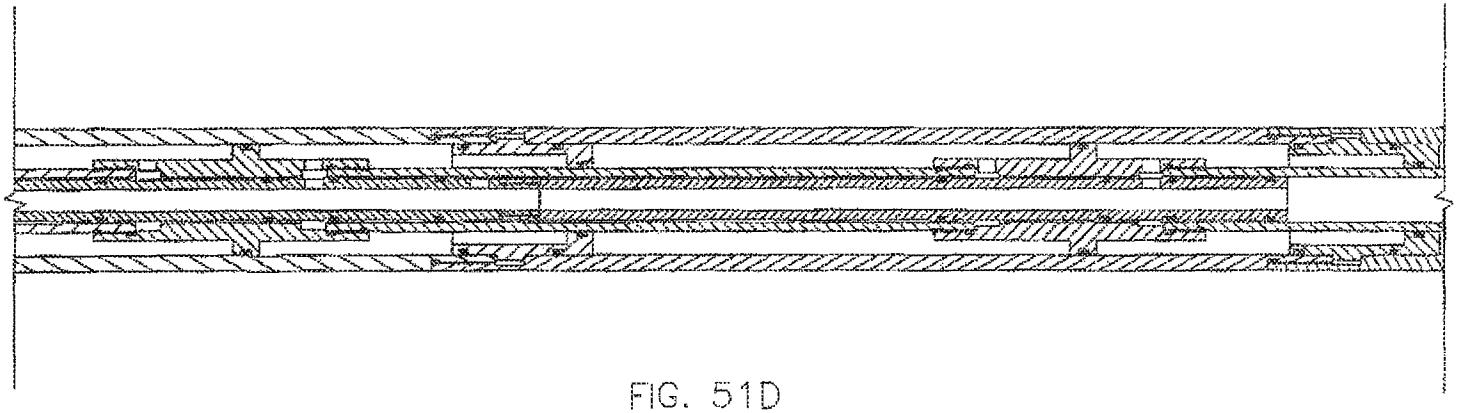
FIG. 51D is an intermediate section view of the UUT, the locking sleeve released and the blocking sleeve further moved.
Figure 50E:
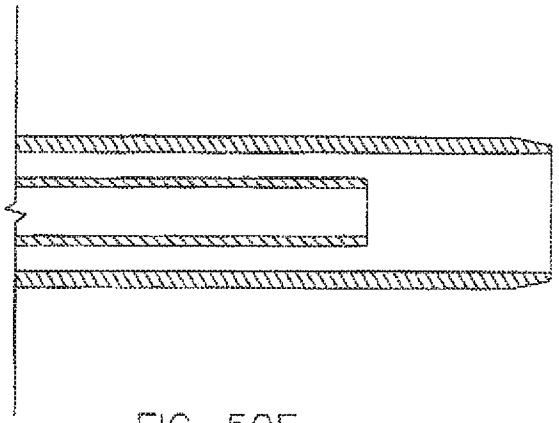
FIG. 50E is a section view of the lower most end of UUT activated, the DSD unlocked and unblocking initiated.
Figure 51E:
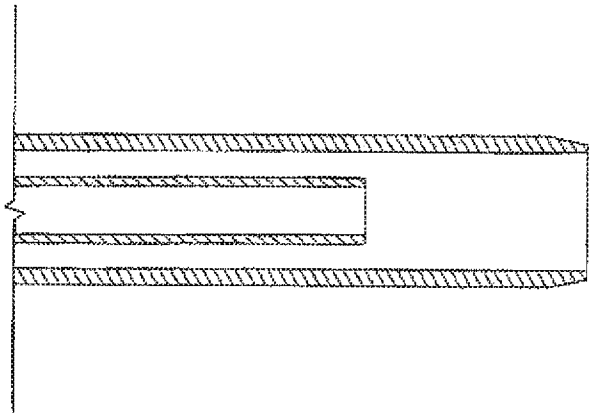
FIG. 51E is a section view of the lower most end of UUT, the locking sleeve released and the blocking sleeve further moved.
Figure 52A:
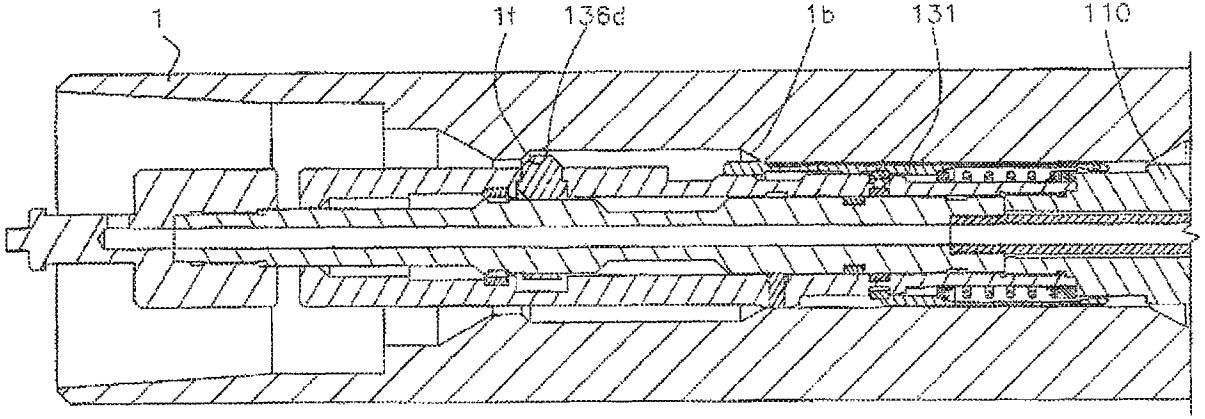
FIG. 52A is a section view of the upper most end of the UUT, the blocking sleeve fully moved and released.
Figure 53A:
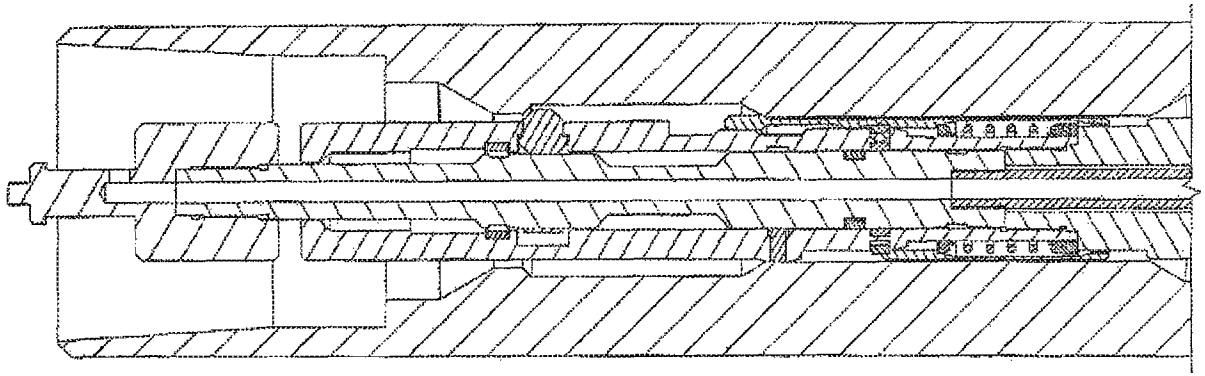
FIG. 53A is a section view of the upper most end of the UUT, the blocking sleeve released, the tool extended and pressures equalized.
Figure 52B:
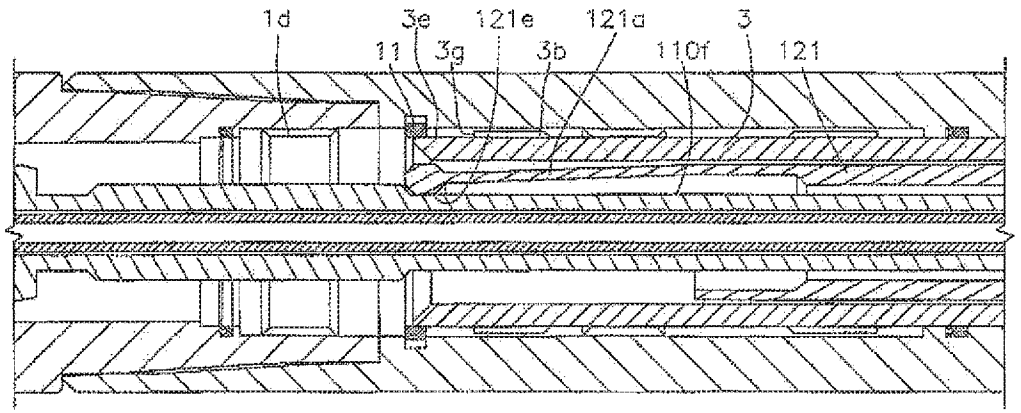
FIG. 52B is an intermediate section view of the UUT, the blocking sleeve fully moved and released.
Figure 53B:
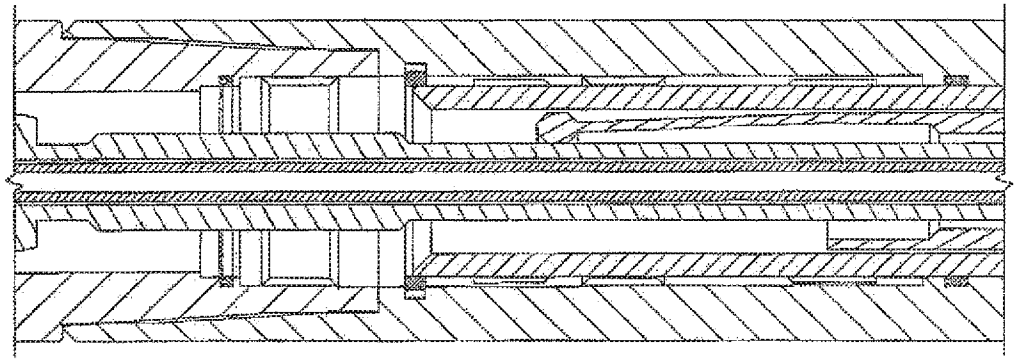
FIG. 53B is an intermediate section view of the UUT, the blocking sleeve released, the tool extended and pressures equalized.
Figure 52C:
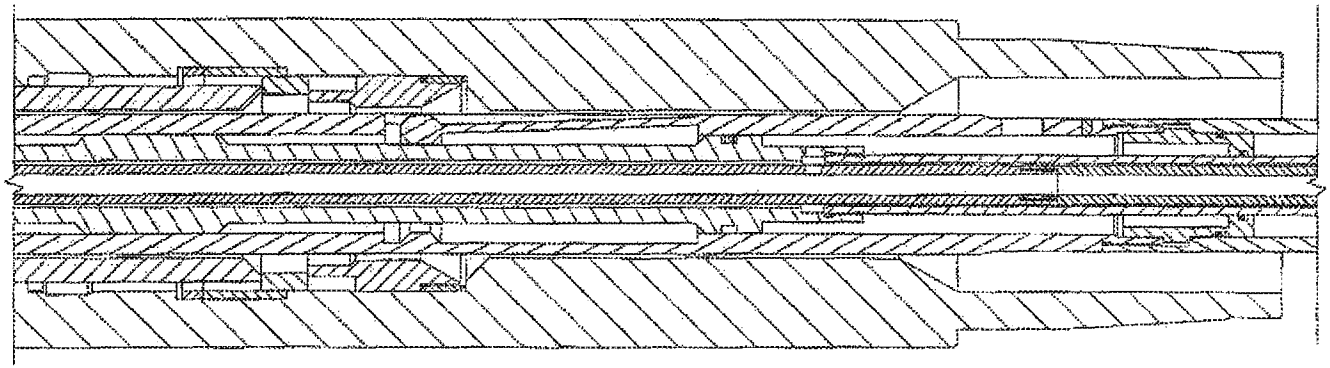
FIG. 52C is an intermediate section view of the UUT, the blocking sleeve fully moved and released.
Figure 53C:
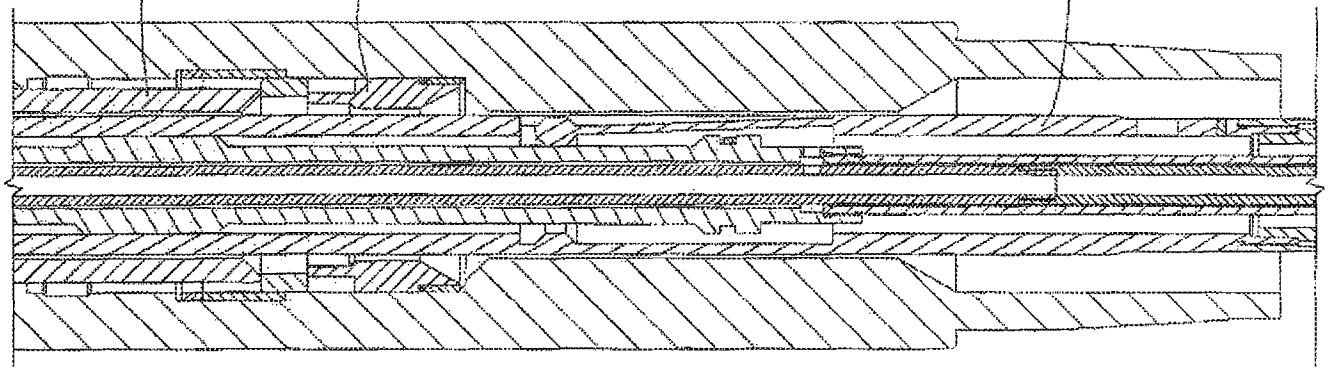
FIG. 53C is an intermediate section view of the UUT, the blocking sleeve released, the tool extended and pressures equalized.
Figure 52D:
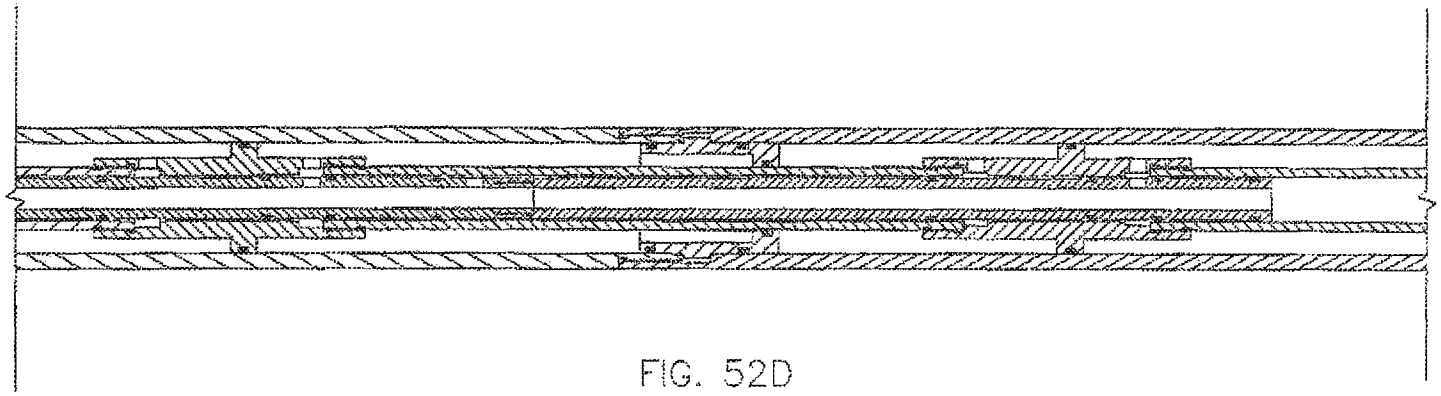
FIG. 52D is an intermediate section view of the UUT, the blocking sleeve fully moved and released.
Figure 53D:
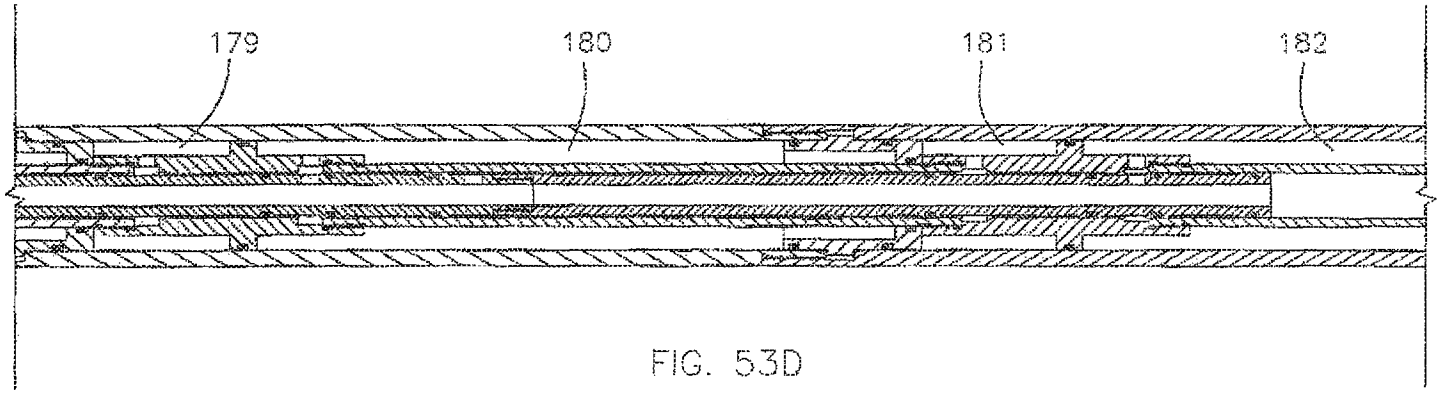
FIG. 53D is an intermediate section view of the UUT, the blocking sleeve released, the tool extended and pressures equalized.
Figure 52E:
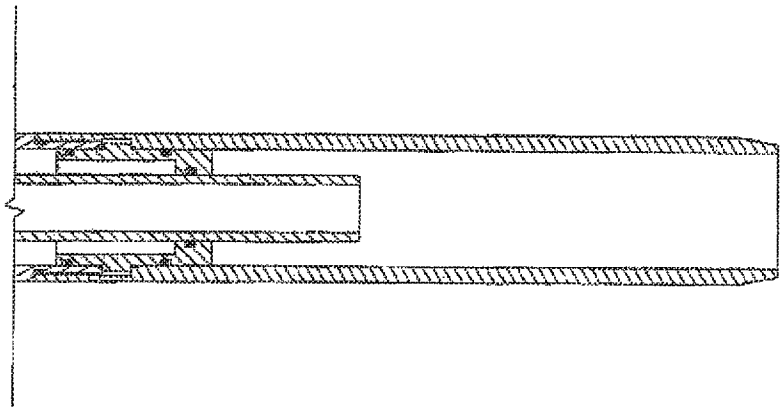
FIG. 52E is a section view of the lower most end of UUT, the blocking sleeve fully moved and released.
Figure 53E:
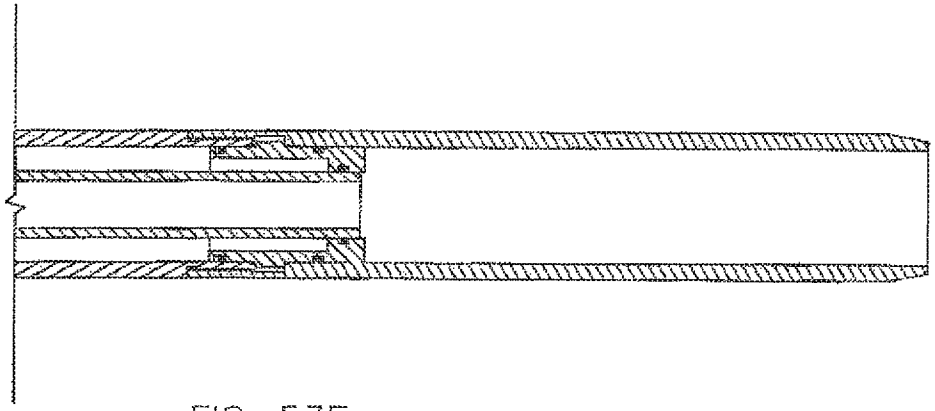
FIG. 53E is a section view of the lower most end of UUT, the blocking sleeve released, the tool extended and pressures equalized.

Referring to FIGS. 50A-50E, pressure within chamber 180 and chamber 182 (FIG. 50D) has, at this point, increased sufficiently to sever retaining ring 8 into outer portion 8*a* and inner portion 8*b* (FIG. 50C). Due to the severing of retaining ring 8, grapple 121 and connected parts have displaced axially downward. Surface 121*j* of lower finger 121*f*, radially supported by surface 110*h* with external shoulder 121*g* engaging shoulder 4*b*, has axially displaced lock sleeve 4 downward such that support surface 4*c* is no longer axially disposed within "c" ring 5. Internal surface 121*e* (FIG. 50B) of upper finger 121*a*, radially supported by diameter 110*d*, has been displaced axially downward such that external shoulder 121*b* engages upper shoulder 3*k* of blocking sleeve 3. Blocking sleeve 3 has started displacing downward and lower end 3*i* (FIG. 50C) has forcibly compelled "c" ring 5 axially downward, as shoulder 2*b* of lower body 2 radially displaces "c" ring 5 inward to reside axially within bore 2*k*.

Referring to FIGS. 51A-51E, after a brief period of time, grapple 121 (FIG. 51C) has been further axially displaced downward, such that finger 121*f* has been radially displaced inward with internal surface 121*j* and is now disposed radially adjacent diameter 110*n* of core 110. Thus, locking sleeve 4 is no longer engaging grapple 121. Finger 121*a* (FIG. 51B), with internal surface 121*e* radially supported by diameter 110*d*, has forcibly compelled blocking sleeve 3 axially downward such that upper seal 10 no longer engages upper seal surface 3*e*.

Referring to FIGS. 52A-52E, after another brief period of time, grapple 121 (FIG. 52B) has been further axially displaced downward. Blocking sleeve 3 has been fully displaced downward such that serration 1*d* of upper body 1 is no longer engaging upper serration 3*b* of blocking sleeve 3. Further, "c" ring 11, radially adjacent upper seal surface 3*e* and axially upward from upper end 3*g* of upper serration 3*b*, prevents upper serration 3*b* from re-engaging serration 1*d*. Finger 121*a* has been radially displaced inward with internal surface 121*e* now disposed adjacent diameter 110*f* of core 110. Thus, blocking sleeve 3 is no longer in engagement with grapple 121. Also, shoulder 136*d* (FIG. 52A) no longer engages shoulder 1*f*. Collet 131 is again in engagement with shoulder 1*b*, preventing downward axial displacement of UUT 90.

Referring to FIGS. 53A-53E, after a brief period of time, grapple 121 (FIG. 53C), no longer engaged with either locking sleeve 4 or blocking sleeve 3, has been fully displaced axially downward. Within chambers 179 and 181 (FIG. 53D), minor pressure and temperature changes have occurred during this process to the atmospheric air trapped during assembly of the UUT 90. The pressure changes within these two chambers are insignificant in relation to the high hydrostatic pressures that exist deep within a fluid filled well, and thus the trapped air within chambers 179 and 181 is considered near atmospheric pressure. Meanwhile, chambers 180 and 182 are filled with hydrostatically pressurized fluid 184.

Figure 54A:
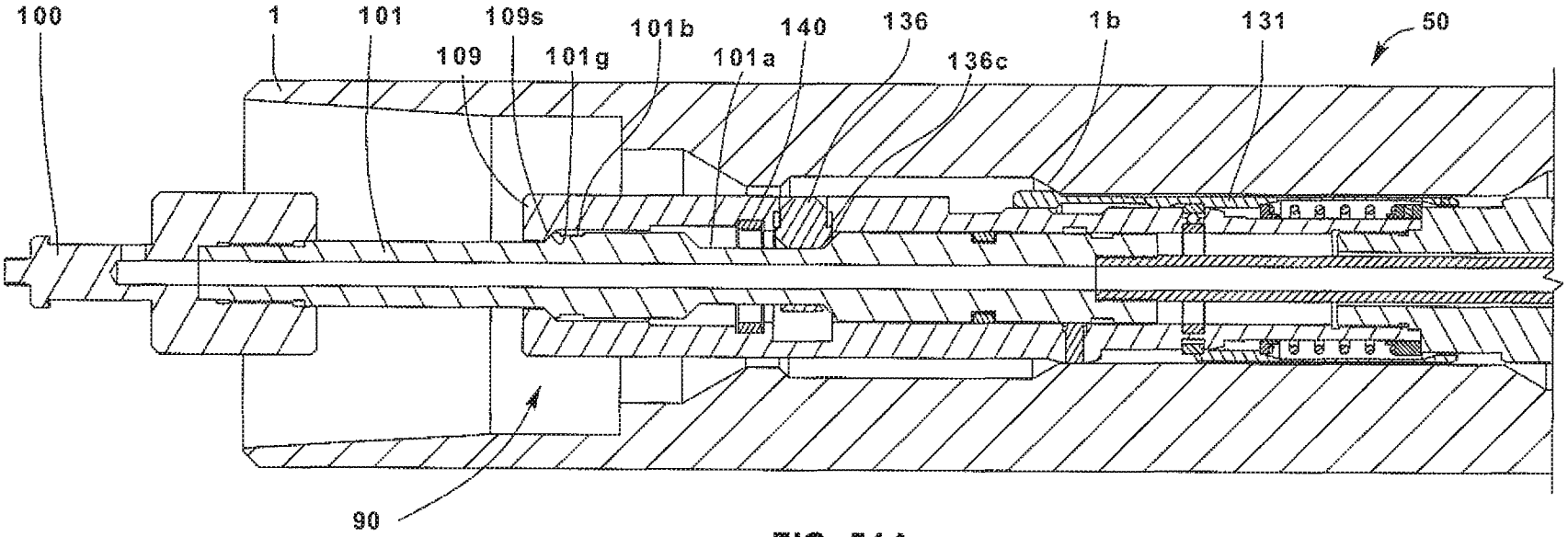
FIG. 54A is a section view of the upper most end of the UUT, the drill stem disconnected and the unblocking and unblocking tool being lifted from the well bore.
Figure 54B:
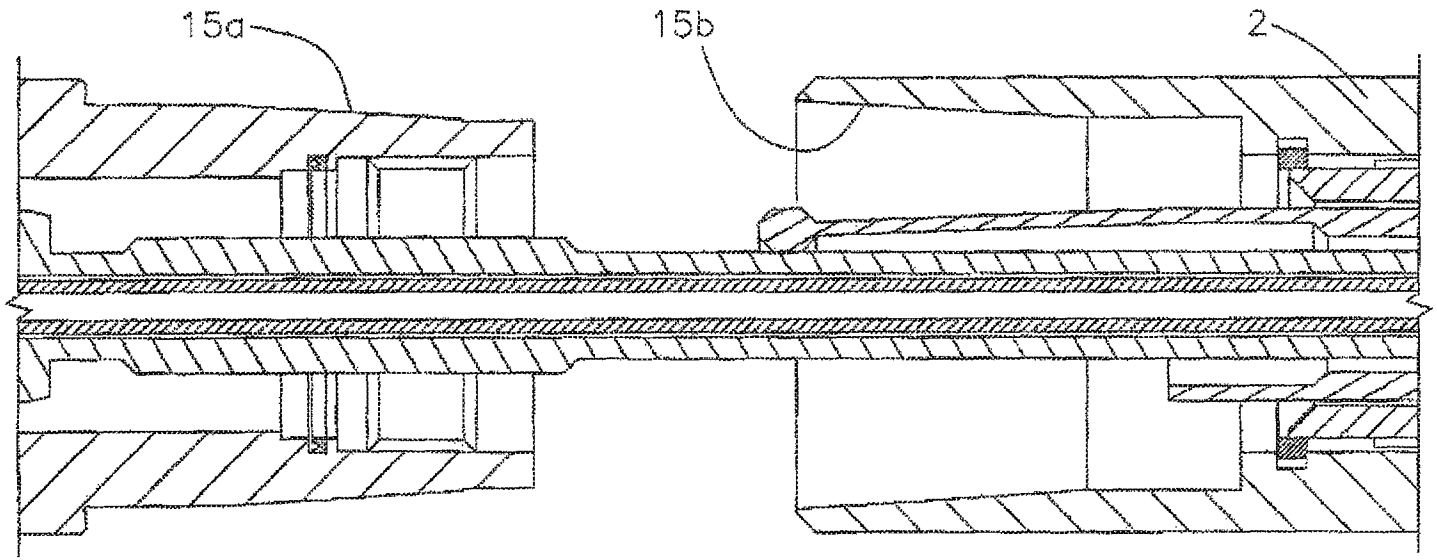
FIG. 54B is an intermediate section view of the UUT, the drill stem disconnected and the unblocking and unblocking tool being lifted from the well bore.
Figure 54C:
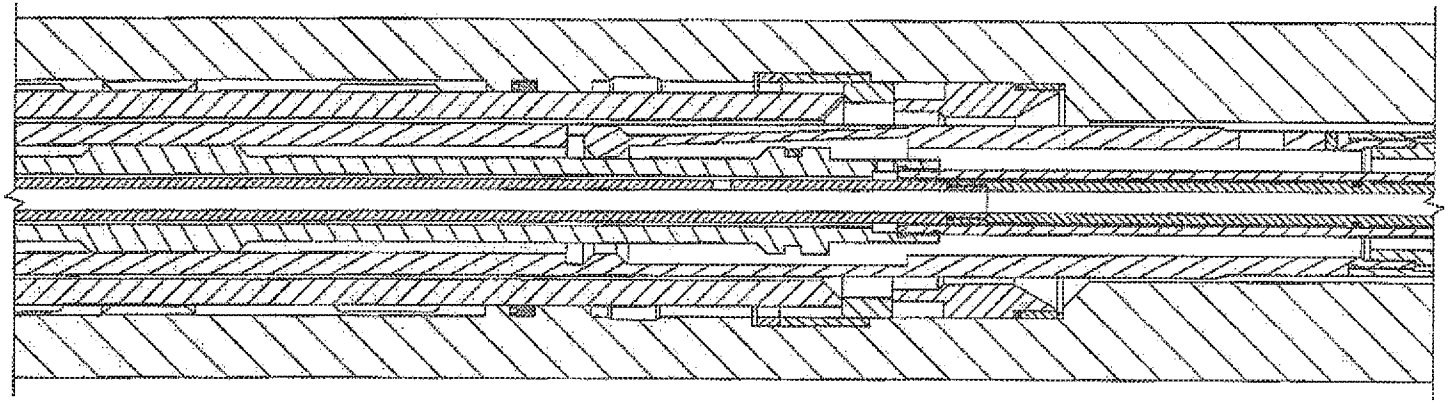
FIG. 54C is an intermediate section view of the UUT, the drill stem disconnected and the unblocking and unblocking tool being lifted from the well bore.
Figure 54D:
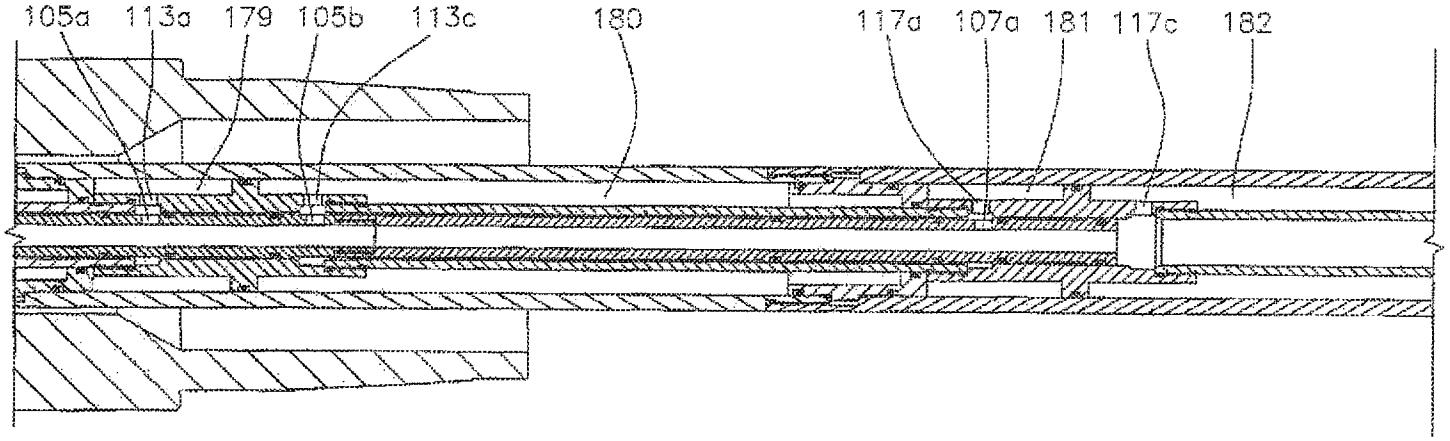
FIG. 54D is an intermediate section view of the UUT, the drill stem disconnected and the unblocking and unblocking tool being lifted from the well bore.

Referring to FIGS. 54A-54E, for the culmination of this process, the drill stem situated axially upward from upper body 1, as shown in FIG. 54A, and lower body 2, as shown in FIG. 54B, are both rotated in the opposite direction from the rotational position used to assemble the rotary shouldered and threaded connection of tool joint 15, as shown in FIG. 2C, and then lifted upward such as to disconnect an upper half 15*a* of upper body 1 from a lower half 15*b* of lower body 2, as shown in FIG. 54B. Collet 131 engages lower shoulder 1*b* and elevates UUT 90 with the upper unstuck portion of the drill stem. UUT 90 may be upwardly removed with the upper drill stem. The wireline unit may be disconnected and fishing neck 100 left down or up. Passage 183 is open to drain fluids as the drill stem is elevated.

Figure 54E:
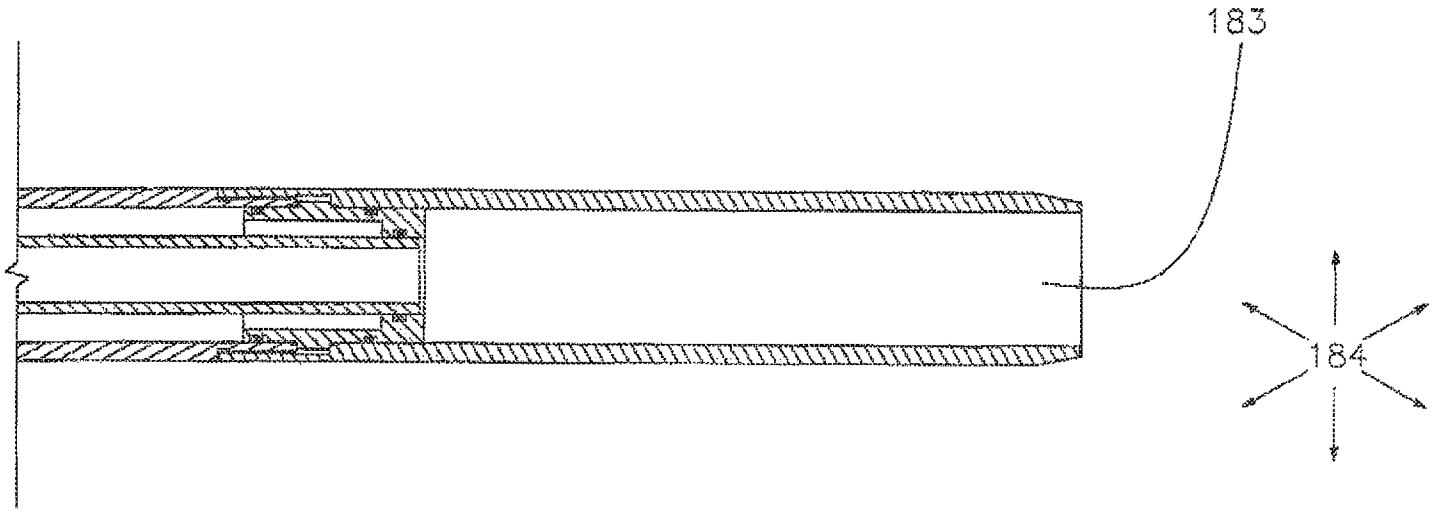
FIG. 54E is a section view of the lower most end of UUT, the drill stem disconnected and the unblocking and unblocking tool being lifted from the well bore.

Alternately, as shown in FIGS. 54A-54E, fishing neck 100 may be displaced upwardly such that groove 101*b* axially passes "c" ring 140, shoulder 101*g* of mandrel 101 engages shoulder 109*s* of body 109, key 136 is radially displaced outward, surface 136*c* is radially adjacent diameter 101*a*, and flow passages 113*a*, 105*b*, 117*a*, 113*c*, 105*a*, 117*c* and 107*a* (FIG. 54D) are now all open to hydrostatically pressurized fluid 184 via passage 183 (FIG. 54E). Chambers 179, 180, 181 and 182 are filled with pressurized fluid 184 and are at similar pressures. As such there will be no forces or trapped pressures as the UUT is elevated by wireline to the surface.

Referring to FIGS. 25A-25H and 26-46, UUT 90 may be broken apart at threads 123, 135 and 106 (FIG. 25E) and axially lengthened by adding: an additional intermediate control tube 105 (FIG. 25F) with seals 160, 161, 162 and 163, an additional upper core extension 112, an additional upper barrel 122 (FIG. 25E), an additional intermediate connector 127 (FIG. 25F) with seals 174, 175 and 163, and an additional core adapter 113 with seal 173. Reassembly of UUT 90 with this additional segment will add another atmospheric chamber and another pressurized chamber. This addition may be repeated as many times as desired to allow UUT 90 to be used shallower in a well that cannot be pressurized from the surface.

Figure 55:
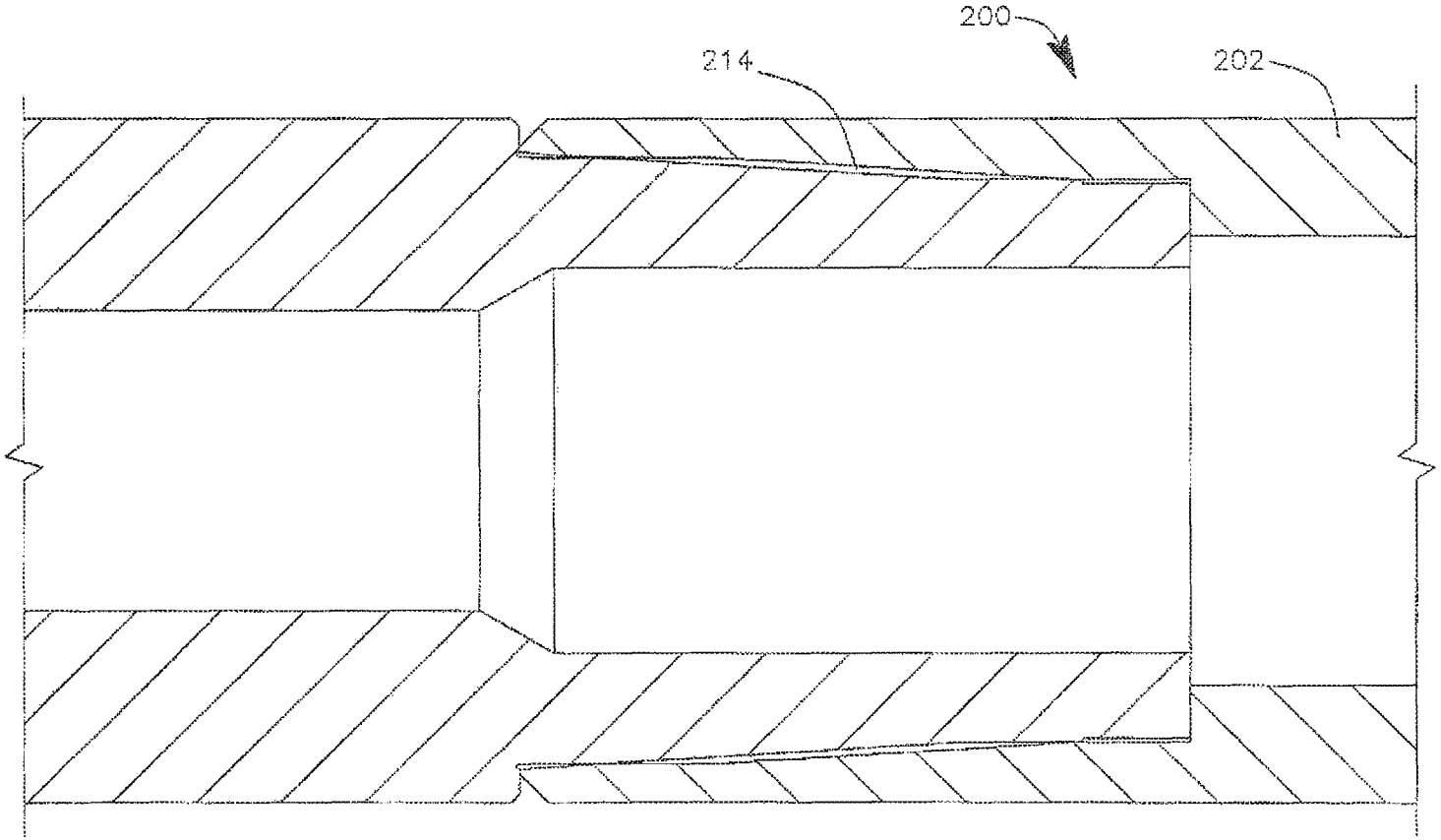
FIGS. 55-71 are similar sections view as above showing multiple alternative embodiments of both the DSD and the UUT.
Figure 56:
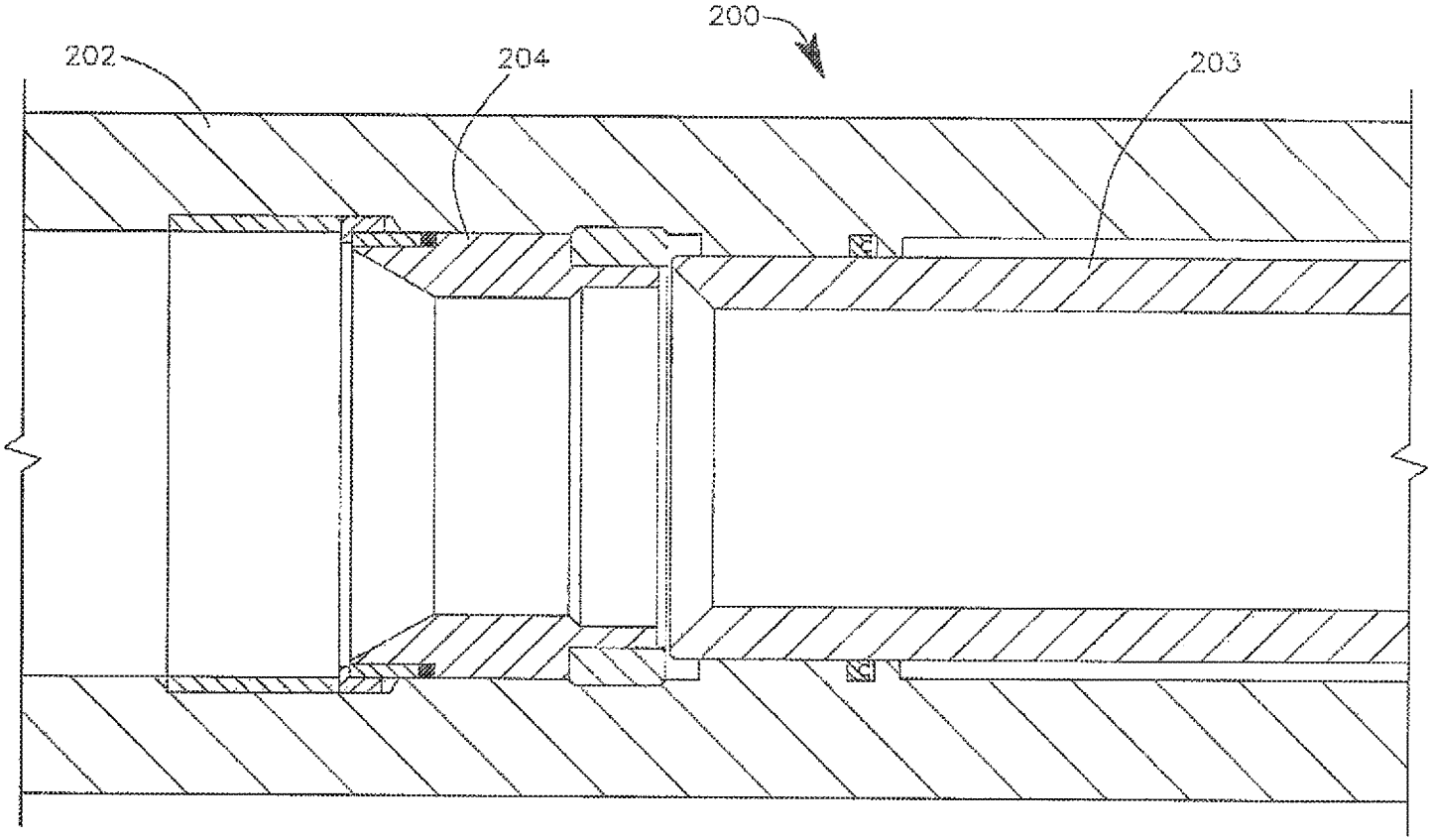
Figure 57:
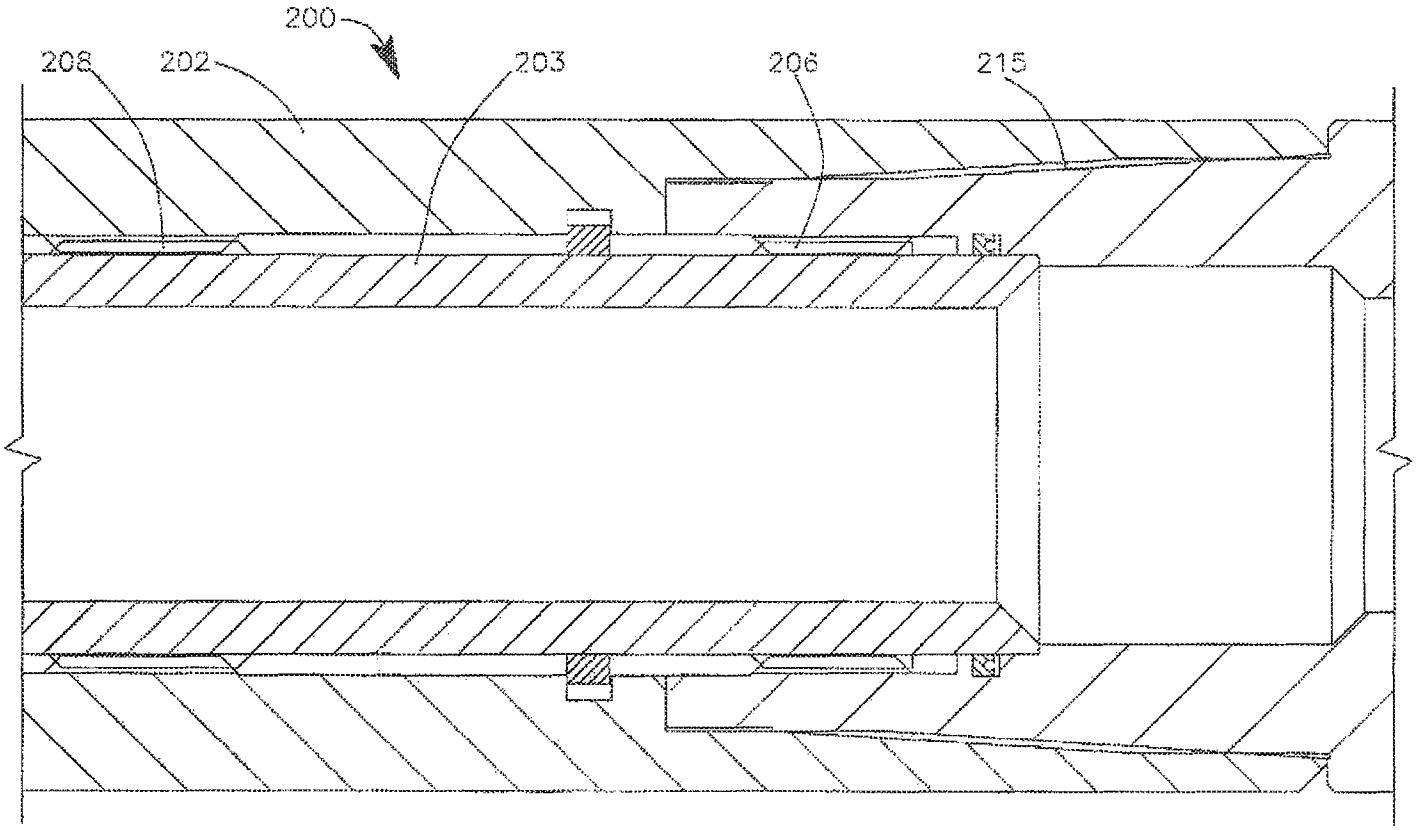
Figure 58:
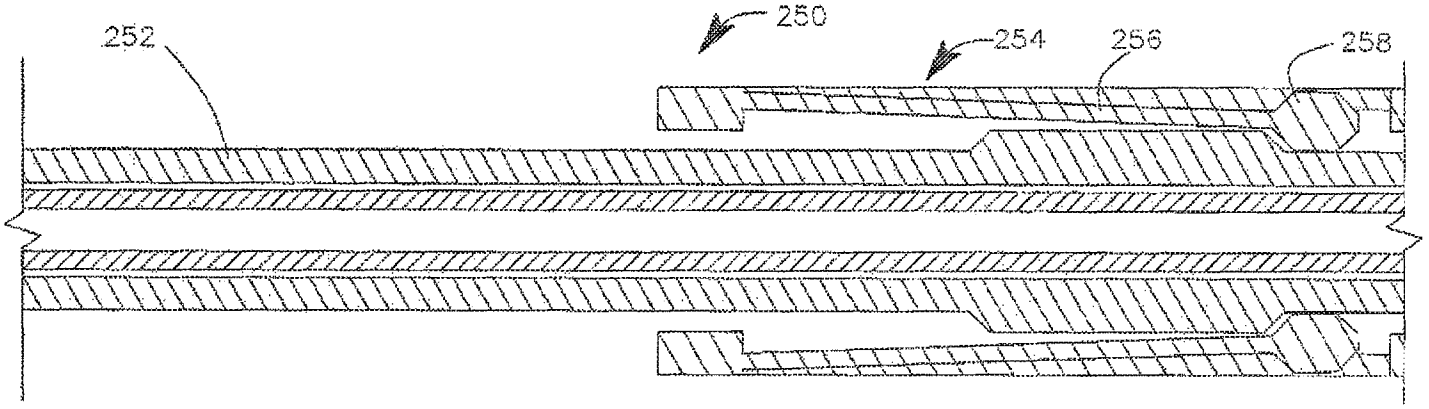

A DSD and UUT may also include alternative embodiments. For instance, referring to FIGS. 55-57, a DSD 200 includes an axially inverted block and lock sleeve mechanism including a block sleeve 203 and a lock sleeve 204. The positions of block sleeve 203 and lock sleeve 204 are reversed or inverted compared to the similar structures of the DSD 50 shown in FIGS. 2A-2F. Also axially inverted compared to similar components of DSD 50 are the first mating serrations 206 and the second mating serrations 208 between block sleeve 203 and body 202. DSD 200 also includes a first tool joint 215 and a second tool joint 214. The other features of inverted DSD 200 may be substantially the same as those shown and described with reference to DSD 50 of FIGS. 2A-2F.

Referring to FIGS. 58-64, to activate DSD 200, an alternative UUT 250 may be used. UUT 250 includes an upper end similar to the same portion of UUT 90 in FIGS. 25A and 25B. UUT 250 also includes an inner core 252 and a grapple 254 similar to grapple 121 but with some differences. Grapple 254 includes an upper collet mechanism with a plurality of collets fingers 256 (FIG. 58), a lower collet mechanism with a plurality of collets fingers 260 (FIG. 60) and a shear member 253. However, grapple 254 of UUT 250 is inverted such that engagement members 258, 262 of the collet fingers 256 and 260 are directed in the opposite axial direction relative to the similar members of grapple 121 of UUT 90. Thus, the axially inverted collets of UUT 250 are adapted for operational interaction with the appropriate portions of the axially inverted DSD 200 described above, in a manner similar to that described above with respect to UUT 90 and DSD 50.

Furthermore, UUT 250 also includes an axially inverted lower hydraulic and atmospheric chamber portion as compared to UUT 90. A detailed description of the lower chamber portion of UUT 90, including chambers 179, 180, 181 and 182, is provided with reference to FIGS. 25E-25H.

Figure 63:
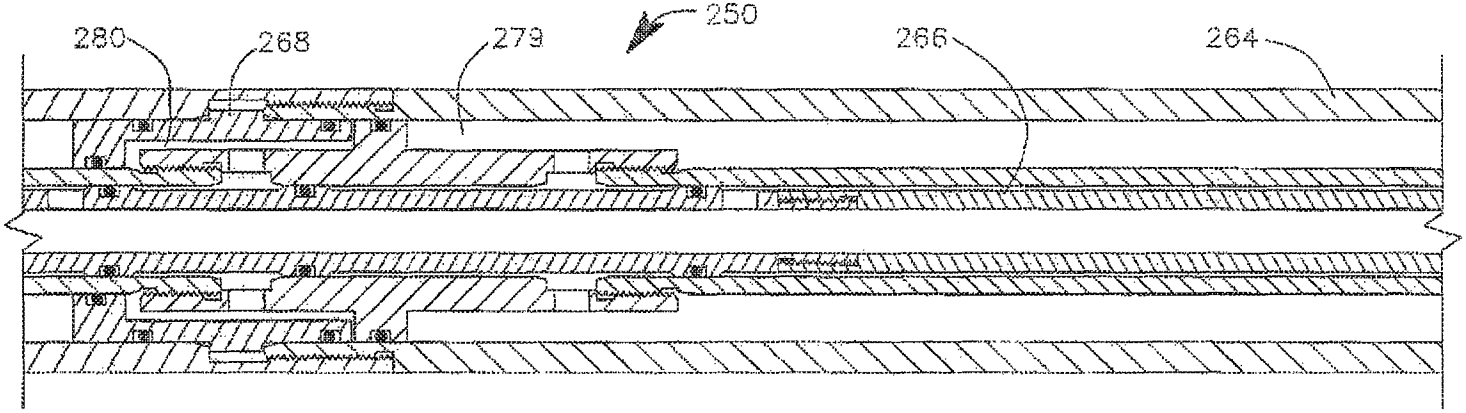
Figure 64:
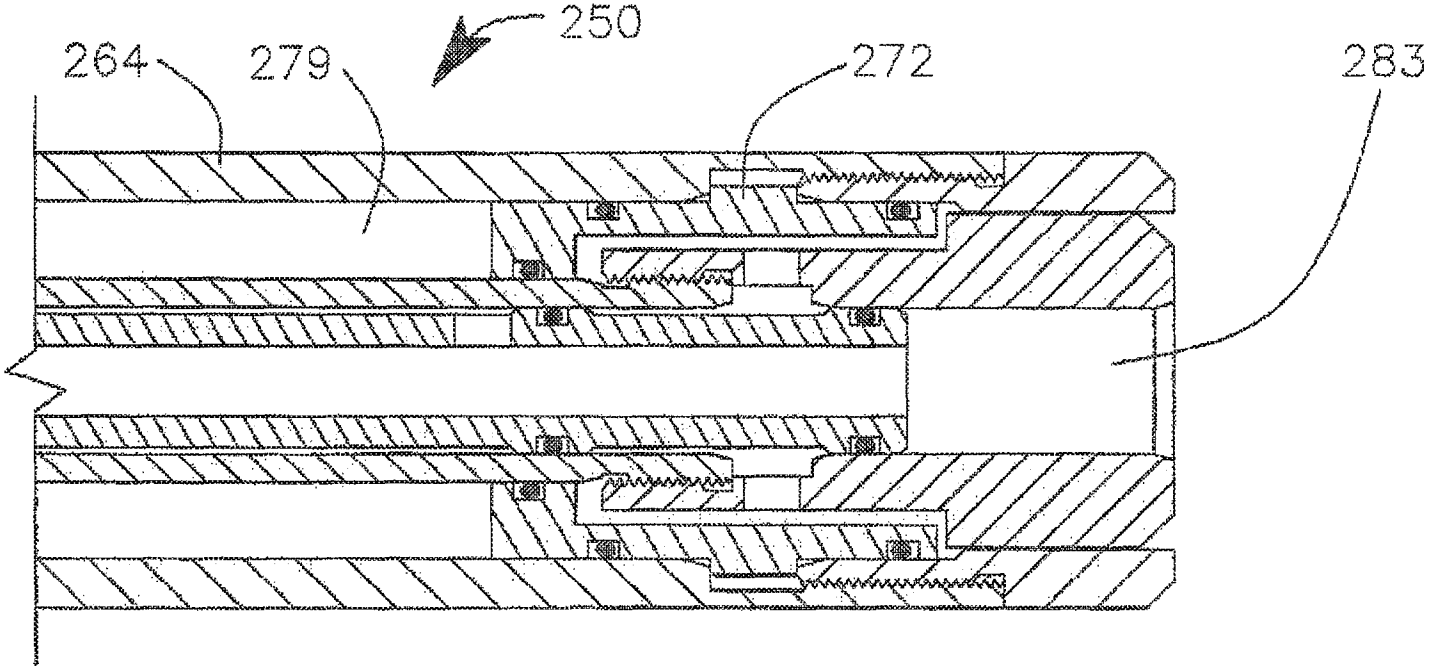

Referring to FIGS. 61-64, the lower hydraulic and atmospheric chamber portion of UUT 250 is axially inverted such that a connector 270 (FIG. 61) is disposed at an upper end of this portion of UUT 250 radially inside outer barrel 264, forming a chamber 282. Axially below this location is a chamber 281 (FIG. 62) formed between radially outer barrel 264 and radially inner core 266. As shown in FIGS. 63 and 64, an intermediate connector 268 partially defines a chamber 280; also, a chamber 279 is disposed within this portion of UUT 250 and is partially defined by lower connector 272, outer barrel 264 and inner core 266. UUT 250 also includes lower end fluid passage 283. The operation of the inverted lower hydraulic and atmospheric chamber portion of UUT 250 is similar in manner as compared to the corresponding chamber portion of UUT 90. However, unlike UUT 90 and DSD 50, block sleeve 203 of DSD 200 shifts axially upward upon activation of the assembly and the disconnection is made in a manner similar as previously described with regard to UUT 90 and DSD 50, at the lower tool joint 215 shown in FIG. 57.

Figure 65:
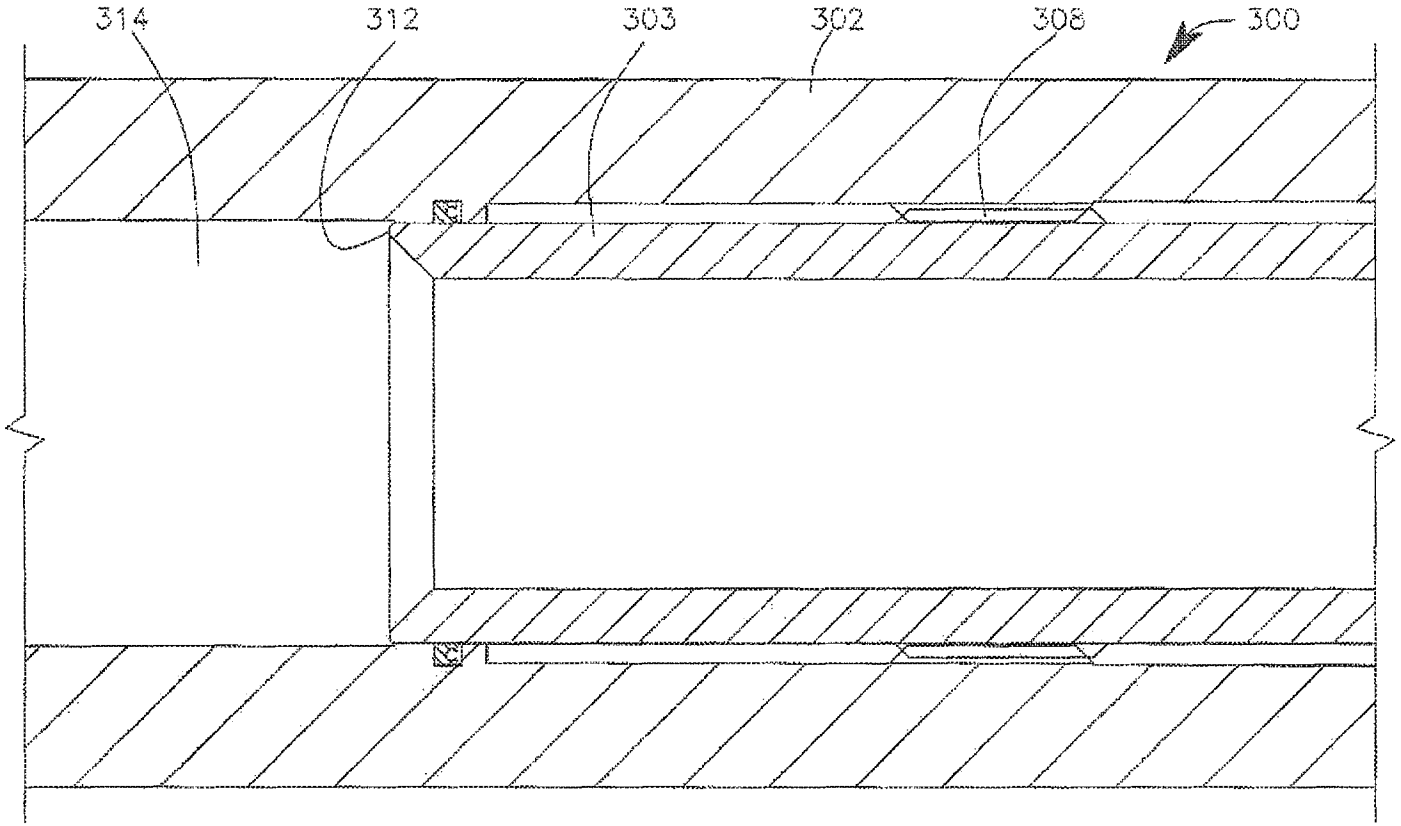
Figure 66:
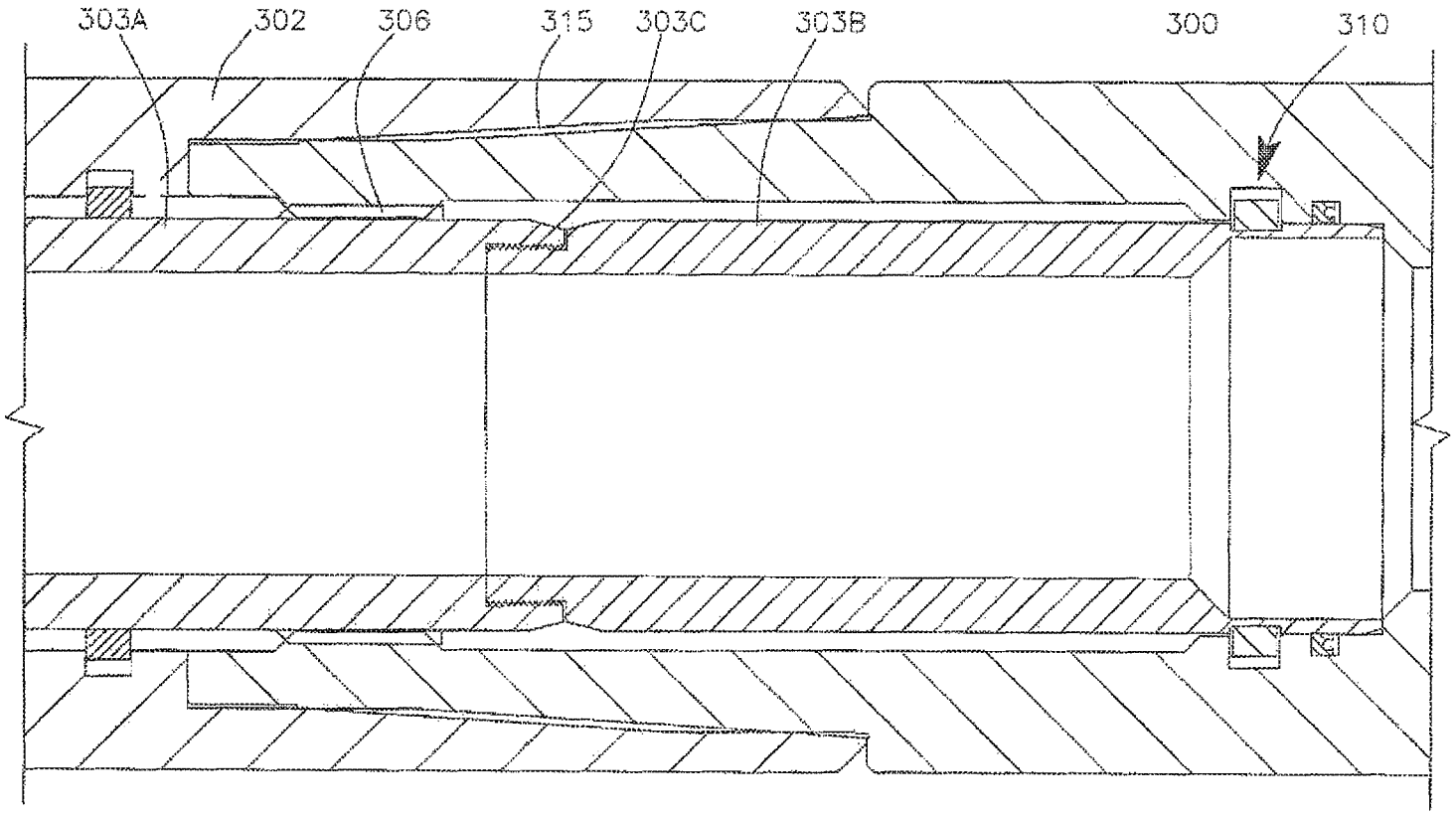

In further alternative embodiments of the DSD and UUT, other changes may be made to these assemblies to provide additional functionality and flexibility to the overall system of disconnecting portions of pipe strings. Referring to FIGS. 65 and 66, another alternative DSD 300 is illustrated which is axially inverted and includes a shear or frangible release in place of the lock sleeve. DSD 300 comprises a body 302 (FIG. 65) with no tool joint axially adjacent to the upper end of a block sleeve 303. Instead a tool joint 315 is disposed toward the axially lower portion of block sleeve 303 (FIG. 66). Disposed axially between body 302 and block sleeve 303 are first mating serrations 306 and second mating serrations 308, which are axially displaceable to engage or disengage the upper and lower bodies on either side of the tool joint 315 as described herein. Block sleeve 303 includes an axially upper portion 303*a* and an axially lower portion 303*b* coupled by a threaded connection 303*c*. A lower shearable or frangible release mechanism 310 radially engages both block sleeve 303 and body 302 until activation of the assembly occurs in response to a UUT as described herein. Upon the application of an upward force by a UUT, mechanism 310 shears or releases to allow the upper end 312 of block sleeve 303 to move axially upward into a bore space 314 of body 302 (FIG. 65), thereby axially disengaging mating serrations 306, 308, and allowing the upper and lower tubular strings to be disconnected at the tool joint 315. Other features of DSD 300 not specifically described herein are consistent with corresponding features of the DSD's described elsewhere in this description.

Figure 67:
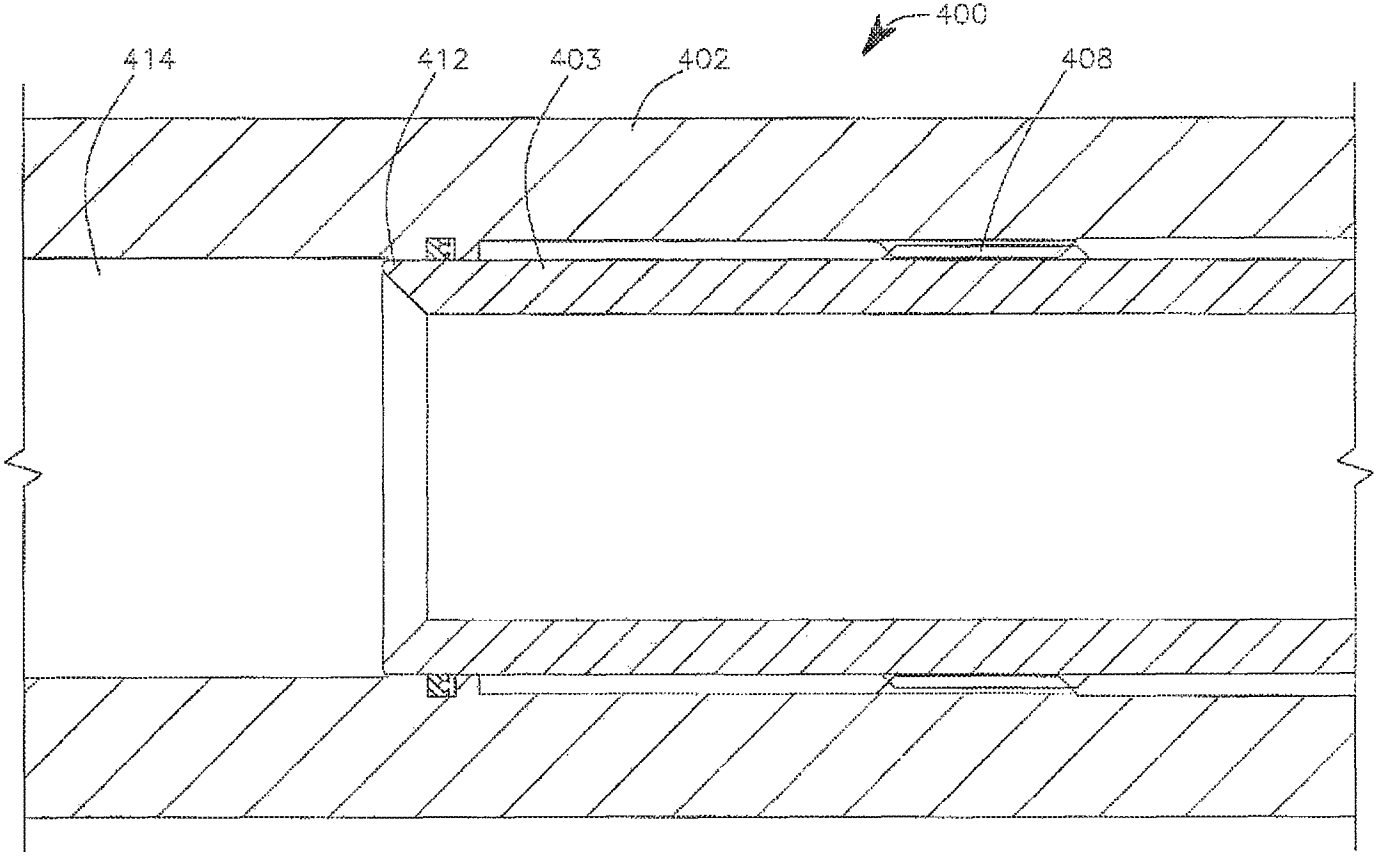
Figure 68:
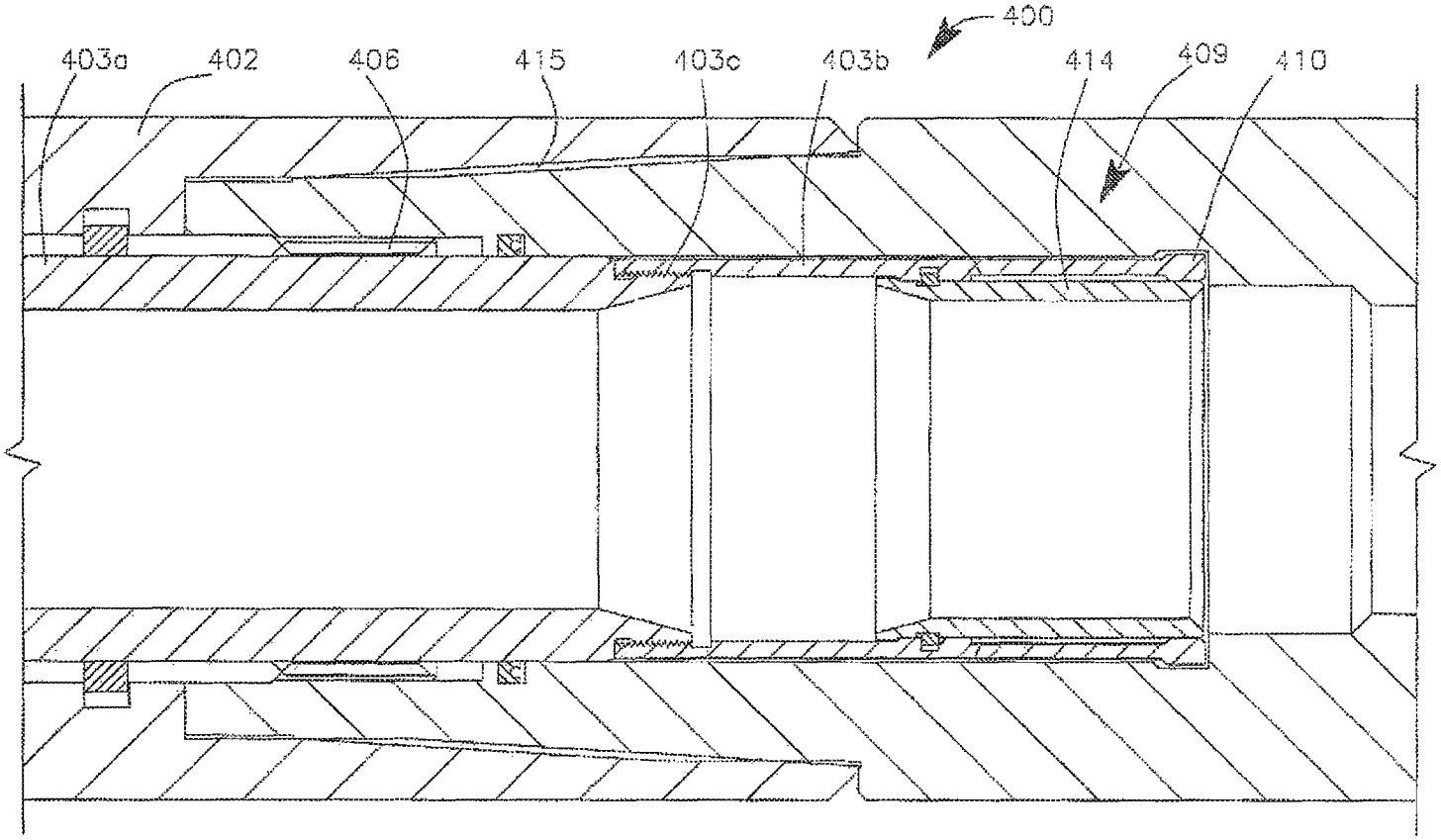

Referring to FIGS. 67 and 68, in a further alternative embodiment of DSD 300, a DSD 400 is also axially inverted as compared to DSD 50, but also includes a lower lock mechanism 409 (FIG. 68) rather than the shear mechanism 310 of DSD 300. Upon activation of the assembly in response to a UUT as described herein, an upward force is applied to a lock sleeve 414 (FIG. 68) and a collet mechanism 410 of the lower lock mechanism 409, releasing a block sleeve 403. Lower lock mechanism 409 comprises an axial lower portion 403*b* and an axial upper portion 403*a* of block sleeve 403, coupled by a threaded connection 403*c*. The released block sleeve 403 is displaced axially upward such that an upper end 412 of block sleeve 403 is displaced axially into a bore space 414 of a body 402 (FIG. 67), thereby axially disengaging mating serrations 406, 408, and allowing the upper and lower tubular strings to be disconnected at the tool joint 415. Other features of DSD 400 not specifically described herein are consistent with corresponding features of the DSD's contained elsewhere in this description.

Figure 69:
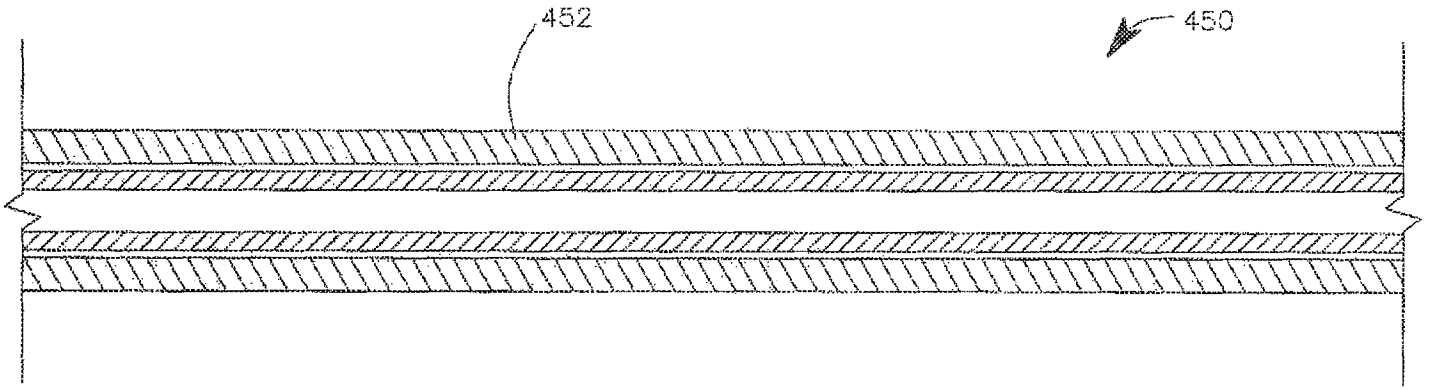
Figure 59:
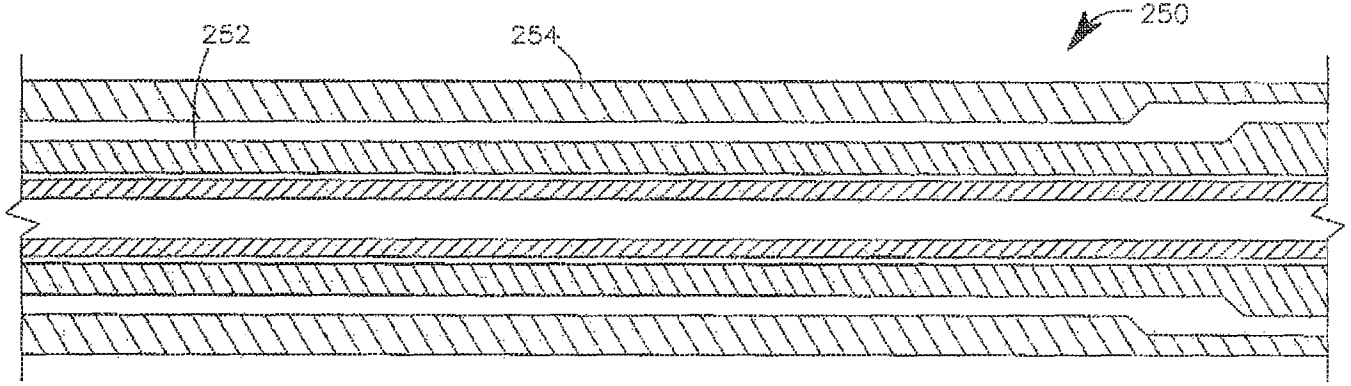
Figure 70:
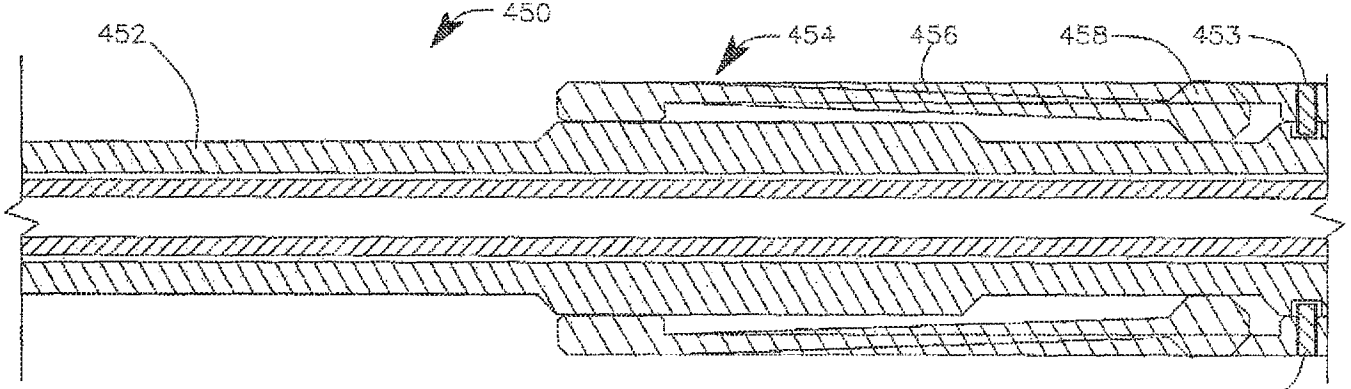
Figure 60:
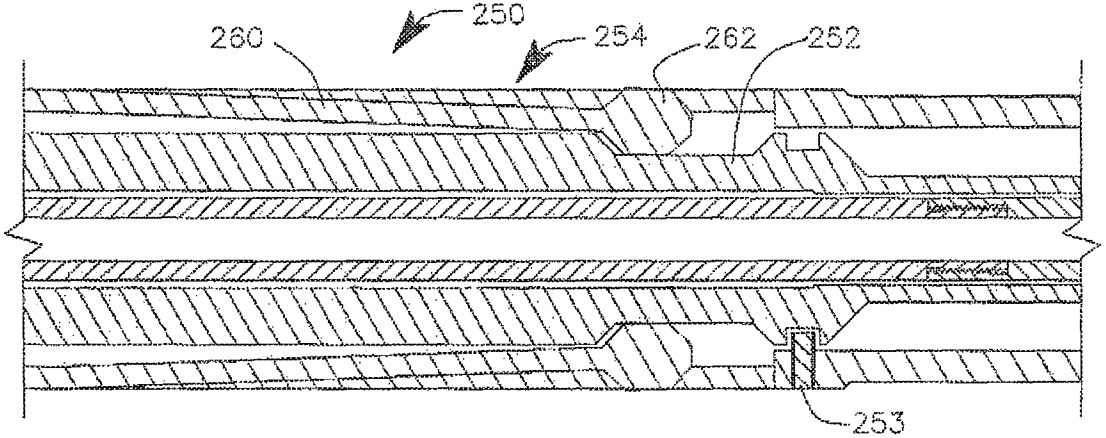
Figure 71:
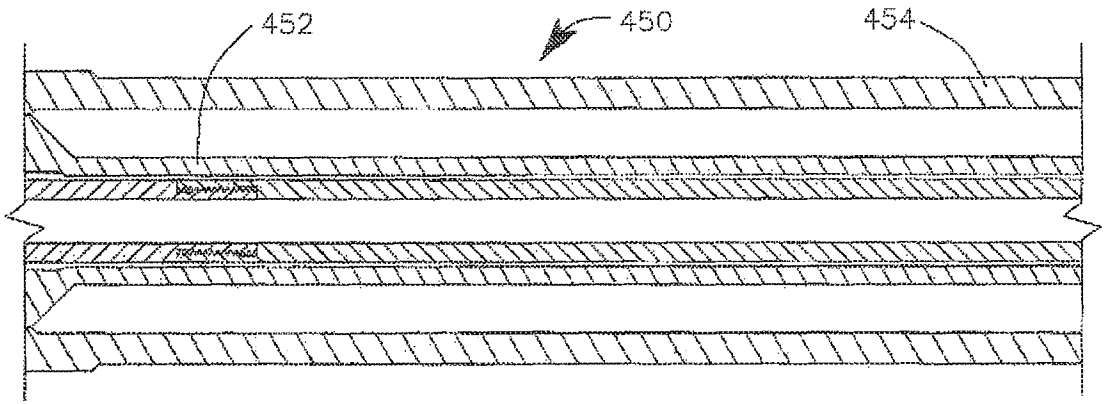
Figure 61:
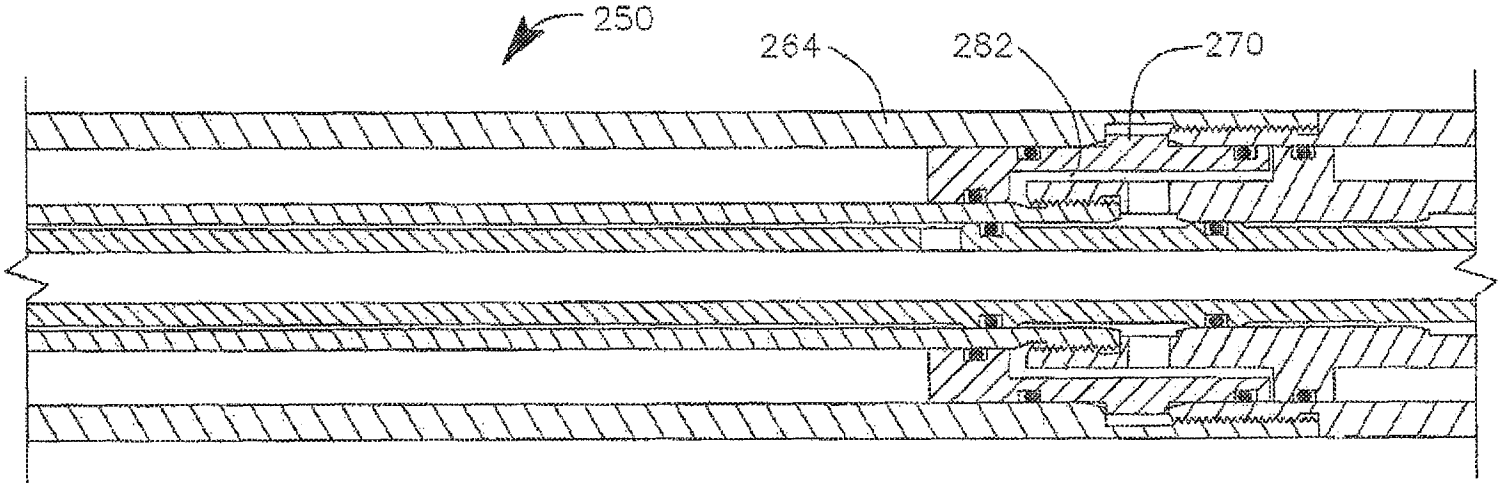
Figure 62:
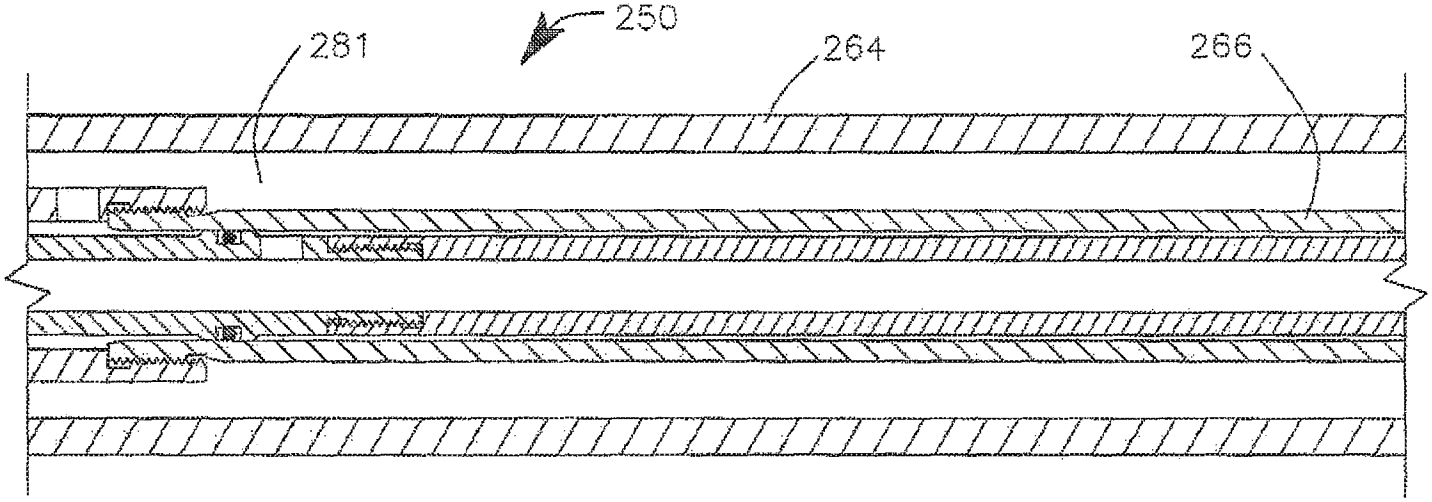

The DSD's 300, 400, include only one rotary shouldered and threaded tool joint and one lock or release mechanism, thus only requiring one collet mechanism in the respective activating UUT. An alternative embodiment of a UUT is illustrated in FIGS. 69-71. UUT 450 is designed to activate inverted DSD's 300, 400, and thus it shares many of the same features and characteristics of the previously described UUT 250. For example, the upper fishing neck and collet portion of UUT 450 corresponds to the fishing neck and collet portion of UUT's 50, 250, of FIGS. 25A and 25B. Also, the lower chamber portion of UUT 450 corresponds to the lower chamber portion of UUT 250, shown in FIGS. 61-64. However, UUT 450 includes a grapple 454 (FIG. 70) with only a single collet mechanism including a plurality of collets fingers 456 and a shear member 453. The axially inverted collet mechanism includes engagement members 458 of the collet fingers directed in the axially opposed direction of the engagement members of the grapple 121 of UUT 90. The collet mechanism of the UUT 450 is configured for operational interaction with the single, lower release or lock mechanism of the inverted DSD's 300, 400, described above.

Another embodiment of a disconnect assembly relates to the use of serrations to rotationally couple two bodies of a disconnect assembly using a third body with a varying number of serrations on each body, and is shown in FIGS. 72-77. First body 500 (FIG. 72) may be a solid or hollow object of any shape fitted with a generally cylindrical end with serrations 500*a* disposed radially about an outer circumference of first body 500. Second body 501 may be a solid or hollow object of any shape fitted with a generally cylindrical end with serrations 501*a* disposed radially about an outer circumference of second body 501. Serrations 500*a* of first body 500 and serrations 501*a* of second body 501 are of different count or pitch. A third body 502 is fitted with serrations 502*a* disposed radially about an inner circumference of third body 502 for companion engagement with serrations 500*a* of first body 500, and serrations 502*b* disposed radially about the inner circumference of third body 502 but axially displaced from serrations 502*a* for companion engagement with serrations 501*a* of second body 501.

Sufficient axial clearance must be provided such that serrations 502*a* and 502*b* of third body 502 may disengage from their respective mating serrations 500*a* and 501*a*, to allow third body 502 to be rotated independently of first body 500 and second body 501. Axial gap 503 disposed axially upward from serration 500*a* must be of sufficient width to allow the third body 502 to be axially displaced upward to disengage serration 502*a* from serration 500*a* of first body 500 and, assuming serration 502*b* would interfere by engaging serration 500*a*, axial gap 504 between serrations 500*a* and 501*a* must be sufficient to allow the third body 502 to be axially displaced upward to disengage serration 502*b* from serration 501*a* of second body 501.

Figure 72:
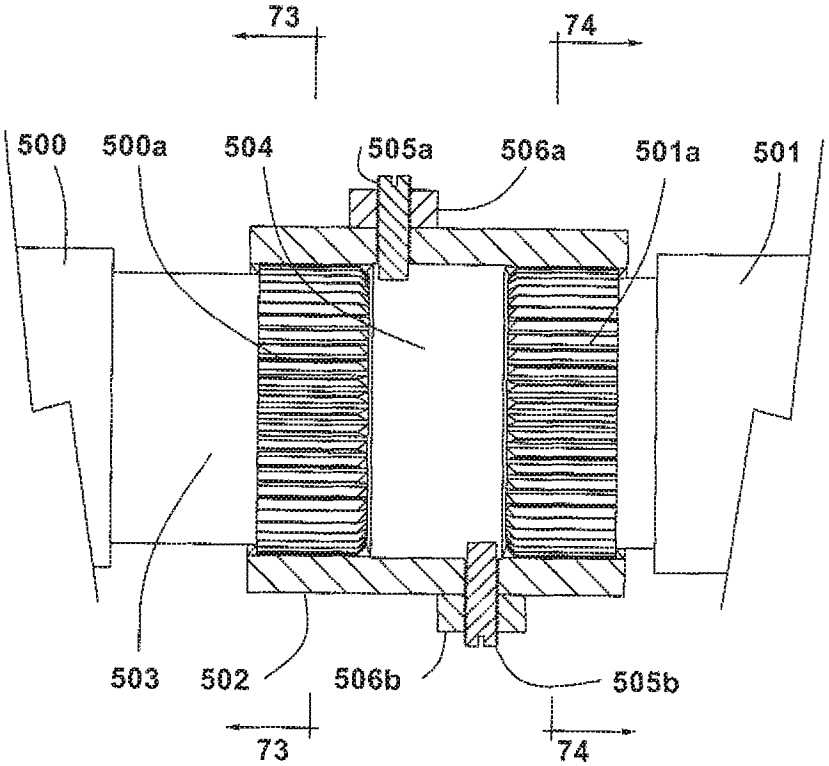
FIGS. 72-88 are elevation and section views of alternative embodiments of a disconnect assembly in accordance with the principles of this disclosure.
Figure 74:
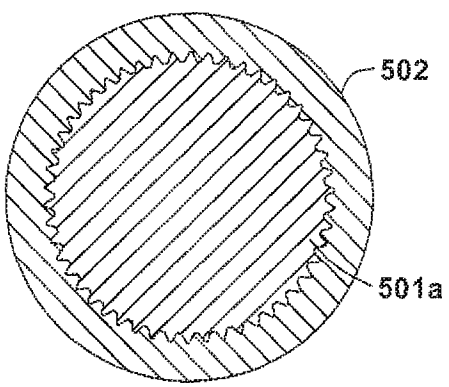
Figure 73:
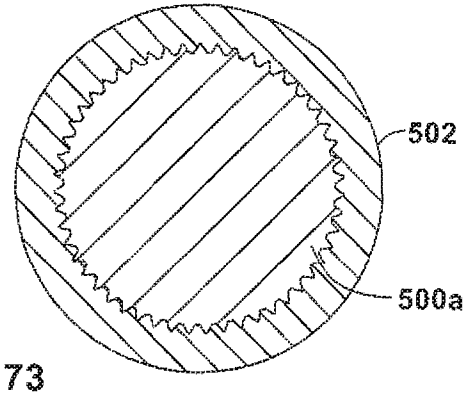
Figures 75, 76, 77:
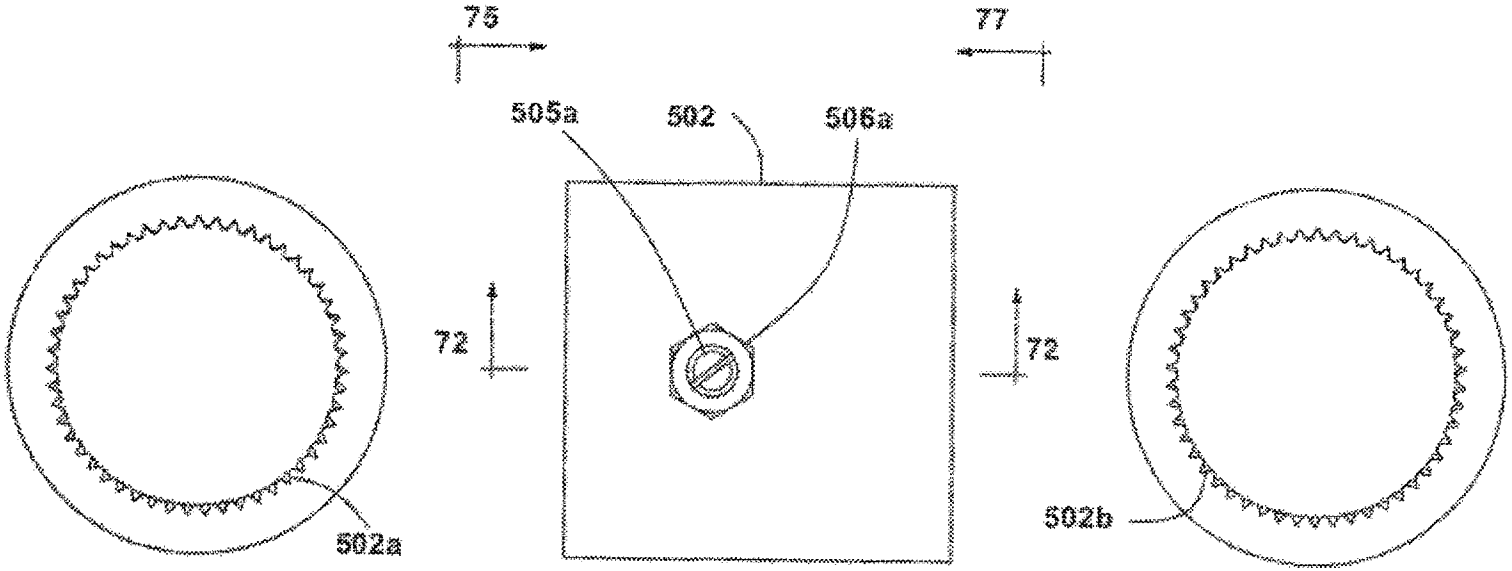
Figure 79:
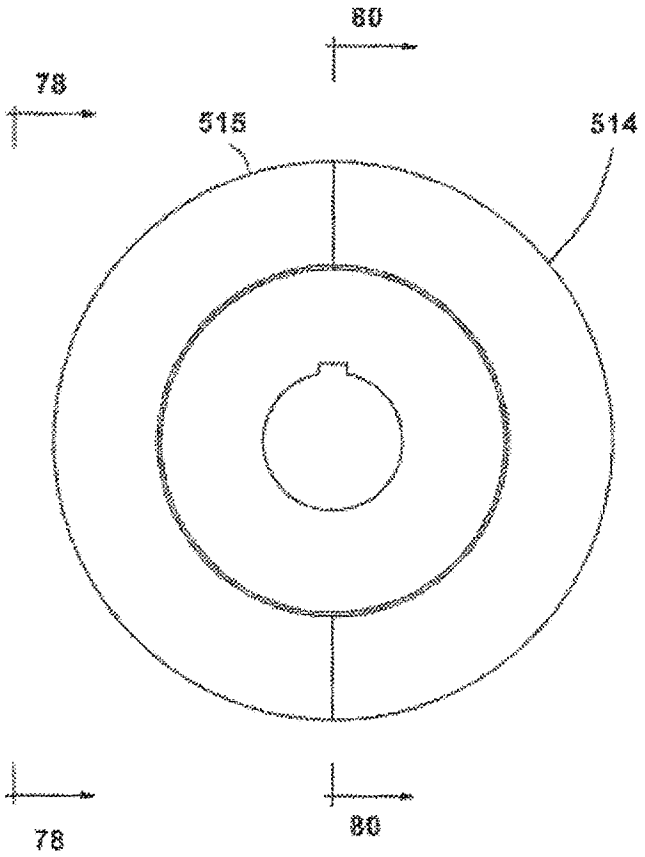

Screws 505*a* and 505*b* retained by nuts 506*a* and 506*b* extend radially through third body 502, holding third body 502 in the engaged position as shown in FIG. 72.

If first body 500 and second body 501 are immovable or positioned in a desired rotational position with respect to one another, the third body 502, axially positioned such that serration 502*a* is aligned in gap 503 and serration 502*b* is aligned in gap 504, may be rotated into a particular position and axially engaged with the serrations of the first body 500 and the second body 501 by axially displacing third body 502 such that serration 502*a* engages serration 500*a* and serration 502*b* engages serration 501*a*, to prevent rotation between first body 500 and second body 501.

The accuracy of alignment between third body 502 and first and second bodies 500 and 501 is dependent on the clearance between the bodies and number of or pitch of the serrations as previously described.

While keeping with the principles of this disclosure, the first body 500 and the second body 501 may be shaft couplings within a machine or a sign post and a ground fitting. In further embodiments, the bodies 500, 501 include not just downhole tubulars, but tubular or cylindrical members in fields outside of hydrocarbon exploration and production.

Also keeping with the principles of this disclosure, if serrations 502*b* of third body 502 and 501*a* of second body 501 are sufficiently diametrically larger than serrations 500*a* of first body 500 and 502*a* of third body 502, gap 504 may be eliminated as larger diameter serration 502*b* may be disposed radially over serration 500*a* without engaging smaller diameter serration 500*a*. Additionally, if first body 500 may be displaced axially upward and away from second body 501 far enough to disengage third body 502 from both the first body 500 and the second body 501, as in the situation of bolted down machine components, gaps 503 and 504 would not be required and screws 505*a*, 505*b*, and nuts 506*a* and 506*b* may also not be required.

Figure 81:
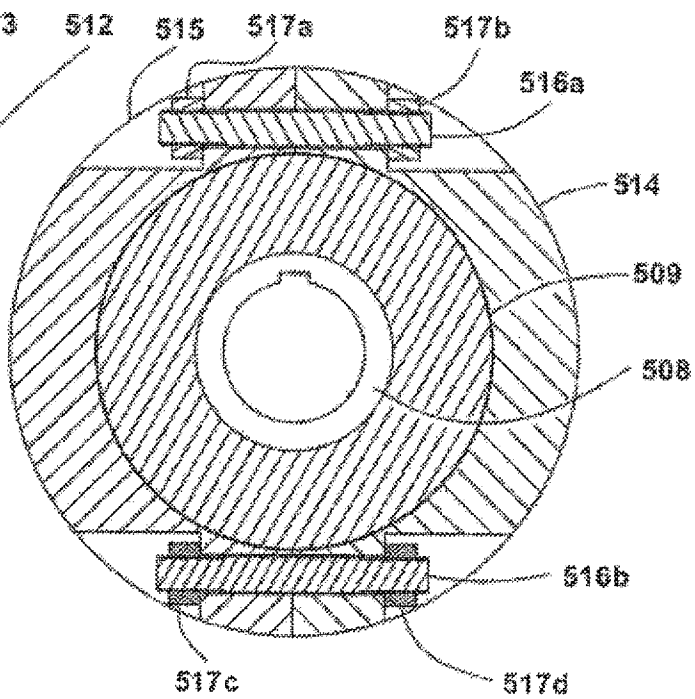
Figure 80:
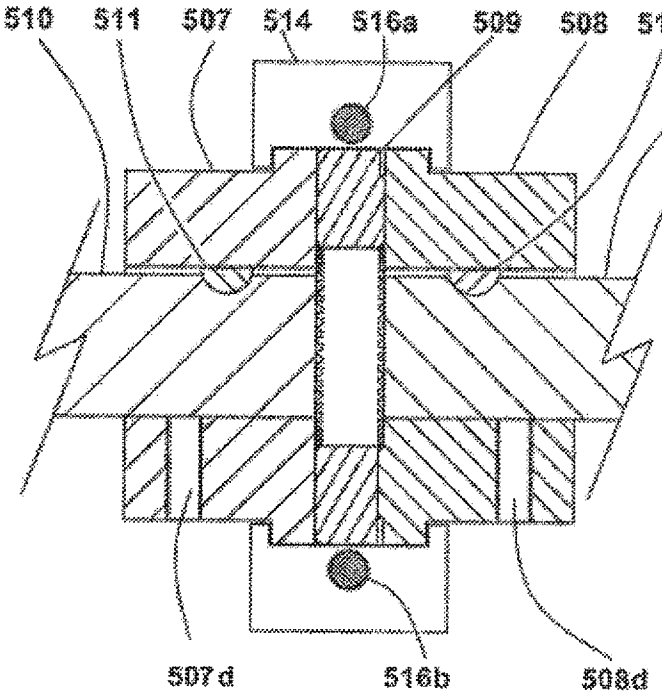
Figure 85:
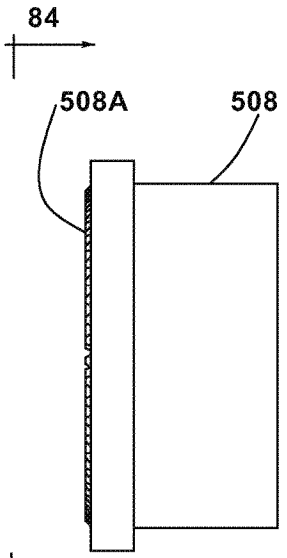
Figure 84:
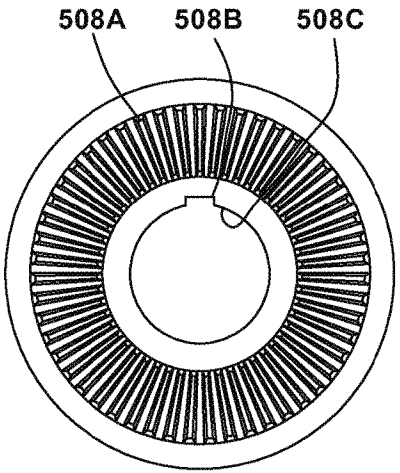
Figure 83:
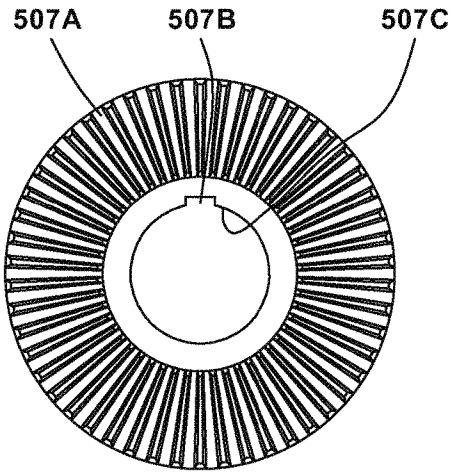
Figure 82:
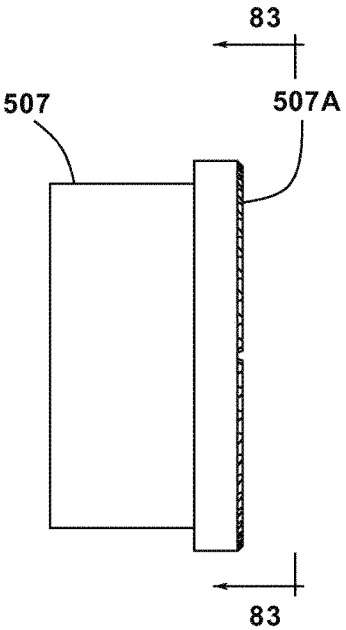
Figure 88:
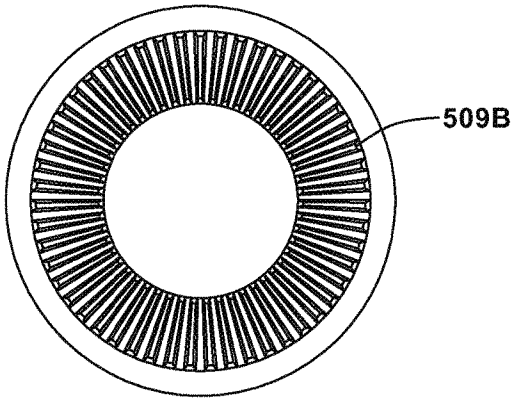
Figure 87:
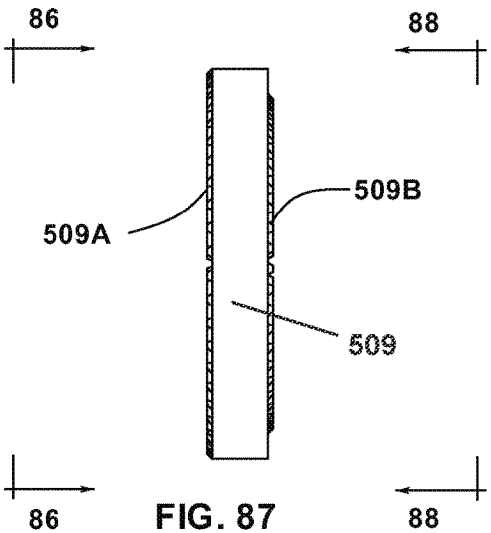
Figure 86:
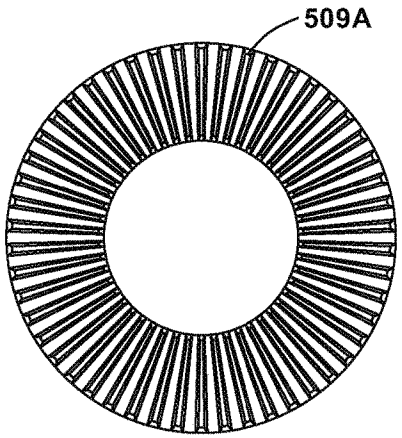

Yet another embodiment of a disconnect assembly using serrations to rotationally couple two bodies using a third body, with a different number of serrations on each body is shown in FIGS. 78-88. The first body 507 (FIG. 78) is in the form of a shaft including a key slot 507*b* (FIG. 83) disposed axially along the circumference of a central bore 507*c* and a threaded set screw hole 507*d* (FIG. 80) extending radially away from first body 507 for mounting on a shaft 510 disposed concentrically within first body 507 using a circumferentially disposed key 511. First body 507 has a serrated face 507*a* (FIGS. 82, 83). The second body 508 is in the form of a shaft including a key slot 508*b* (FIG. 84) disposed axially along the circumference of a central bore 508*c* and a threaded set screw hole 508*d* (FIG. 508D) extending radially away from second body 508 for mounting on a shaft 512 disposed concentrically within second body 508 using a circumferentially disposed key 513. Second body 508 has a serrated face 508*a* (FIGS. 84, 85). Serrations 507*a* of first body 507 and serrations 508*a* of second body 508 are of different count or pitch. A third body 509 (FIG.

80) is fitted with serrations 509*a* (FIG. 87) disposed on a face of third body 508 for companion engagement with serrations 507*a* of first body 507, and serrations 509*b* disposed on an opposite face of third body 508 for companion engagement with serrations 508*a* of second body 508.

Figure 78:
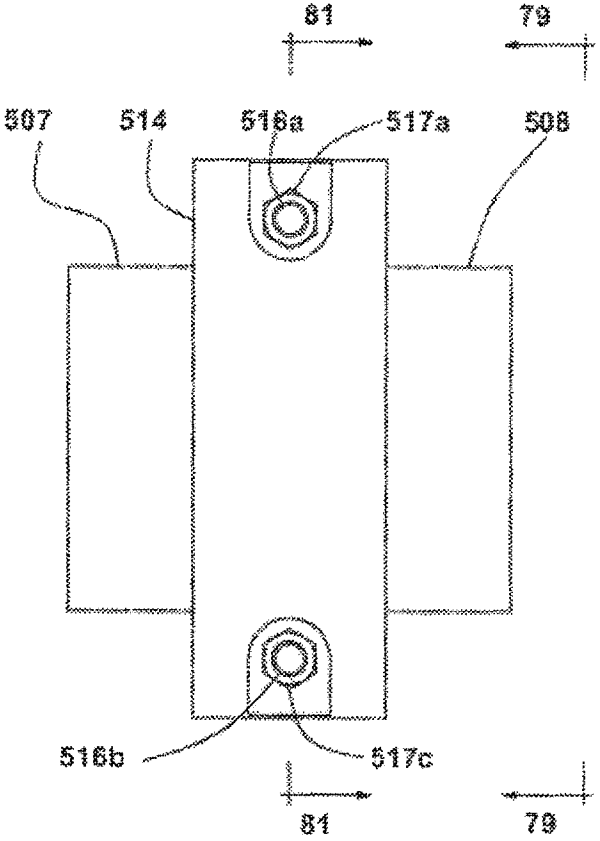

Circumferentially disposed about the axial engagement between first body 507, second body 508, and third body 509 are semi-cylindrical retainers 514 and 515 (FIG. 78). Retainer 515 and retainer 514 surround and act to hold first body 507, second body 508 and third body 509 in companion serration engagement. Retainer 515 and retainer 514 are secured in engagement about first body 507, second body 508 and third body 509 by studs 516*a*, 516*b*, nuts 517*a*, 517*b*, 517*c* and 517*d* (FIG. 81).

With the retainer 514 and retainer 515 removed serrations 507*a* of first body 507 and serrations 508*a* of second body 508 may be disengaged from the companion serrations 509*a* and 509*b* of third body 509 and first body 507 and second body 508 may be rotated in relation to one another to form a new angular relationship. Retainers 514 and 515 may then be reinstalled as previously described depending on clearances and number of or angular pitch of the pairs of serrations.

Keeping with the principles of this disclosure, first body 507 and second body 508 may be formed integrally with shafts 510 and 512 so long as freedom exists to move the shaft mountings axially apart to position and engage the serration pairs 509*a* and 509*b* formed with third body 509.

It will be understood that all tool joints of the drill stem including tool joint 15 of FIG. 2C may be identical but assembled with different lubricants, or they may be of different design but assembled with the same lubricant, or a mixture of different designs and lubricants and not deviate from the scope and spirit of the principles disclosed herein.

The exemplary situation given above is by way of example only, and other embodiments may include one DSD or any number of DSD's used at any depth, at regular or random spacing intervals so long as adequate hydrostatic or applied pressure is available. Wireline was used in the exemplary situation to lower and raise the UUT within the drill stem, though other common methods may be used with this description such as coiled tubing, pump down, macaroni tubing, sand line and the like. Circulation was not possible in the exemplary situation described above to display the versatility of the embodiments disclosed herein, though circulation is often desirable and would aid, not inhibit, the function of the described UUTs.

It will be understood that the lower thread of upper body 1 (FIG. 2A) and the upper thread of lower body 2 (FIG. 2F) could be reversed or interchanged such that upper body 1 could have an external thread and the upper end of lower body 2 could have an external thread, and the functioning of the tool described herein would not change. Likewise the threads connecting upper body 1 and lower body 2 could be configured to engage by clockwise or counterclockwise rotation, depending on location and need of a particular use without deviating from the spirit of the principles described herein. Further, the upper thread and lower thread could be any type or kind of drill stem connection to accommodate any particular drill stem.

It will thus be seen, that the disconnect for a well drill stem as well as the selective anchoring and functioning of the unlocking and unblocking tool of the present description may be adapted to carry out the ends and advantages mentioned as well as those inherent therein. While some embodiments of the apparatus have been shown for the purposes of this disclosure, numerous changes in the arrangement and construction of parts may be made by those skilled in the art. All such changes are encompassed within the scope and spirit of the appended claims.

It should be understood by those skilled in the art that the disclosure herein is by way of example only, and even though specific examples are drawn and described, many variations, modifications and changes are possible without limiting the scope, intent or spirit of the claims listed below.

The invention claimed is:

1. An activation tool for anchoring within a string extending through a wellbore, comprising:

an outer body; and a radially expandable anchor disposed about the outer body and comprising an external shoulder, wherein the anchor is configured to selectively anchor the external shoulder of the anchor against an upward shoulder of the string;

wherein the anchor comprises an unarmed position allowing the anchor to pass through the upward shoulder of the string;

wherein the anchor comprises an armed position preventing the anchor to pass through the upward shoulder of the string while allowing the anchor to pass through a downward shoulder of the string;

wherein the anchor is configured to be transitioned from the unarmed position to the armed position in response to engagement from the downward shoulder of the string.

2. The activation tool of claim 1, further comprising:

a first ring disposed radially between the anchor and the outer body; and a shear member configured to frangibly couple the anchor to the first ring;

wherein, when the anchor is in the unarmed position, the shear member is in an unsheared position restricting relative axial movement between the anchor and the first ring;

wherein, when the anchor is in the armed position, the shear member is in a sheared position permitting relative axial movement between the anchor and the first ring.

3. The activation tool of claim 2, further comprising:

a second ring disposed radially between the anchor and the outer body, and axially spaced from the first ring; and a biasing member disposed radially between the anchor and the outer body, and extending axially between the first ring and the second ring.

4. The activation tool of claim 3, wherein:

when the anchor is in the unarmed position, the biasing member is configured to bias the anchor towards a first axial position; and when the anchor is disposed in the first axial position, the anchor is supported by the outer body in a radially outer position.

5. The activation tool of claim 4, wherein, when the anchor is in the unarmed position, the biasing member is configured to act against the first ring to bias the anchor towards the first axial position.

6. The activation tool of claim 4, wherein:

when the anchor is in the armed position, the biasing member is configured to bias the anchor towards a second axial position; and when the anchor is disposed in the second axial position, the anchor is supported by the outer body in a radially outer position.

7. The activation tool of claim 6, wherein, when the anchor is in the armed position, the biasing member is configured to act against the second ring to bias the anchor towards the second position.

8. The activation tool of claim 3, wherein:

when the anchor is in the unarmed position, the biasing member is configured to bias the anchor in a first axial direction; and when the anchor is in the armed position, the biasing member is configured to bias the anchor in a second axial direction opposite the first axial direction.

9. The activation tool of claim 1, wherein:

an outer surface of the outer body comprises a first groove configured to receive the anchor in response to physical engagement between the anchor and the upward shoulder of the string; and the outer surface of the outer body comprises a second groove axially spaced from the first groove and configured to receive the anchor in response to physical engagement between the anchor and the downward shoulder of the string.

10. The activation tool of claim 9, wherein:

the anchor is allowed to pass through the upward shoulder of the string when the anchor is in the unarmed position and received in the first groove of the outer body; and the anchor is allowed to pass through the downward shoulder of the string when the anchor is in the armed position and received in the second groove of the outer body.

11. An activation tool for anchoring within a string extending through a wellbore, comprising:

an outer body comprising a bore extending therethrough; and a radially expandable anchor disposed about the outer body and comprising an external shoulder, wherein the anchor is configured to selectively anchor the external shoulder of the anchor against an upward shoulder of the string;

a mandrel disposed in the passage of the outer body;

a first inner c-ring disposed radially between the mandrel and outer body, wherein the first inner c-ring comprises a radially inner position restricting relative axial movement between the mandrel and the outer body;

an outer c-ring disposed radially between the outer body and the anchor, wherein the outer c-ring comprises a radially outer position restricting relative axial movement between the anchor and the outer body; and a radially translatable member disposed radially between the first inner c-ring and the outer c-ring.

12. The activation tool of claim 11, wherein:

the anchor comprises a collet including a radially expandable finger; and the radially translatable member comprises a ball disposed in an aperture of the outer body.

13. The activation tool of claim 11, wherein the outer c-ring comprises a radially outer position permitting relative axial movement between the mandrel and the outer body.

14. The activation tool of claim 13, wherein, in response to the first inner c-ring being displaced from the radially inner position to a radially outer position, the radially translatable member is configured to displace the outer c-ring from a radially inner position into the radially outer position permitting relative axial movement between the mandrel and the outer body.

15. The activation tool of claim 1, wherein:

when the outer c-ring is disposed in the radially outer position, the outer c-ring is disposed in a groove in an inner surface of the anchor; and when the first inner c-ring is disposed in the radially inner position, the first inner c-ring is disposed both in a groove in an outer surface of the mandrel and a groove disposed in an inner surface of the outer body.

16. The activation tool of claim 1, wherein the radially translatable member is in physical engagement with both the first inner c-ring and the outer c-ring.

17. The activation tool of claim 1, wherein the first inner c-ring comprises a radially inner position permitting relative axial movement between the anchor and the outer body.

18. The activation tool of claim 1, further comprising:

a second inner c-ring disposed radially between the mandrel and the outer body, and axially spaced from the first inner c-ring; and a moveable bore sensor disposed in the outer body;

wherein the second inner c-ring comprises a radially outer position configured to restrict relative axial movement between the mandrel and the outer body;

wherein, in response to contacting an inner profile of the string, the bore sensor is configured to displace the second inner c-ring from the radially outer position to a radially inner position permitting relative axial movement between the mandrel and the outer body.

19. The activation tool of claim 1, wherein:

the anchor comprises an unarmed position allowing the anchor to pass through the upward shoulder of the string;

the anchor comprises an armed position preventing the anchor to pass through the upward shoulder of the string while allowing the anchor to pass through a downward shoulder of the string; and the anchor is configured to be transitioned from the unarmed position to the armed position in response to engagement from the downward shoulder of the string.

20. The activation tool of claim 19, further comprising:

a first ring disposed radially between the anchor and the outer body; and a shear member configured to frangibly couple the anchor to the first ring;

wherein, when the anchor is in the unarmed position, the shear member is in an unsheared position restricting relative axial movement between the anchor and the first ring;

wherein, when the anchor is in the armed position, the shear member is in a sheared position permitting relative axial movement between the anchor and the first ring.

21. A tool for activating a disconnect assembly comprising:

an inner tubular member;

an outer tubular member surrounding and coupled to the inner tubular member;

at least one atmospheric chamber between the inner and outer tubular members configured to selectively communicate with a hydrostatic well pressure; and a grapple comprising a shoulder with the disconnect assembly;

wherein, in response to communication between the atmospheric chamber and hydrostatic well pressure;

the atmospheric chamber is configured to apply a first force in a first axial direction to the grapple; and the atmospheric chamber is configured to apply a second force in a second axial direction opposite the first axial direction to the outer tubular member.

22. The tool of claim 21 wherein the grapple includes at least one collet mechanism for engaging the disconnect assembly.

23. The tool of claim 21 wherein the disconnect assembly comprises:

a first tubular member including a first inner spline;

a second tubular member including a second inner spline; and an inner sleeve including an upper spline engaged with the first inner spline and a lower spline engaged with the second inner spline;

wherein the grapple is engageable with an inner portion of the first tubular member and an inner portion of the inner sleeve.

24. The tool of claim 23, further comprising:

a shear member frangibly coupling the grapple to the outer body to restrict relative axial movement between the grapple and the outer body;

wherein, in response to communication between the atmospheric chamber and hydrostatic well pressure, the atmospheric chamber is configured to shear the shear member to permit relative axial movement between the grapple and the outer body.

25. The tool of claim 24, wherein, in response to shearing of the shear member, the grapple is configured to displace a lock sleeve of the disconnect assembly to unlock the first tubular member and the second tubular member of the disconnect assembly.

26. The tool of claim 21, further comprising:

an axial passage disposed in the inner tubular member and configured to communicate with hydrostatic well pressure when the tool is disposed in a well; and a radial passage disposed in the inner tubular member;

wherein, when the inner tubular member is in a first axial position relative the outer tubular member, fluid communication between the axial passage of the inner tubular member and the atmospheric chamber is restricted;

wherein, when the inner tubular member is in a second axial position relative the outer tubular member, fluid communication is permitted between the axial passage of the inner tubular member and the atmospheric chamber.

27. A tool for activating a disconnect assembly comprising:

an inner tubular member;

an outer tubular member surrounding and coupled to the inner tubular member;

a grapple comprising a shoulder to interact with the disconnect assembly; and a moveable bore sensor coupled to and extending from the outer tubular member, wherein the bore sensor is configured to land in an inner profile of the disconnect assembly.

28. The tool of claim 27 wherein the bore sensor is configured to selectively pass through another disconnect assembly and land in the inner profile of a selected disconnect assembly.

29. The tool of claim 27 wherein the disconnect assembly comprises:

a first tubular member including a first inner spline;

a second tubular member including a second inner spline; and an inner sleeve including an upper spline engaged with the first inner spline and a lower spline engaged with the second inner spline;

wherein the shoulder of the grapple is engageable with an inner portion of the first tubular member and an inner portion of the inner sleeve.

* * * * *